US007222069B2

(12) United States Patent
Suzuki et al.

(10) Patent No.: US 7,222,069 B2
(45) Date of Patent: May 22, 2007

(54) VOICE CODE CONVERSION APPARATUS

(75) Inventors: Masanao Suzuki, Kawasaki (JP); Yasuji Ota, Kawasaki (JP); Yoshiteru Tsuchina, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 4 days.

(21) Appl. No.: 11/284,332

(22) Filed: Nov. 21, 2005

(65) Prior Publication Data

US 2006/0074644 A1 Apr. 6, 2006

Related U.S. Application Data

(62) Division of application No. 09/818,355, filed on Mar. 27, 2001, now Pat. No. 7,016,831.

(30) Foreign Application Priority Data

Oct. 30, 2000 (JP) ..... 2000-330108
Mar. 16, 2001 (JP) ..... 2001-075427

(51) Int. Cl.
*G10L 19/04* (2006.01)
*G10L 19/12* (2006.01)

(52) U.S. Cl. ..... 704/201; 704/221; 704/230

(58) Field of Classification Search ..... 704/201, 704/206, 207, 219, 221, 223, 203, 225, 226, 704/230

See application file for complete search history.

(56) References Cited

U.S. PATENT DOCUMENTS 5,541,852 A 7/1996 Eyuboglu et al.
5,764,298 A 6/1998 Morrison
5,995,923 A 11/1999 Mermelstein et al.
6,460,158 B1 10/2002 Baggen
6,463,414 B1 10/2002 Su et al.
6,493,386 B1 12/2002 Vetro et al.
6,748,020 B1 6/2004 Eifrig et al.
6,829,579 B2 * 12/2004 Jabri et al. ..... 704/221
7,016,831 B2 * 3/2006 Suzuki et al. ..... 704/203
7,092,875 B2 * 8/2006 Tsuchinaga et al. ..... 704/210
2002/0077812 A1 6/2002 Suzuki et al.
2003/0065508 A1 * 4/2003 Tsuchinaga et al. ..... 704/215
2003/0142699 A1 7/2003 Suzuki et al.
2003/0177004 A1 * 9/2003 Jabri et al. ..... 704/219
2004/0068404 A1 * 4/2004 Tanaka et al. ..... 704/229

(Continued)

FOREIGN PATENT DOCUMENTS

JP 8-146997 6/1996

(Continued)

*Primary Examiner*—Martin Lerner
(74) *Attorney, Agent, or Firm*—Katten Muchin Rosenman LLP

(57) ABSTRACT

Disclosed is a voice code conversation apparatus to which voice code obtained by a first voice encoding method is input for converting this voice code to voice code of a second voice encoding method. The apparatus includes a code separating unit for separating, from the voice code based upon the first voice encoding method, codes of a plurality of components necessary to reconstruct a voice signal, code converters for dequantizing the codes of each of the components and then quantizing the dequantized values by the second voice encoding method to thereby generate codes, and a code multiplexer for multiplexing the codes output from respective ones of the code converters and transmitting voice code based upon the second voice encoding method.

14 Claims, 29 Drawing Sheets

U.S. PATENT DOCUMENTS

2005/0010400 A1 1/2005 Murashima
2005/0027517 A1* 2/2005 Jabri et al. ..... 704/219
2005/0053130 A1* 3/2005 Jabri et al. ..... 375/240
2005/0131682 A1* 6/2005 Murashima ..... 704/219
2005/0159943 A1* 7/2005 Zinser et al. ..... 704/219
2006/0088093 A1* 4/2006 Lakaniemi et al. .... 375/240.01
2006/0159185 A1* 7/2006 D'Antonio et al. ..... 375/242

FOREIGN PATENT DOCUMENTS

WO WO 99/63728 12/1999
WO WO 00/48170 8/2000

* cited by examiner

FIG. 4A
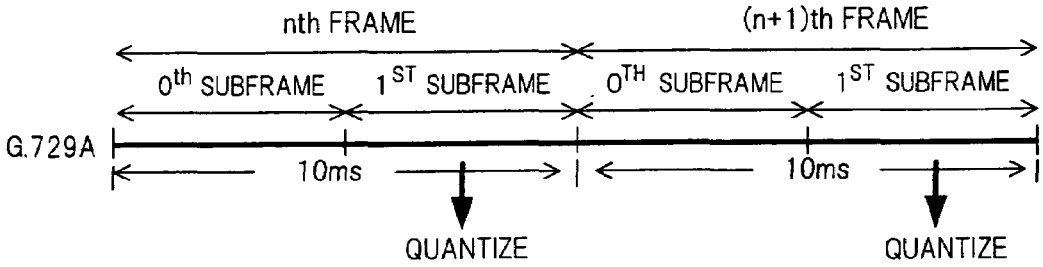
FIG. 4B
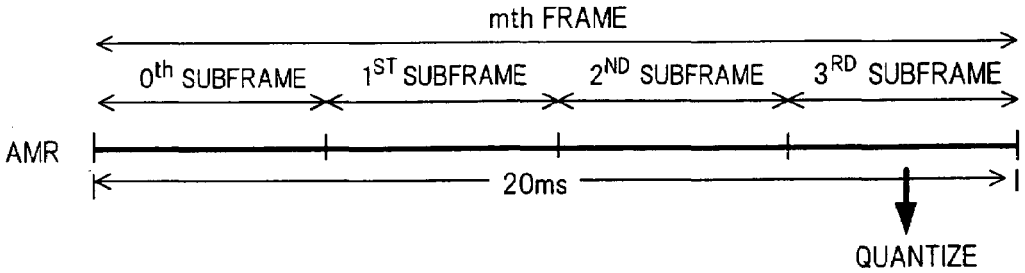
FIG. 6
(a)
| | SUBFRAME NO. / FRAME NO. | | | |
|---|---|---|---|---|
| G.729 | 0/n | 1/n | 0/(n+1) | 1/(n+1) |
| AMR | 0/m | 1/m | 2/m | 3/m |
CORRESPONDS TO NUMBER OF BITS OF PITCH-LAG CODE IN EACH SUBFRAME
(b)
| | PITCH-LAG CODE (NUMBER OF BITS ) | | | |
|---|---|---|---|---|
| G.729 | 8 | 5 | 8 | 5 |
| AMR | 8 | 6 | 8 | 6 |
CORRESPONDS TO NUMBER OF BITS OF ALGEBRAIC CODE IN EACH SUBFRAME
(c)
| | ALGEBRAIC CODE | | | |
|---|---|---|---|---|
| G.729 | 17 | 17 | 17 | 17 |
| AMR | 17 | 17 | 17 | 17 |

| PULSE SYSTEM | PULSE POSITION | POLARITY |
|---|---|---|
| 1 | 0,5,10,15,20,25,30,35 | +/− |
| 2 | 1,6,11,16,21,26,31,36 | +/− |
| 3 | 2,7,12,17,22,27,32,37 | +/− |
| 4 | 3,8,13,18,23,28,33,38<br>4,9,14,19,24,29,34,39 | +/− |

| | ITU-T G.729A | GSM-AMR |
|---|---|---|
| SAMPLING FREQUENCY | 8kHz | 8kHz |
| FRAME LENGTH | 10ms | 20ms |
| SUBFRAME LENGTH | 5ms | 5ms |
| NUMBER OF SUBFRAMES | 2 | 4 |
| BASIC DELAY | 15ms | 20ms |
| LINEAR PREDICTION DEGREE | 10 | 10 |

| | ITU-T G.729A | AMR (7.95-kbps MODE) |
|---|---|---|
| PARAMETER | BIT LENGTH (SUBFRAME/FRAME) | BIT LENGTH (SUBFRAME/FRAME) |
| LSP CODE | -/18 | -/27 |
| PITCH-LAG CODE | 8+5/13 | 8+6+8+6/28 |
| PITCH PARITY | 1/1 | — |
| ALGEBRAIC CODE | 17+17/34 | 17+17+17+17/68 |
| GAIN CODE | 7+7/14 | — |
| ADAPTIVE CODEBOOK GAIN CODE | — | 4+4+4+4/16 |
| ALGEBRAIC CODEBOOK GAIN CODE | — | 5+5+5+5/20 |
| TOTAL | 80bit/10ms | 159bit/20ms |

VOICE CODE CONVERSION APPARATUS

CROSS-REFERENCE TO RELATED APPLICATION

This application is a divisional of U.S. application Ser. No. 09/818,355 filed on Mar. 27, 2001, now U.S. Pat. No. 7,016,831, which claims priority from Japanese Patent Applications 2000-330108 filed Oct. 30, 2000 and 2001-075427 filed Mar. 16, 2001, which is hereby incorporated by reference in its entirety.

BACKGROUND OF THE INVENTION

This invention relates to a voice code conversion apparatus and, more particularly, to a voice code conversion apparatus to which a voice code obtained by a first voice encoding method is input for converting this voice code to a voice code of a second voice encoding method and outputting the latter voice code.

There has been an explosive increase in subscribers to cellular telephones in recent years and it is predicted that the number of such users will continue to grow in the future. Voice communication using the Internet (Voice over IP, or VoIP) is coming into increasingly greater use in intracorporate IP networks (intranets) and for the provision of long-distance telephone service. In voice communication systems such as cellular telephone systems and VoIP, use is made of voice encoding technology for compressing voice in order to utilize the communication line effectively. In the case of cellular telephones, the voice encoding technology used differs depending upon the country or system. With regard to W-CDMA expected to be employed as the next-generation cellular telephone system, AMR (Adaptive Multi-Rate) has been adopted as the common global voice-encoding method. With VoIP, on the other hand, a method compliant with ITU-T Recommendation G.729A is being used as the voice encoding method. The AMR and G.729A methods both employ a basic algorithm referred to as CELP (Code Excited Linear Prediction). The CELP operating principles will now be described taking the G.729A method as an example.

CELP Operating Principles

CELP is characterized by the efficient transmission of linear prediction coefficients (LPC coefficients) representing the voice characteristics of the human vocal tract, and a sound-source signal comprising the pitch component and noise component of voice. More specifically, in accordance with CELP, the human vocal tract is approximated by an LPC synthesis filter H(z) expressed by the following equation:

$$H(z) = \frac{1}{1 + \sum_{i=1}^{p} a_i z^{-i}} \tag{1}$$

and it is assumed that the sound-source signal input to the LPC synthesis filter H(z) can be separated into a pitch-period component representing the periodicity of voice and a noise component representing randomness. CELP, rather than transmitting the input voice signal to the decoder side directly, extracts the filter coefficients of the LPC synthesis filter and the pitch-period and noise components of the excitation signal, quantizes these to obtain quantization indices and transmits the quantization indices, thereby implementing a high degree of information compression.

Encoder Structure and Operation

FIG. 23 is a diagram illustrating a method compliant with ITU-U Recommendation G.729A. As shown in FIG. 23, input signals (voice signals) X of a predetermined number (=N) of samples per frame are input to an LPC analyzer 1 frame by frame. If the sampling speed is 8 kHz and the period of a single frame is 10 ms, then one frame is composed of 80 samples. The LPC analyzer 1, which is regarded as an all-pole filter represented by Equation (1), obtains filter coefficients $\alpha i$ (i=1, . . . , p), where p represents the order of the filter. Generally, in the case of voice in the telephone band, a value of 10 to 12 is used as p. The LPC analyzer 1 performs LPC analysis using the input signal (80 samples), 40 pre-read samples and 120 past samples, for a total of 240 samples, and obtains the LPC coefficients.

A parameter converter 2 converts the LPC coefficients to LSP (Line Spectrum Pair) parameters. An LSP parameter is a parameter of a frequency region in which mutual conversion with LPC coefficients is possible. Since a quantization characteristic is superior to LPC coefficients, quantization is performed in the LSP domain. An LSP quantizer 3 quantizes an LSP parameter obtained by the conversion and obtains an LSP code and an LSP dequantized value. An LSP interpolator 4 obtains an LSP interpolated value from the LSP dequantized value found in the present frame and the LSP dequantized value found in the previous frame. More specifically, one frame is divided into two subframes, namely first and second subframes, of 5 ms each, and the LPC analyzer 1 determines the LPC coefficients of the second subframe but not of the first subframe. Using the LSP dequantized value found in the present frame and the LSP dequantized value found in the previous frame, the LSP interpolator 4 predicts the LSP dequantized value of the first subframe by interpolation.

A parameter reverse converter 5 converts the LSP dequantized value and the LSP interpolated value to LPC coefficients and sets these coefficients in an LPC synthesis filter 6. In this case, the LPC coefficients converted from the LSP interpolated values in the first subframe of the frame and the LPC coefficients converted from the LSP dequantized values in the second subframe are used as the filter coefficients of the LPC synthesis filter 6. In subsequent description, 1 having subscript(s) is not a numeral, but an alphabet.

After LSP parameters LSPi (i=1, . . . , p) are quantized as by scalar quantization or vector quantization in the LSP quantizer 3, the quantization indices (LSP codes) are sent to a decoder. FIG. 24 is a diagram useful in describing the quantization method. Here sets of large numbers of quantization LSP parameters have been stored in a quantization table 3*a* in correspondence with index numbers 1 to n. A distance calculation unit 3*b* calculates distance in accordance with the following equation:

$$d = W \cdot \Sigma_i \{lsp_q(i) - lsp(i)\}^2 (i=1-p)$$

where W represents a weighting coefficient.

When q is varied from 1 to n, a minimum-distance index detector 3*c* finds the q for which the distance d is minimum and sends the index q to the decoder side as an LSP code.

Next, sound-source and gain search processing is executed. Sound source and gain are processed on a per-subframe basis. In accordance with CELP, a sound-source signal is divided into a pitch-period component and a noise component, an adaptive codebook 7 storing a sequence of past sound-source signals is used to quantize the pitch-period component and an algebraic codebook 8 or noise codebook is used to quantize the noise component. Described below will be typical CELP-type voice encoding using the adaptive codebook 7 and algebraic codebook 8 as sound-source codebooks.

The adaptive codebook 7 is adapted to output N samples of sound-source signals (referred to as "periodicity signals"), which are delayed successively by one sample, in association with indices 1 to L. FIG. 25 is a diagram showing the structure of the adaptive codebook 7 in the case of a subframe of 40 samples (N=40). The adaptive codebook is constituted by a buffer BF for storing the pitch-period component of the latest (L+39) samples. A periodicity signal comprising 1 to 40 samples is specified by index 1, a periodicity signal comprising 2 to 41 samples is specified by index 2, . . . , and a periodicity signal comprising L to L+39 samples is specified by index L. In the initial state, the content of the adaptive codebook 7 is such that all signals have amplitudes of zero. Operation is such that a subframe length of the oldest signals is discarded subframe by subframe so that the sound-source signal obtained in the present frame will be stored in the adaptive codebook 7.

An adaptive-codebook search identifies the periodicity component of the sound-source signal using the adaptive codebook 7 storing past sound-source signals. That is, a subframe length (=40 samples) of past sound-source signals in the adaptive codebook 7 are extracted while changing, one sample at a time, the point at which read-out from the adaptive codebook 7 starts, and the past sound-source signals are input to the LPC synthesis filter 6 to create a pitch synthesis signal $\beta AP_L$, where $P_L$ represents a past periodicity signal (adaptive code vector), which corresponds to delay L, extracted from the adaptive codebook 7, A the impulse response of the LPC synthesis filter 6, and β the gain of the adaptive codebook.

An arithmetic unit 9 finds an error power $E_L$ between the input voice X and $\beta AP_L$ in accordance with the following equation:

$$E_L=|X-\beta AP_L|^2 \tag{2}$$

If we let $AP_L$ represent a weighted synthesized signal output from the adaptive codebook, Rpp the autocorrelation of $AP_L$ and Rxp the cross-correlation between $AP_L$ and the input signal X, then an adaptive code vector $P_L$ at a pitch lag Lopt for which the error power of Equation (2) is minimum will be expressed by the following equation:

$$\begin{aligned} P_L &= \operatorname{argmax}\left(\frac{R_{xp}^2}{R_{pp}}\right) \\ &= \operatorname{argmax}\left(\frac{(X^{\top}AP_L)^2}{(AP_L)^{\top}(AP_L)}\right) \end{aligned} \tag{3}$$

That is, the optimum starting point for read-out from the adaptive codebook is that at which the value obtained by normalizing the cross-correlation Rxp between the weighted systhesized signal $AP_L$ and the input signal X by the autocorrelation Rpp of the weighted systhesized signal is largest. Accordingly, an error-power evaluation unit 10 finds the pitch lag Lopt that satisfies Equation (3). Optimum pitch gain βopt is given by the following equation:

$$\beta opt=Rxp/Rpp \tag{4}$$

Next, the noise component contained in the sound-source signal is quantized using the algebraic codebook 8. The latter is constituted by a plurality of pulses of amplitude 1 or −1. By way of example, FIG. 26 illustrates pulse positions for a case where frame length is 40 samples. The algebraic codebook 8 divides the N (=40) sampling points constituting one frame into a plurality of pulse-system groups 1 to 4 and, for all combinations obtained by extracting one sampling point from each of the pulse-system groups, successively outputs, as noise components, pulsed signals having a +1 or a −1 pulse at each sampling point. In this example, basically four pulses are deployed per frame. FIG. 27 is a diagram useful in describing sampling points assigned to each of the pulse-system groups 1 to 4.

(1) Eight sampling points 0, 5, 10, 15, 20, 25, 30, 35 are assigned to the pulse-system group 1;

(2) eight sampling points 1, 6, 11, 16, 21, 26, 31, 36 are assigned to the pulse-system group 2;

(3) eight sampling points 2, 7, 12, 17, 22, 27, 32, 37 are assigned to the pulse-system group 3; and (4) 16 sampling points 3, 4, 8, 9, 13, 14, 18, 19, 23, 24, 28, 29, 33, 34, 38, 39 are assigned to the pulse-system group 4.

Three bits are required to express the sampling points in pulse-system groups 1 to 3 and one bit is required to express the sign of a pulse, for a total of four bits. Further, four bits are required to express the sampling points in pulse-system group 4 and one bit is required to express the sign of a pulse, for a total of five bits. Accordingly, 17 bits are necessary to specify a pulsed signal output from the algebraic codebook 8 having the pulse placement of FIG. 26, and $2^{17}$ ($=2^4\times2^4\times2^4\times2^5$) types of pulsed signals exist.

The pulse positions of each of the pulse systems are limited as illustrated in FIG. 26. In the algebraic codebook search, a combination of pulses for which the error power relative to the input voice is minimized at the reproduction is decided from among the combinations of pulse positions of each of the pulse systems. More specifically, with βopt as the optimum pitch gain found by the adaptive-codebook search, the output PL of the adaptive codebook is multiplied by βopt and the product input to an adder 11. At the same time, the pulsed signals are input successively to the adder 11 from the algebraic codebook 8 and a pulse signal is specified that will minimize the difference between the input signal X and a reproduced signal obtained by inputting the adder output to the LPC synthesis filter 6. More specifically, first a target vector X' for an algebraic codebook search is generated in accordance with the following equation using the optimum adaptive codebook output PL and optimum pitch gain βopt obtained from the input signal X by the adaptive-codebook search:

$$X'=X-\beta optAPL \tag{5}$$

In this example, pulse position and amplitude (sign) are expressed by 17 bits and therefore 217 combinations exist, as mentioned above. Accordingly, letting CK represent a kth algebraic-code output vector, a code vector CK that will minimize an evaluation −function error output power D in the following equation is found by a search of the algebraic codebook:

$$D=|X'-GcACK|2 \tag{6}$$

where Gc represents the gain of the algebraic codebook. Minimizing Equation (6) is equivalent to finding the CK, i.e., the k, that will minimize the following equation:

$$D' = \frac{(X'^{T} AC_k)^2}{(AC_k)^{T}(AC_k)} \quad (7)$$

Thus, in the algebraic codebook search, the error-power evaluation unit 10 searches for the k that specifies the combination of pulse position and polarity that will afford the largest value obtained by normalizing the cross-correlation between the algebraic synthesis signal $AC_K$ and target signal X' by the autocorrelation of the algebraic synthesis signal $AC_K$.

Gain quantization will be described next. With the G.729A system, the algebraic codebook gain is not quantized directly. Rather, the adaptive codebook gain $G_a$ (=βopt) and a correction coefficient γ of the algebraic codebook gain $G_c$ are vector quantized together. The algebraic codebook gain $G_c$ and the correction coefficient γ are related as follows:

$$G_c = g' \times \gamma$$

where g' represents the gain of the present frame predicted from the logarithmic gains of four past subframes. A gain quantizer 12 has a gain quantization table (gain codebook), not shown, for which there are prepared 128 ($=2^7$) combinations of adaptive codebook gain $G_a$ and correction coefficients γ for algebraic codebook gain. The method of the gain codebook search includes (1) extracting one set of table values from the gain quantization table with regard to an output vector from the adaptive codebook 7 and an output vector from the algebraic codebook 8 and setting these values in gain varying units 13, 14, respectively; (2) multiplying these vectors by gains $G_a$, $G_c$ using the gain varying units 13, 14, respectively, and inputting the products to the LPC synthesis filter 6; and (3) selecting, by way of the error-power evaluation unit 10, the combination for which the error power relative to the input signal X is smallest.

A line encoder 15 creates line data by multiplexing (1) an LSP code, which is the quantization index of the LSP, (2) a pitch-lag code Lopt, (3) an algebraic code, which is an algebraic codebook index, and (4) a gain code, which is a quantization index of gain, and sends the line data to the decoder.

Thus, as described above, the CELP system produces a model of the voice generation process, quantizes the characteristic parameters of this model and transmits the parameters, thereby making it possible to compress voice efficiently.

Decoder Structure and Operation

FIG. 28 is a block diagram illustrating a G.729A-compliant decoder. Line data sent from the encoder side is input to a line decoder 21, which proceeds to output an LSP code, pitch-lag code, algebraic code and gain code. The decoder decodes voice data based upon these codes. The operation of the decoder will now be described, though parts of the description will be redundant because functions of the decoder are included in the encoder.

Upon receiving the LSP code as an input, an LSP dequantizer 22 applies dequantization and outputs an LSP dequantized value. An LSP interpolator 23 interpolates an LSP dequantized value of the first subframe of the present frame from the LSP dequantized value in the second subframe of the present frame and the LSP dequantized value in the second subframe of the previous frame. Next, a parameter reverse converter 24 converts the LSP interpolated value and the LSP dequantized value to LPC synthesis filter coefficients. A G.729A-compliant synthesis filter 25 uses the LPC coefficient converted from the LSP interpolated value in the initial first subframe and uses the LPC coefficient converted from the LSP dequantized value in the ensuing second subframe.

An adaptive codebook 26 outputs a pitch signal of subframe length (=40 samples) from a read-out starting point specified by a pitch-lag code, and a noise codebook 27 outputs a pulse position and pulse polarity from a read-out position that corresponds to an algebraic code. A gain dequantizer 28 calculates an adaptive codebook gain dequantized value and an algebraic codebook gain dequantized value from the gain code applied thereto and sets these vales in gain varying units 29, 30, respectively. A adder 31 creates a sound-source signal by adding a signal, which is obtained by multiplying the output of the adaptive codebook by the adaptive codebook gain dequantized value, and a signal obtained by multiplying the output of the algebraic codebook by the algebraic codebook gain dequantized value. The sound-source signal is input to an LPC synthesis filter 25. As a result, reproduced voice can be obtained from the LPC synthesis filter 25.

In the initial state, the content of the adaptive codebook 26 on the decoder side is such that all signals have amplitudes of zero. Operation is such that a subframe length of the oldest signals is discarded subframe by subframe so that the sound-source signal obtained in the present frame will be stored in the adaptive codebook 26. In other words, the adaptive codebook 7 of the encoder and the adaptive codebook 26 of the decoder are always maintained in the identical, latest state.

Difference between G.729A and AMR-Compliant Encoding Methods

The difference between the G.729-compliant voice encoding method and the AMR voice encoding method will be described next. FIG. 29 illustrates results obtained by comparing the main features of the G.729A and AMR voice encoding methods. It should be noted that although there are a total of eight types of AMR encoding modes, the particulars shown in FIG. 29 are common for all encoding modes. The G.729A and AMR voice encoding methods have the same input-signal sampling frequency (=8 kHz), the same subframe length (=5 ms) and the same order of linear prediction (=order ten). However, as shown in FIG. 30, they have different frame lengths and different numbers of subframes per frame. In the G.729A method, one frame is composed of two subframes, namely $0^{th}$ and $1^{st}$ subframes; in the AMR method, one frame is composed of four subframes, namely $0^{th}$ to $3^{rd}$ subframes.

FIG. 31 illustrates the result of comparing the bit assignments of the G.729A and AMR methods. FIG. 31 illustrates a case where the mode for the AMR method is 7.95 kbps, which is nearest to the bit rate of the G.729A method. It is obvious from FIG. 31 that although the numbers of bits (=17) of the algebraic codebook per subframe are the same, the allocations of numbers of bits necessary for other codes differ entirely. Further, with the G.729A method, adaptive codebook gain and algebraic codebook gain are vector quantized collectively and, as a consequence, there is one type of gain code per subframe. With the AMR method, however, there are two types of gain codes, namely adaptive codebook gain and algebraic codebook gain, per subframe.

As described above, a common basic algorithm is used by the G.729A method now employed widely for VoIP in the communication of voice over the Internet and by the AMR method adopted for the next-generation cellular telephone system. However, the frame lengths differ and so do the numbers of bits expressing the codes.

It is believed that the growing popularity of the Internet and cellular telephones will lead to ever increasing voice traffic by Internet users and users of cellular telephone networks. FIG. 32 is a conceptual view illustrating the relationship between networks and users in such case. In a case where a user A of a network (e.g., the Internet) 51 communicates by voice with a user B of a network (e.g., a cellular telephone network) 53, communication between the users cannot take place if a first encoding method used in voice communication by the network 51 and a second encoding method used in voice communication by the network 53 differ.

Accordingly, a voice code converter 55 is provided between the networks, as shown in FIG. 32, and is adapted to convert the voice code that has been encoded by one network to the voice code of the encoding method used in the other network.

FIG. 33 shows an example of the prior art using voice code conversion. This example takes into consideration only a case where voice input to a terminal 52 by user A is sent to a terminal 54 of user B. It is assumed here that the terminal 52 possessed by user A has only an encoder 52*a* of an encoding method 1 and that the terminal 54 of user B has only a decoder 54*a* of an encoding method 2.

Voice that has been produced by user A on the transmitting side is input to the encoder 52*a* of encoding method 1 incorporated in terminal 52. The encoder 52*a* encodes the input voice signal to a voice code of the encoding method 1 and outputs this code to a transmission path 51'. When the voice code of encoding method 1 enters via the transmission path 51', a decoder 55*a* of the voice code converter 55 decodes reproduced voice from the voice code of encoding method 1. An encoder 55*b* of the voice code converter 55 then converts the reproduced voice signal to voice code of the encoding method 2 and sends this voice code to a transmission path 53'. The voice code of the encoding method 2 is input to the terminal 54 through the transmission path 53'. Upon receiving the voice code of the encoding method 2 as an input , the decoder 54*a* decodes reproduced voice from the voice code of the encoding method 2. As a result, the user B on the receiving side is capable of hearing the reproduced voice. Processing for decoding voice that has first been encoded and then re-encoding the decoded voice is referred to as "tandem connection".

Voice (reproduced voice) consisting of information compressed by encoding processing contains a lesser amount of voice information in comparison with the original voice (source) and, hence, the sound quality of reproduced voice is inferior to that of the source. In particular, with recent low-bit-rate voice encoding typified by the G.729A and AMR methods, much information contained in input voice is discarded in the encoding process in order to realize a high compression rate. When a tandem connection in which encoding and decoding are repeated is employed, a problem which arises is a marked decline in the quality of reproduced voice.

An additional problem with tandem processing is delay. It is known that when a delay in excess of 100 ms occurs in two-way communication such as a telephone conversation, the delay is perceived by the communicating parties and is a hindrance to conversation. It is known also that even if real-time processing can be executed in voice encoding in which frame processing is carried out, a delay which is four times the frame length basically is unavoidable. For example, since frame length in the AMR method is 20 ms, the delay is at least 80 ms. With the conventional method of voice code conversion, tandem connection is required in the G.729A and AMR methods. The delay in such case is 160 ms or greater. Such a delay is perceivable by the parties in a telephone conversation and is an impediment to conversation.

As described above, in order for voice communication to be performed between networks employing different voice encoding methods, the conventional practice is to execute tandem processing in which a compressed voice code is decoded into voice and then the voice code is re-encoded. Problems arise as a consequence, namely a pronounced decline in the quality of reproduced voice and an impediment to telephone conversion caused by delay.

Another problem is that the prior art does not take the effects of transmission-path error into consideration. More specifically, if wireless communication is performed using a cellular telephone and, bit error or burst error occurs owing to the influence of phenomena such as phasing, the voice code changes to one different from the original and there are instances where the voice code of an entire frame is lost. If traffic is heavy over the Internet, transmission delay grows, the voice code of an entire frame may be lost or frames may change places in terms of their order. Since code conversion will be performed based upon a voice code that is incorrect if transmission-path error is a factor, a conversion to the optimum voice code can no longer be achieved. Thus there is need for a technique that will reduce the effects of transmission-path error.

SUMMARY OF THE INVENTION

Accordingly, an object of the present invention is to so arrange it that the quality of reconstructed voice will not be degraded even when a voice code is converted from that of a first voice encoding method to that of a second voice encoding method.

Another object of the present invention is to so arrange it that a voice delay can be reduced to improve the quality of a telephone conversation even when a voice code is converted from that of a first voice encoding method to that of a second voice encoding method.

Another object of the present invention is to reduce a decline in the sound quality of reconstructed voice ascribable to transmission-path error by eliminating, to the maximum degree possible, the effects of error from a voice code that has been distorted by transmission-path error and applying a voice-code conversion to the voice code in which the effects of error have been reduced.

According to the present invention, the foregoing objects are attained by providing a voice code conversion apparatus to which a voice code obtained by encoding performed by a first voice encoding method is input for converting this voice code to a voice code of a second voice encoding method, comprising: (1) code separating means for separating codes of a plurality of components necessary to reconstruct a voice signal from the voice code based upon the first voice encoding method; (2) dequantizers for dequantizing the codes of each of the components and outputting dequantized values; (3) quantizers for quantizing the dequantized values, which are output from respective ones of the dequantizers, by the second voice encoding method to thereby generate codes; and (4) means for multiplexing the codes output from respective ones of the quantizers and outputting a voice code based upon the second voice encoding method.

In accordance with the voice code conversion apparatus according to the present invention, a voice code based upon a first voice encoding method is dequantized and the dequantized values are quantized and encoded by a second voice encoding method. As a consequence, there is no need to output reconstructed voice in the voice code conversion process. This means that it is possible to suppress a decline in the quality of voice that is eventually reproduced and to reduce signal delay by shortening processing time.

According to another aspect of the present invention, there is provided an acoustic code conversion apparatus to which an acoustic code obtained by encoding an acoustic signal by a first encoding method frame by frame is input for converting this acoustic code to an acoustic code of a second encoding method and outputting the latter acoustic code, comprising: (1) code separating means for separating codes of a plurality of components necessary to reconstruct an acoustic signal from the acoustic code based upon the first encoding method; (2) dequantizers for dequantizing the codes of each of the components and outputting dequantized values if a transmission-path error has not occurred, and outputting dequantized values obtained by applying error concealment processing if a transmission-path error has occurred; (3) quantizers for quantizing the dequantized values, which are output from respective ones of the dequantizers, by the second encoding method to thereby generate codes; and (4) means for multiplexing the codes output from respective ones of the quantizers and outputting an acoustic code that is based upon the second encoding method.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 4A and 4B are diagrams useful in describing frames subjected to LSP quantization;

FIG. 6 is a diagram showing the correspondence between frames and subframes;

DESCRIPTION OF THE PREFERRED EMBODIMENTS (A) Principles of the Present Invention FIG. 1 is a block diagram illustrating the principles of a voice code conversion apparatus according to the present invention. The apparatus receives, as an input signal, a voice code obtained by a first voice encoding method (encoding method 1), and converts this voice code to a voice code of a second voice encoding method (encoding method 2).

Figure 1:
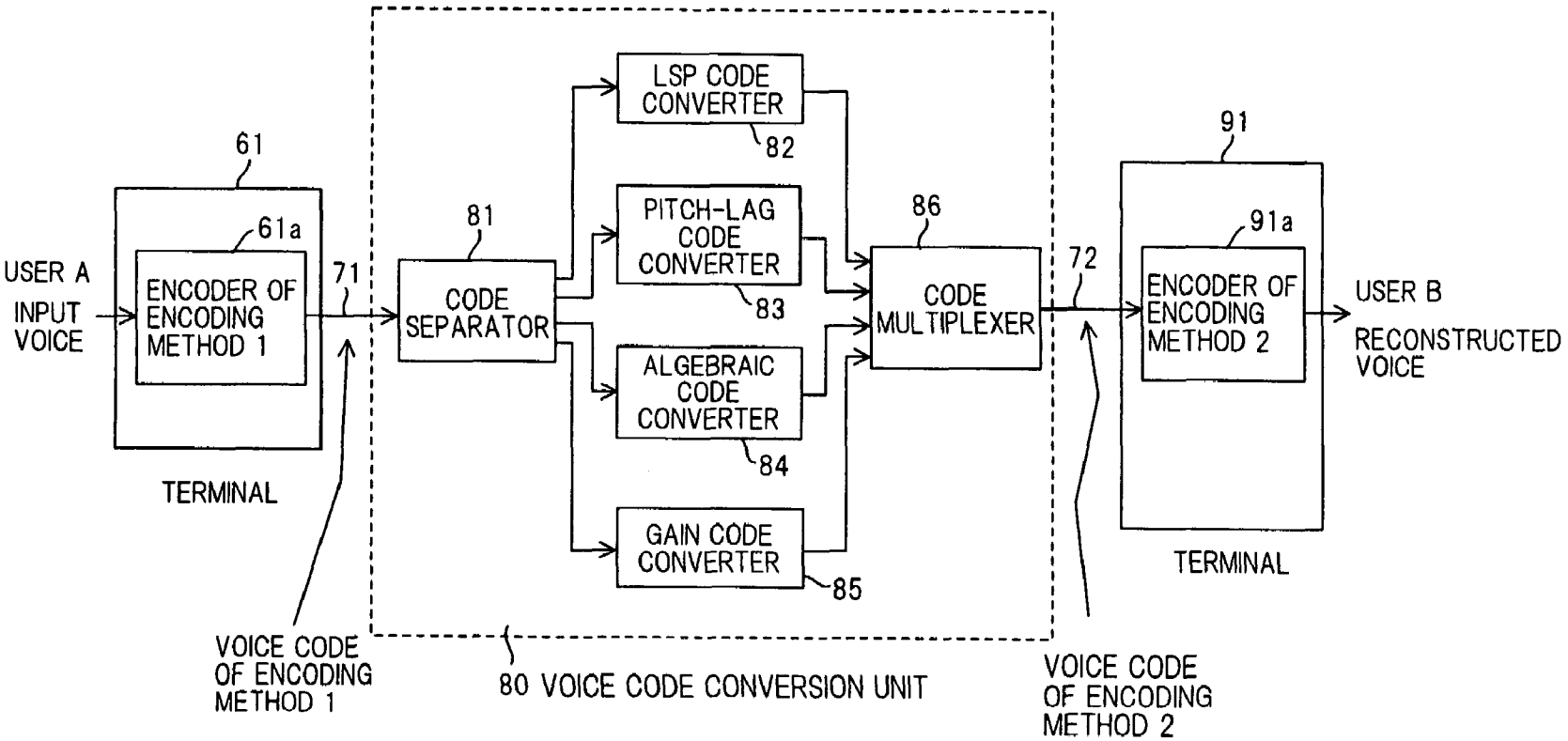
FIG. 1 is a block diagram illustrating the principles of the present invention.

An encoder 61*a* of encoding method 1incorporated in a terminal 61 encodes a voice signal produced by user A to a voice code of encoding method 1and sends this voice code to a transmission path 71. A voice code conversion unit 80 converts the voice code of encoding method 1that has entered from the transmission path 71 to a voice code of encoding method 2 and sends this voice code to a transmission path 72. A decoder 91*a* in a terminal 91 decodes reproduced voice from the voice code of encoding method 2 that enters via the transmission path 72, and a user B is capable of hearing the reproduced voice.

The encoding method 1encodes a voice signal by (1) a first LPC code obtained by quantizing linear prediction coefficients (LPC coefficients), which are obtained by frame-by-frame linear prediction analysis, or LSP parameters found from these LPC coefficients; (2) a first pitch-lag code, which specifies the output signal of an adaptive codebook that is for outputting a periodic sound-source signal; (3) a first noise code, which specifies the output signal of a noise codebook that is for outputting a noisy sound-source signal;

and (4) a first gain code obtained by collectively quantizing adaptive codebook gain, which represents the amplitude of the output signal of the adaptive codebook, and noise codebook gain, which represents the amplitude of the output signal of the noise codebook. The encoding method 2 encodes a voice signal by (1) a second LPC code, (2) a second pitch-lag code, (3) a second noise code and (4) a second gain code, which are obtained by quantization in accordance with a quantization method different from that of the encoding method 1.

The voice code conversion unit 80 has a code separator 81, an LSP code converter 82, a pitch-lag code converter 83, an algebraic code converter 84, a gain code converter 85 and a code multiplexer 86. The code separator 81 separates the voice code of the encoding method 1, which code enters from the encoder 61*a* of terminal 61 via the transmission path 71, into codes of a plurality of components necessary to reproduce a voice signal, namely (1) LSP code, (2) pitch-lag code, (3) algebraic code and (4) gain code. These codes are input to the code converters 82, 83, 84 and 85, respectively. The latter convert the entered LSP code, pitch-lag code, algebraic code and gain code of the encoding method 1to LSP code, pitch-lag code, algebraic code and gain code of the encoding method 2, and the code multiplexer 86 multiplexes these codes of the encoding method 2 and sends the multiplexed signal to the transmission path 72.

Figure 2:
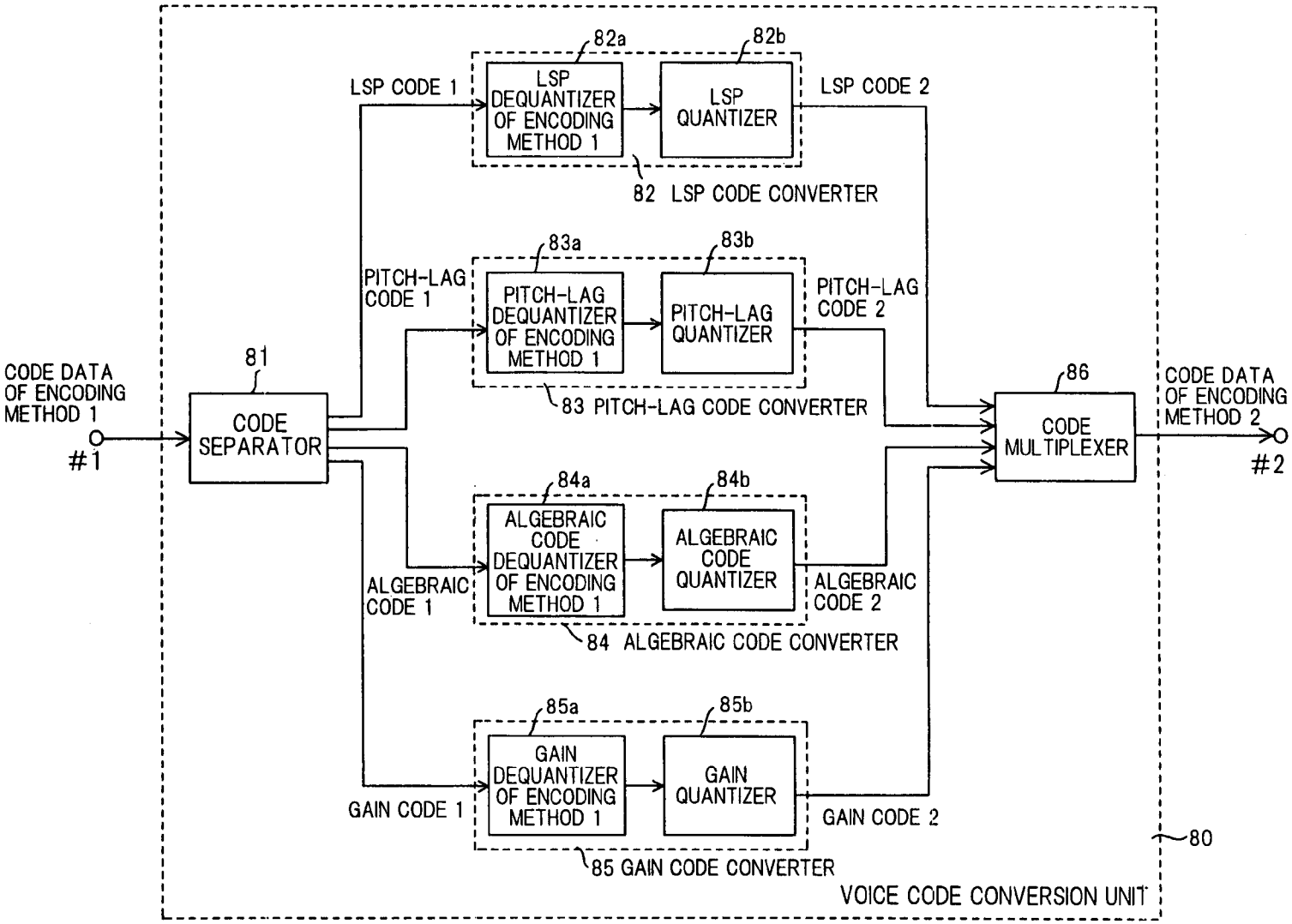
FIG. 2 is a block diagram illustrating the principles of the present invention in greater detail.

FIG. 2 is a block diagram illustrating the voice code conversion unit in which the construction of the code converters 82 to 85 is clarified. Components in FIG. 2 identical with those shown in FIG. 1 are designated by like reference characters. The code separator 81 separates an LSP code 1, a pitch-lag code 1, an algebraic code 1 and a gain code 1 from line data (the voice signal based upon encoding method 1) that enters from the transmission path via an input terminal #1, and inputs these codes to the code converters 82, 83, 84 and 85, respectively.

The LSP code converter 82 has an LSP dequantizer 82*a* for dequantizing the LSP code 1 of encoding method 1and outputting an LSP dequantized value, and an LSP quantizer 82*b* for quantizing the LSP dequantized value by the encoding method 2 and outputting an LSP code 2. The pitch-lag code converter 83 has a pitch-lag dequantizer 83*a* for dequantizing the pitch-lag code 1 of encoding method 1and outputting a pitch-lag dequantized value, and a pitch-lag quantizer 83*b* for quantizing the pitch-lag dequantized value by the encoding method 2 and outputting a pitch-lag code 2. The algebraic code converter 84 has an algebraic dequantizer 84*a* for dequantizing the algebraic code 1 of encoding method 1and outputting an algebraic dequantized value, and an algebraic quantizer 84*b* for quantizing the algebraic dequantized value by the encoding method 2 and outputting an algebraic code 2. The gain code converter 85 has a gain dequantizer 85*a* for dequantizing the gain code 1 of encoding method 1and outputting a gain dequantized value, and a gain quantizer 85*b* for quantizing the gain dequantized value by the encoding method 2 and outputting a gain code 2.

The code multiplexer 86 multiplexes the LSP code 2, pitch-lag code 2, algebraic code 2 and gain code 2, which are output from the quantizers 82*b*, 83*b*, 84*b* and 85*b*, respectively, thereby creating a voice code based upon the encoding method 2 and sends this voice code to the transmission path from an output terminal #2.

In the prior art, the input is a reproduced voice obtained by decoding a voice code that has been encoded in accordance with encoding method 1, and, the reproduced voice is encoded again in accordance with encoding method 2 and then is decoded. As a consequence, since voice parameters are extracted from reproduced voice in which the amount of information has been reduced slightly in comparison with the source owing to the re-encoding (i.e., voice-information compression), the voice code obtained thereby is not necessarily the optimum voice code. By contrast, in accordance with the code conversion apparatus of the present invention, the voice code of encoding method 1 is converted to the voice code of encoding method 2 via the process of dequantization and quantization. As a result, it is possible to carry out voice code conversion with much less degradation in comparison with the conventional tandem connection. An additional advantage is that since it is unnecessary to effect decoding into voice in order to perform the voice code conversion, there is little of the delay that is a problem with the conventional tandem connection.

(B) First Embodiment

Figure 3:
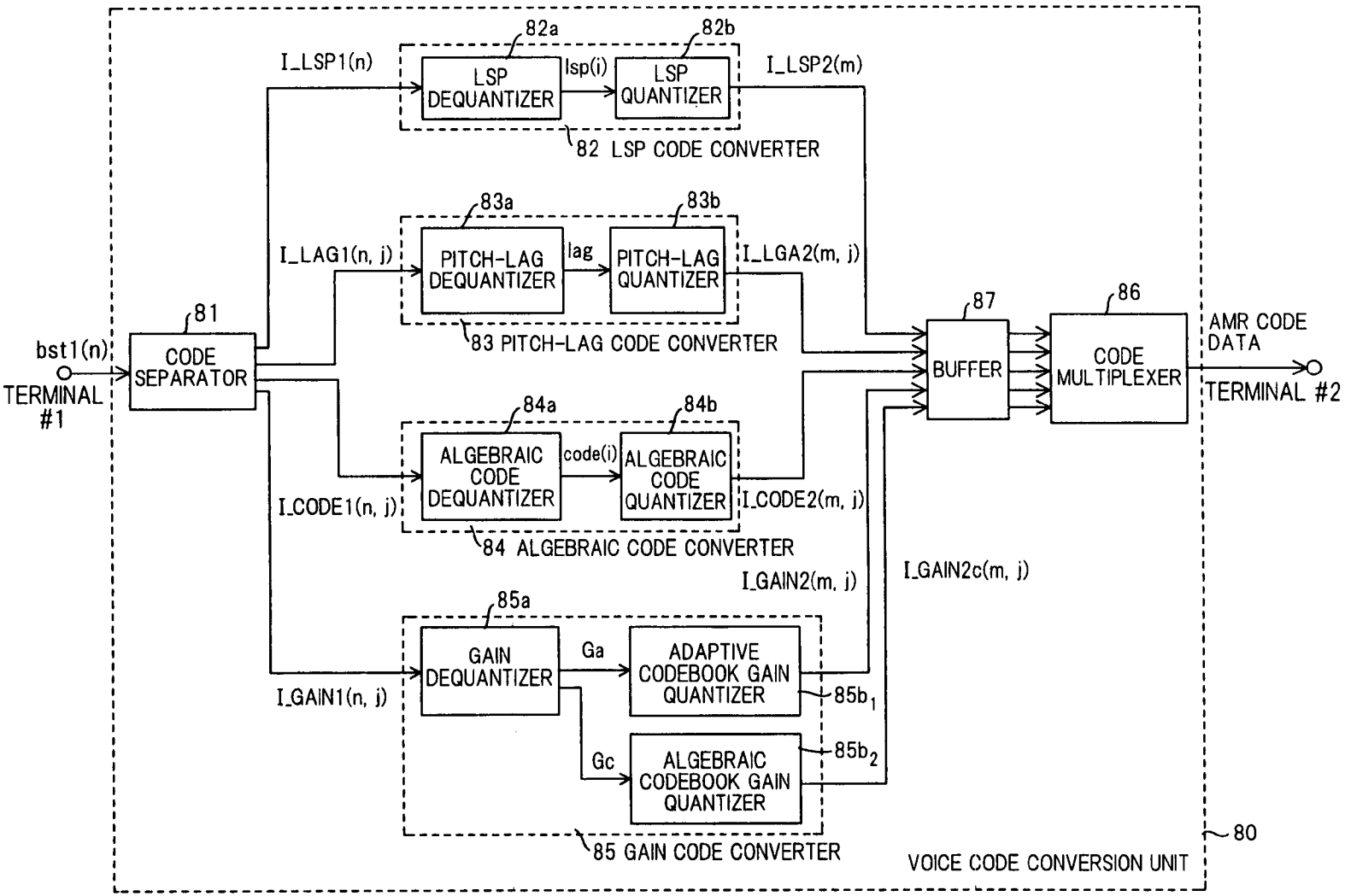
FIG. 3 is a block diagram of a first embodiment of the present invention.

FIG. 3 is a block diagram illustrating a voice code conversion unit according to a first embodiment of the present invention. Components identical with those shown in FIG. 2 are designated by like reference characters. This arrangement differs from that FIG. 2 in that a buffer 87 is provided and in that the gain quantizer of the gain code converter 85 is constituted by an adaptive codebook gain quantizer 85$b_1$ and a noise codebook gain quantizer 85$b_2$. Further, in the first embodiment shown in FIG. 3, it is assumed that the G.729A encoding method is used as encoding method 1and the AMR method as the encoding method 2. Though there are eight encoding modes in AMR encoding, in this embodiment use is made of an encoding mode having a transmission rate of 7.95 kbps.

As shown in FIG. 3, an nth frame of channel data bst1(n) is input to terminal #1 from a G.729A encoder (not shown) via the transmission path. Here the bit rate of G.729A encoding is 8 kbps and therefore the line data bst1(n) is represented by bit sequence of 80 bits. The code separator 81 separates LSP code I_LSP1(n), pitch-lag code I_LAG1(n,j), algebraic code I_CODE1(n,j) and gain code I_GAIN1(n,j) from the line data bst1(n) and inputs these codes to the converters 82, 83, 84 and 85, respectively. The suffix j represents the number of the $0^{th}$ and $1^{st}$ subframes constituting each frame and takes on values of 0 and 1.

(a) LSP Code Converter

FIGS. 4A and 4B are diagrams illustrating the relationship between frames and LSP quantization in the G.729A and AMR encoding methods. As shown in FIG. 4A, frame length according to the G.729A method is 10 ms and an LSP parameter found from the input voice signal of the first subframe ($1^{st}$ subframe) is quantized only once every 10 ms. By contrast, frame length according to the AMR method is 20 ms and an LSP parameter is quantized from the input signal of the third subframe ($3^{rd}$ subframe)only once every 20 ms. In other words, if the same 20 ms is considered to be the frame length in both cases, the G.729A method performs LSP quantization twice whereas the AMR method performs quantization only once. This means that the LSP codes of two consecutive frames in the G.729A method cannot be converted as it is to the LSP code of the AMR method.

According to the first embodiment, therefore, it is so arranged that only the LSP codes of odd-numbered frames are converted to LSP codes of the AMR method; the LSP codes of even-numbered frames are not converted. It is also possible, however, to adopt an arrangement in which only the LSP codes of even-numbered frames are converted to LSP codes of the AMR method and the LSP codes of the odd-numbered frames are not converted. Further, as will be described below, the G.729A-compliant LSP dequantizer

82*a* uses interframe prediction and therefore the updating of status is performed frame by frame.

When LSP code I_LSP1(n+1) of an odd-numbered frame enters the LSP dequantizer 82*a*, the latter dequantizes the code and outputs LSP dequantized values lsp(i) (i=1, . . . , 10). Here the LSP dequantizer 82*a* performs the same operation as that of a dequantizer used in a decoder of the G.729A encoding method.

Next, when an LSP dequantized value lsp(i) enters the LSP quantizer 82*b*, the latter quantizes the value in accordance with the AMR encoding method and obtains LSP code I_LSP2(m). Here it is not necessarily required that the LSP quantizer 82*b* be exactly the same as the quantizer used in an encoder of the AMR encoding method, although it is assumed that at least the LSP quantization table thereof is the same as that of the AMR encoding method.

LSP Dequantization Method in LSP Dequantizers

The G.729A-compliant LSP dequantization method used in the LSP dequantizer 82*a* will be described in line with G.729. If LSP code I_LSP1(n) of an nth frame is input to the LSP dequantizer 82*a*, the latter divides this code into four codes $L_0$, $L_1$, $L_2$ and $L_3$. The code $L_1$ represents an element number (index number) of a first LSP codebook CB1, and the codes $L_2$, $L_3$ represent element numbers of second and third LSP codebooks $CB_2$, $CB_3$, respectively. The first LSP codebook CB1 has 128 sets of 10-dimensional vectors, and the second and third LSP codebooks CB2 and CB3 both have 32 sets of 5-dimensional vectors. The code $L_0$ indicates which of two types of MA prediction coefficients (described later) to use.

Next, a residual vector $l_i^{(n)}$ of the nth frame is found by the following equation:

$$l_i^{(n)} = \begin{cases} CB1(L_1, i) + CB2(L_2, i) & (i = 1, \ldots, 5) \\ CB1(L_1, i) + CB3(L_3, i-5) & (i = 6, \ldots, 10) \end{cases} \quad (8)$$

A residual vector $l_i^{(n+1)}$ of the (n+1)th frame can be found in similar fashion. An LSF coefficient ω(i) is found from the residual vector $l_i^{(n+1)}$ of the (n+1)th frame and residual vectors $l_i^{(n+1-k)}$ of the past four frames in accordance with the following equation:

$$\omega(i) = \left(1 - \sum_{k=1}^{4} p(i, k)\right) l_i^{(n+1)} + \sum_{k=1}^{4} p(i, k) l_i^{(n+1-k)}, \ (i = 1, \ldots, 10) \quad (9)$$

where p(i,k) represents which coefficient of the two types of MA prediction coefficients has been specified by the code $L_0$. It should be noted that an LSF coefficient is not found from a residual vector with regard to the nth frame. The reason for this is that the nth frame is not quantized by the LSP quantizer. However, the residual vector $l_i^{(n)}$ is necessary to update status.

Next, the LSP dequantizer 82*a* finds an LSP dequantized value lsp(i) from the LSP coefficient ω(i) using the following equation:

$$lsp(i) = \cos[\omega(i)] \ (i=1, \ldots, 10) \quad (10)$$

LSP Quantization Method in LSP Quantizers

The details of the LSP quantization method used in the LSP quantizer 82*b* will now be described. In accordance with the AMR encoding method, a common LSP quantization method is used in seven of the eight modes, with the 12.2-kbps mode being excluded. Only the size of the LSP codebook differs. The LSP quantization method in the 7.95-kbps mode will be described here.

If the LSP dequantized value lsp(i) has been found by Equation (10), the LSP quantizer 82*b* finds a residual vector $r(i)^{(m)}$ by subtracting a prediction vector $q(i)^{(m)}$ from the LSP dequantized value lsp(i) in accordance with the following equation:

$$r(i)^m = lsp(i) - q(i)^{(m)} \quad (11)$$

where m represents the number of the present frame.

The prediction vector $q(i)^{(m)}$ is found in accordance with the following equation using a quantized residual vector $\hat{r}(i)^{(m-1)}$ of the immediately preceding frame and an MA prediction vector a(i):

$$q(i)^{(m)} = a(i)\hat{r}(i)^{(m-1)} \quad (12)$$

In accordance with the AMR encoding method, the 10-dimensional vector $r(i)^{(m)}$ is divided into three small vectors $r_1(i)$ (i=1, 2, 3), $r_2(i)$ (i=4, 5, 6) and $r_3(i)$ (i=7, 8, 9, 10) and each of these small vectors is vector-quantized using nine bits.

Vector quantization is so-called pattern-matching processing. From among prepared codebooks (codebooks for which the dimensional lengths are the same as those of the small vectors) CB1 to CB3, the LSP quantizer 82*b* selects a codebook for which the weighted Euclidean distance to each small vector is minimum. The selected codebook serves as the optimum codebook vector. Let $I_1$, $I_2$ and $I_3$ represent numbers (indices) indicating the particular element numbers of the optimum codebook vector in each of the codebooks CB1 to CB3. The LSP quantizer 82*b* outputs an LSP code I_LSP2(m) obtained by combining these indices $I_1$, $I_2$, $I_3$. Since the sizes of all of the codebooks CB1 to CB3 are nine bits (512 sets), the word length of each of the indices $I_1$, $I_2$, $I_3$ also is nine bits and the LSP code I_LSP2(m) has a word length that is a total of 27 bits.

Figure 5:
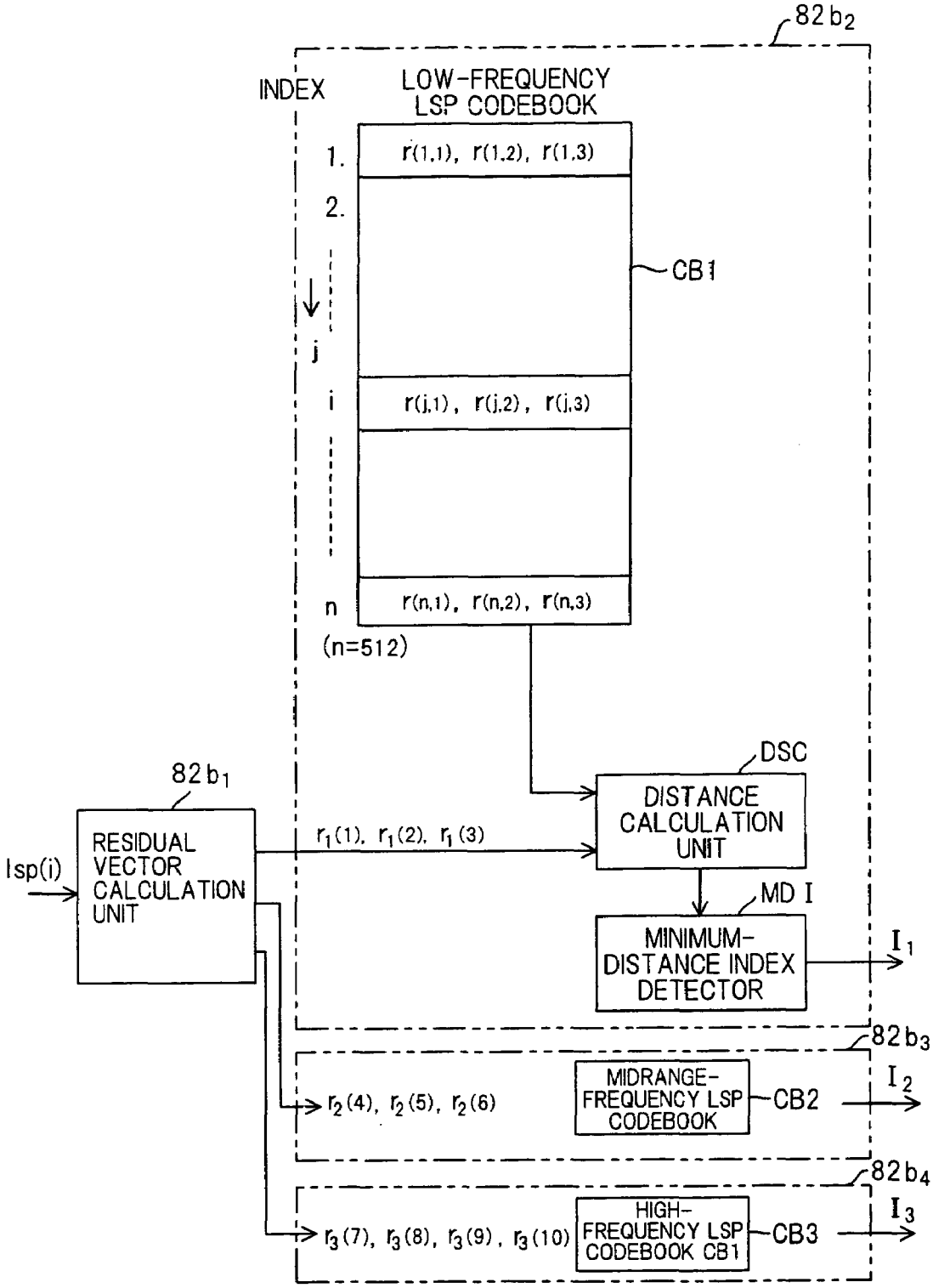
FIG. 5 is a block diagram illustrating the construction of an LSP quantizer.

FIG. 5 is a block diagram illustrating the construction of the LSP quantizer 82*b*. The latter includes a residual vector calculation unit 82*b*$_1$ for outputting the following 10-dimensional residual vector in accordance with Equation (11):

$$r(i) = r_1(i)(i=1, 2, 3), \ r_2(i)(i=4, 5, 6), \ r_3(i) \ (i=7, 8, 9, 10)$$

Optimum codebook vector decision units 82*b*$_2$ to 82*b*$_4$ output the index numbers $I_1$, $I_2$, $I_3$ of an optimum codebook vector for which the weighted Euclidean distances to each of the small vectors $r_1(i)$ (i=1, 2, 3), $r_2(i)$ (i=4, 5, 6), $r_3(i)$ (i=7, 8, 9, 10) are minimum.

Further, 512 sets of 3-dimensional low-frequency LSP vectors r(j,1), r(j,2), r(j,3) (i=1–512) have been stored in the low-frequency LSP codebook CB1 of the optimum codebook vector decision unit 82*b*$_2$ in correspondence with indices 1–512. A distance calculation unit DSC calculates distance in accordance with the following equation:

$$d = \Sigma_i \{r(j,i) - r_1(i)\}^2 (i=1\sim3)$$

When j is varied from 1 to 512, a minimum distance index detector MDI finds the j for which distance d is minimized and outputs j as an LSP code $I_1$ for the low order region.

Though the details are not shown, the optimum codebook vector decision units 82*b*$_3$ and 82*b*$_4$ use the midrange-frequency LSP codebook CB2 and high-frequency LSP codebook CB3 to output the indices $I_2$ and $I_3$, respectively, in a manner similar to that of the optimum codebook vector decision unit 82*b*$_2$.

(b) Pitch-Lag Code Converter

The pitch-lag code converter 83 will now be described.

Figures 29, 30:
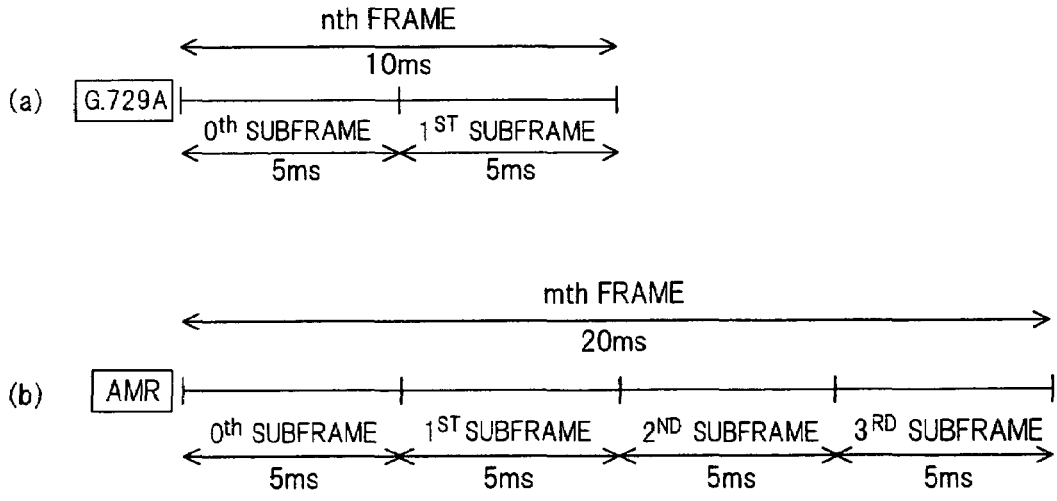
FIG. 29 PRIOR ART
FIG. 30 PRIOR ART
FIG. 29 is a diagram showing a comparison of main features of ITU-T G.729A code conversion and AMR code conversion according to the prior art.
FIG. 30 is a diagram showing a comparison of frame lengths according to the prior art.

As mentioned above (see FIG. 29), frame length is 10 ms in the G.729A encoding method and 20 ms in the AMR encoding method. When the pitch-lag code is converted, therefore, it is necessary that pitch-lag code of two frames in the G.729A method be converted as one frame of pitch-lag code in the AMR method.

Figures 31, 32:
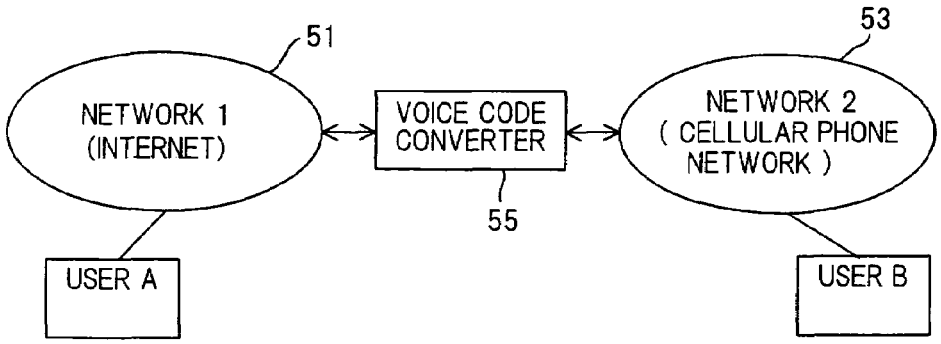
FIG. 31 PRIOR ART
FIG. 32 PRIOR ART
FIG. 31 is a diagram showing a comparison of bit allocations in ITU-T G.729A code conversion and AMR code conversion according to the prior art.
FIG. 32 is a conceptual view of the prior art.
Figure 33:
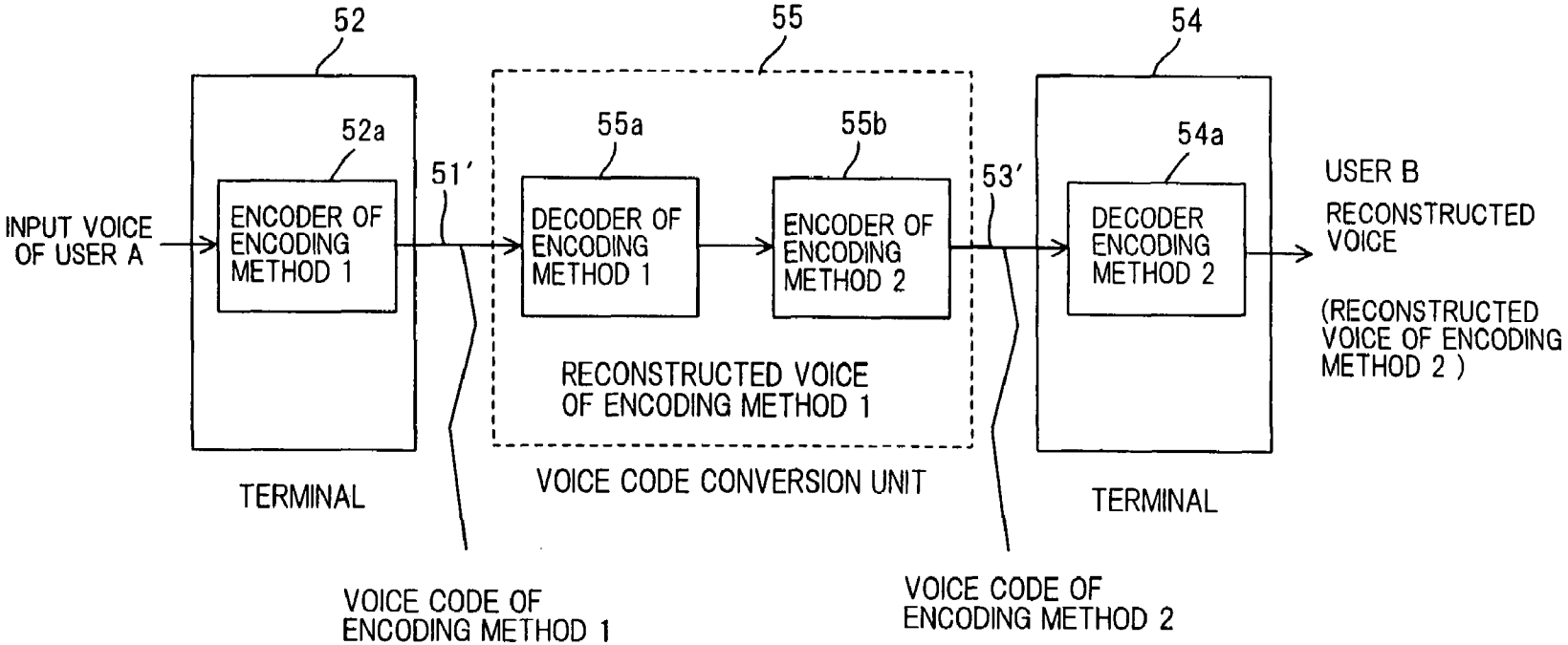
FIG. 33 PRIOR ART
FIG. 33 illustrates an example of voice code conversion according to the prior art.

Consider a case where pitch-lag codes of the nth and (n+1)th frames in the G.729A method are converted to pitch-lag code of the mth frame in the AMR method. If it is assumed that the leading timing of the nth frame in the G.729A method and the leading timing of the mth frame in the AMR method are equal, then the relationship between the frames and subframes of the G.729A and AMR methods will be as shown in (a) of FIG. 6. Further, the quantization bit numbers of pitch lag in each subframe of the G.729A and AMR methods will be as shown in (b) of FIG. 6 (see FIG. 31).

In even-numbered subframes, therefore, the methods of encoding pitch-lags in the G.729A and AMR are exactly the same and the numbers of quantization bits are the same, i.e., eight. This means that a G.729A-compliant pitch-lag code can be converted to an AMR-compliant pitch-lag code in regard to even-numbered subframes by the following equations:

$$I_LAG2(m,0)=I_LAG1(n,0) \tag{13}$$

$$I_LAG2(m,2)=I_LAG1(n+1,0) \tag{14}$$

On the other hand, in odd numbered subframes, quantization of the difference between integral lag of the present frame and integral lag of the preceding subframe is performed in the G.729A and AMR. Since the number of quantization bits is one larger for the AMR method, the conversion can be made by the following equations:

$$I_LAG2(m,1)=I_LAG1(n,1)+15 \tag{15}$$

$$I_LAG2(m,3)=I_LAG1(n+1,1)+15 \tag{16}$$

Equations (13), (14) and Equations (15), (16) will be described in greater detail.

With the G.729A and AMR methods, pitch lag is decided assuming that the pitch period of voice is between 2.5 and 18 ms. If the pitch lag is an integer, encoding processing is simple. In the case of a short pitch period, however, frequency resolution is unsatisfactory and voice quality declines. For this reason, a sample interpolation filter is used to decide pitch lag at one-third the sampling precision in the G.729A and AMR methods. That is, it is just as if a voice signal sampled at a period that is one-third the actual sampling period has been stored in the adaptive codebook.

Thus, two types of pitch lag exist, namely integral lag indicating the actual sampling period and non-integral lag indicating one-third the sampling period.

Figure 7A:
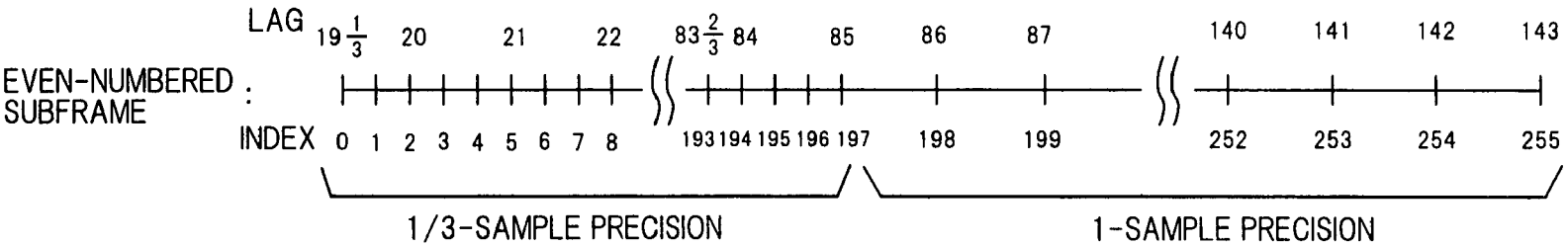
FIGS. 7A and 7B are diagrams showing the relationship between pitch lag and indices in the G.729A method.
Figure 7B:
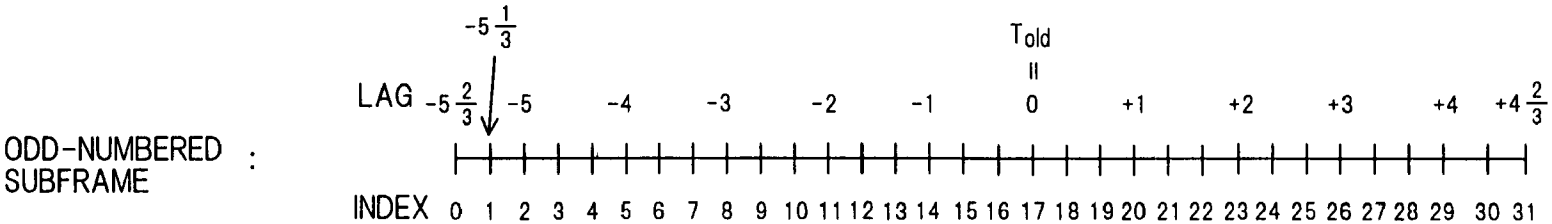

FIGS. 7A and 7B illustrate the relationship between pitch lag and indices in the G.729A method, in which FIG. 7A shows the case for even-numbered subframes and FIG. 7B the case for odd-numbered subframes. In the case of the odd-numbered frames, indices are assigned at one-third the sampling precision for lag values in the range 19+⅓ to 85 and at a precision of one sample for lag values in the range 85 to 143. Here the integral portion of lag is referred to as "integral lag" and the non-integral portion (fractional portion) is referred to as "non-integral lag". In the G.729A method, eight bits are assigned to the pitch lag of the even-numbered subframes and, hence, there are 256 pitch-lag indices. For example, index is 4 in a case where pitch-lag is 20+⅔ and index is 254 in a case where is 142.

On the other hand, in the case of odd-numbered subframes according to the G.729A method, the difference between integral lag $T_{old}$ of the previous subframe (even-numbered) and pitch lag (integral pitch lag or non-integral pitch lag) of the present subframe is quantized using five bits (32 patterns). In the case of odd-numbered subframes, it is assumed that $T_{old}$ is a reference point and that the index of $T_{old}$ is 17, as shown in FIG. 7B. It is assumed that the index of lag that is 5+⅔ samples smaller than $T_{old}$ is zero and that the index of lag that is 4+⅔ samples larger than $T_{old}$ is 31. In other words, the range $T_{old}-(5+⅔)$ to $T_{old}+(4+⅔)$ is equally divided at one-third sample intervals and indices of 32 patterns (5 bits) are assigned.

Figure 8A:
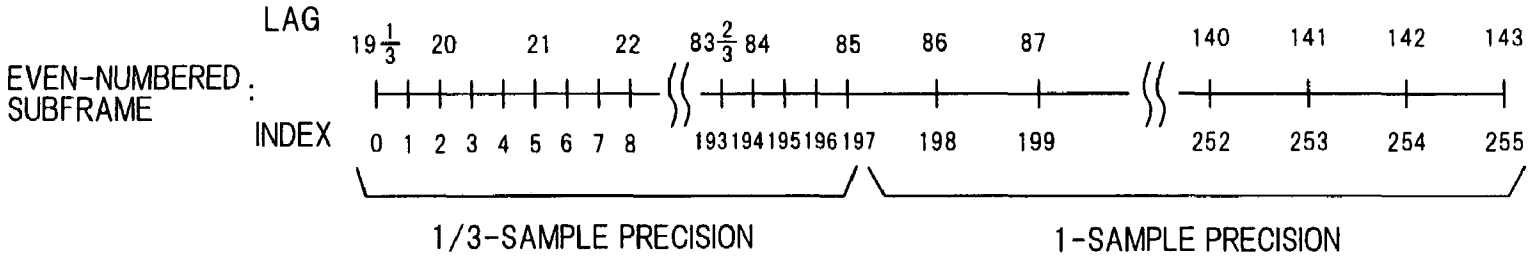
FIGS. 8A and 8B are diagrams showing the relationship between pitch lag and indices in the AMR method.
Figure 8B:
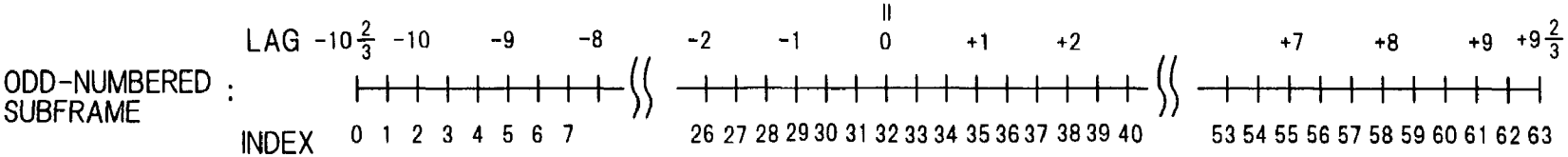

The relationship between pitch lag and indices in the AMR method will now be described. FIG. 8 is a diagram illustrating the relationship between pitch lag and indices in the AMR method, in which FIG. 8A shows the case for even-numbered subframes and FIG. 8B the case for odd-numbered subframes. In the case of the even-numbered subframes of the AMR method, eight bits are assigned to the pitch-lag indices. Pitch lag is composed of integral lag and non-integral lag, and the index-number assignment method is exactly the same as that of the G.729A method. Accordingly, in the case of even-numbered subframes, G.729A-compliant pitch-lag indices can be converted to AMR-compliant pitch-lag indices by Equations (13) and (14).

On the other hand, in the case of odd-numbered subframes according to the AMR method, the difference between integral lag $T_{old}$ of the previous subframe and pitch lag of the present subframe is quantized just as in the case of the G.729A method. However, the number of quantization bits is one larger than in the case of the G.729A method and quantization is performed using six bits (64 patterns). In the case of odd-numbered subframes, it is assumed that $T_{old}$ is a reference point and that the index of $T_{old}$ is 32, as shown in FIG. 8B. It is assumed that the index of lag that is 10+⅔ samples smaller than $T_{old}$ is zero and that the index of lag that is 9+⅔ samples larger than $T_{old}$ is 63. In other words, the range $T_{old}-(10+⅔)$ to $T_{old}+(9+⅔)$ is equally divided at one-third sample intervals and indices of 64 patterns (6 bits) are assigned.

Figure 9:
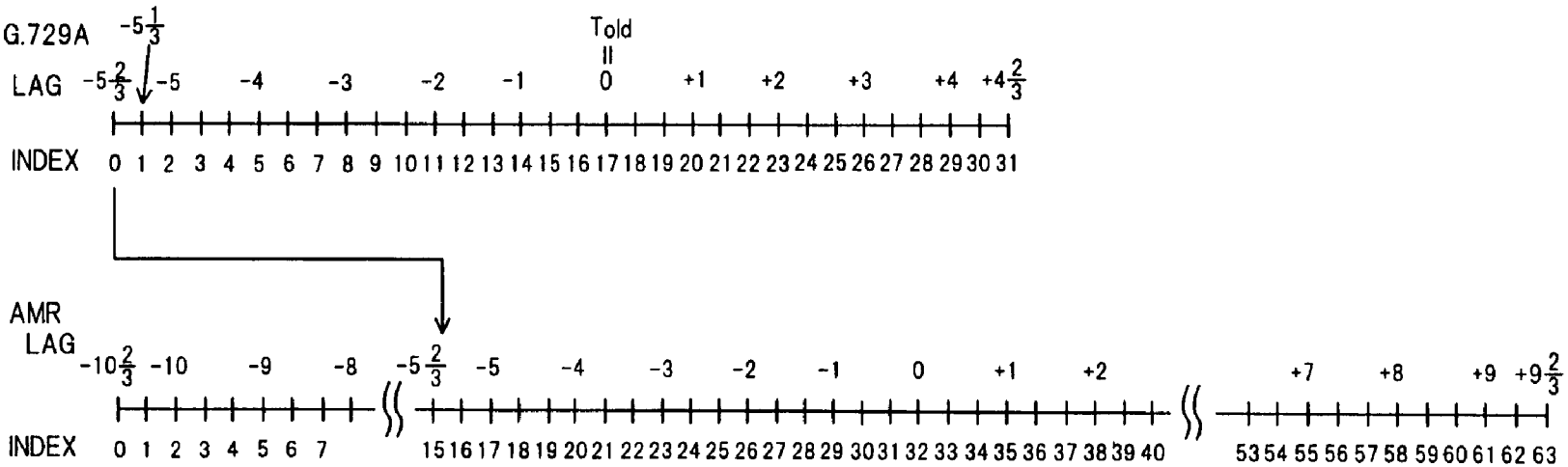
FIG. 9 is a diagram showing the corresponding relationship between pitch lag in the G.729A method and pitch lag in the AMR method.

FIG. 9 is a diagram of corresponding relationships in a case where G.729A-compliant indices in odd-numbered subframes are converted to AMR-compliant indices. As will be understood from FIG. 9, the indices are shifted by a total of 15 from the G.729A method to the AMR method even though the lag values are the same. For example, with regard to lag−(5+⅔), the $0^{th}$ index is assigned in the G.729A method but the $15^{th}$ index is assigned in the AMR method. Accordingly, in order to convert G.729A-compliant indices in odd-numbered subframes to AMR-compliant indices, it is necessary to correct the index values by adding on 15, as indicated by Equations (15), (16).

(c) Conversion of Algebraic Code

Conversion of algebraic code will be described next.

Figures 26, 27:
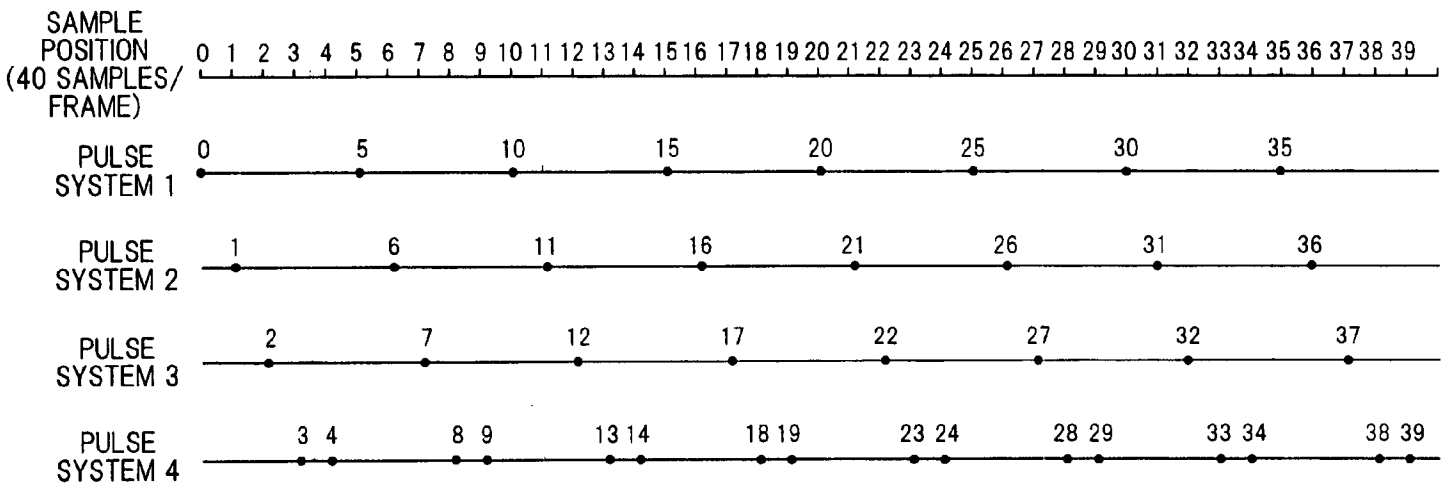
FIG. 26 PRIOR ART
FIG. 27 PRIOR ART
FIG. 26 is a diagram useful in describing an algebraic codebook used in G.729A code conversion according to the prior art.
FIG. 27 is a diagram useful in describing sampling points of pulse-system groups according to the prior art.
Figure 28:
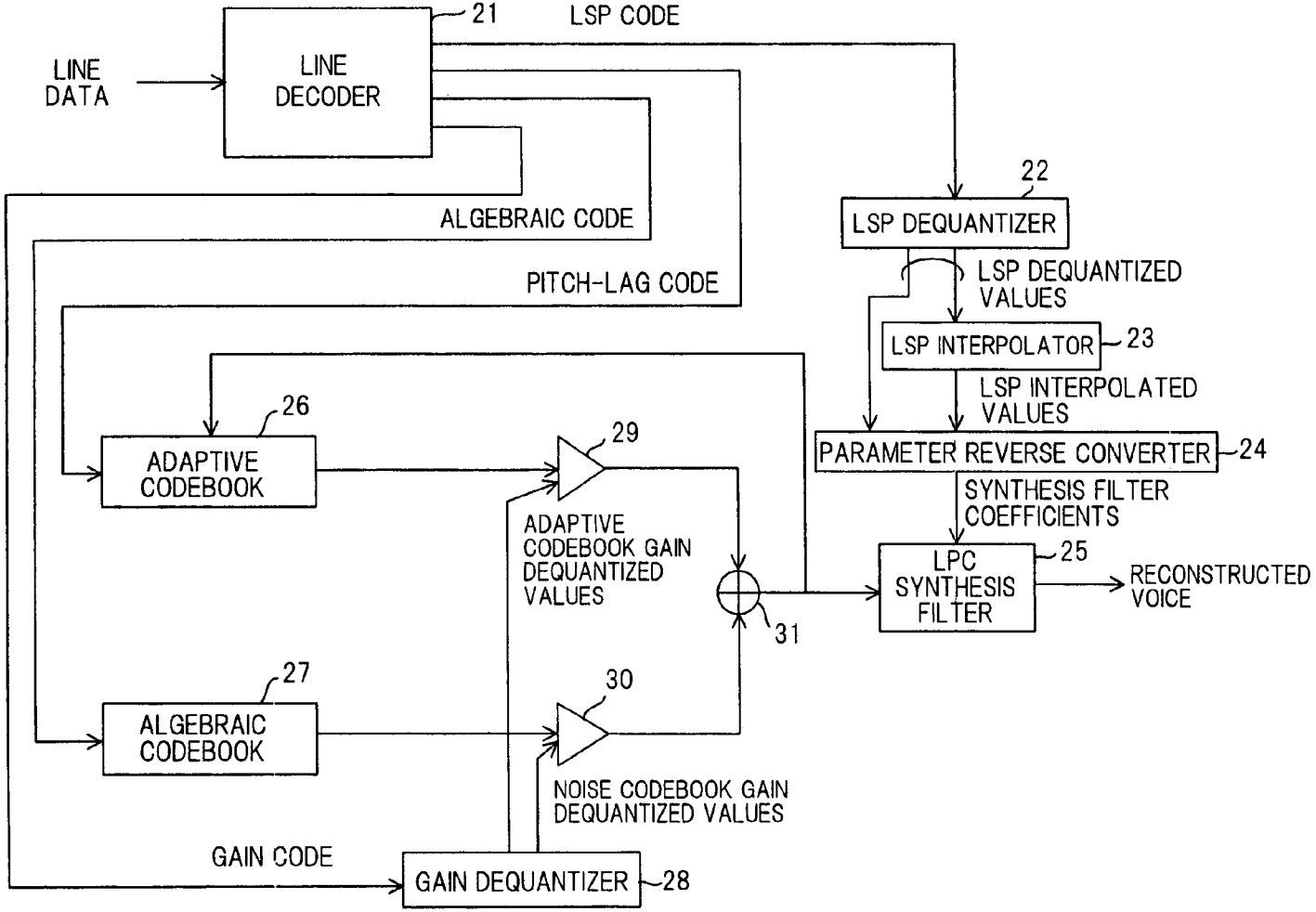
FIG. 28 PRIOR ART
FIG. 28 is a block diagram of a decoder based upon ITU-T G.729A code conversion according to the prior art.

Although frame length in the G.729A method differs from that in the AMR method, subframe length is the same for both, namely 5 ms (40 samples). In other words, the relationship between frames and subframes in the G.729A and AMR methods is as illustrated in (a) of FIG. 6. Further, the numbers of quantization bits of algebraic code in each subframe of the G.729A and AMR methods is as illustrated in (c) of FIG. 6 (see FIG. 31). Furthermore, the algebraic codebooks of both methods have the structure depicted in FIG. 26; the structures are exactly the same.

Accordingly, the four pulse positions and the pulse polarity information that are the results output from the algebraic codebook search in the G.729A method can be replaced as it is on a one-to-one basis by the results output from the algebraic codebook search in the AMR method. The algebraic-code conversions are as indicated by the following:

$$I_CODE2(m,0)=I_CODE1(n,0) \quad (17)$$

$$I_CODE2(m,1)=I_CODE1(n,1) \quad (18)$$

$$I_CODE2(m,2)=I_CODE1(n+1,0) \quad (19)$$

$$I_CODE2(m,3)=I_CODE1(n+1,1) \quad (20)$$

(d) Conversion of Gain Code

Conversion of gain code will be described next.

First, gain code I_GAIN(n,0) is input to the gain dequantizer 85*a* (FIG. 3). In accordance with the G.729A method, vector quantization is used to quantize the gain. Accordingly, an adaptive codebook gain dequantized value $G_a$ and a dequantized value $\gamma_c$ of a correction coefficient for algebraic codebook gain are sought as the gain dequantized value. The algebraic codebook gain is found in accordance with the following equation using a prediction value $g_c'$, which is predicted from the logarithmic energy of algebraic codebook gain of the past four subframes, and $\gamma_c$:

$$G_c=g_c'\gamma_c \quad (21)$$

In the AMR method, adaptive codebook gain $G_a$ and algebraic codebook gain $G_c$ are quantized separately and therefore quantization is performed separately by the adaptive codebook gain quantizer 85$b_1$ and algebraic codebook gain quantizer 85$b_2$ of the AMR method in the gain code converter 85. It is unnecessary to identify the adaptive codebook gain quantizer 85$b_1$ and the algebraic codebook gain quantizer 85$b_2$ with those used by AMR method. But, at least an adaptive codebook gain table and an algebraic codebook table of the quantizers 85$b_1$, 85$b_2$ are same as those used by AMR method.

Figure 10:
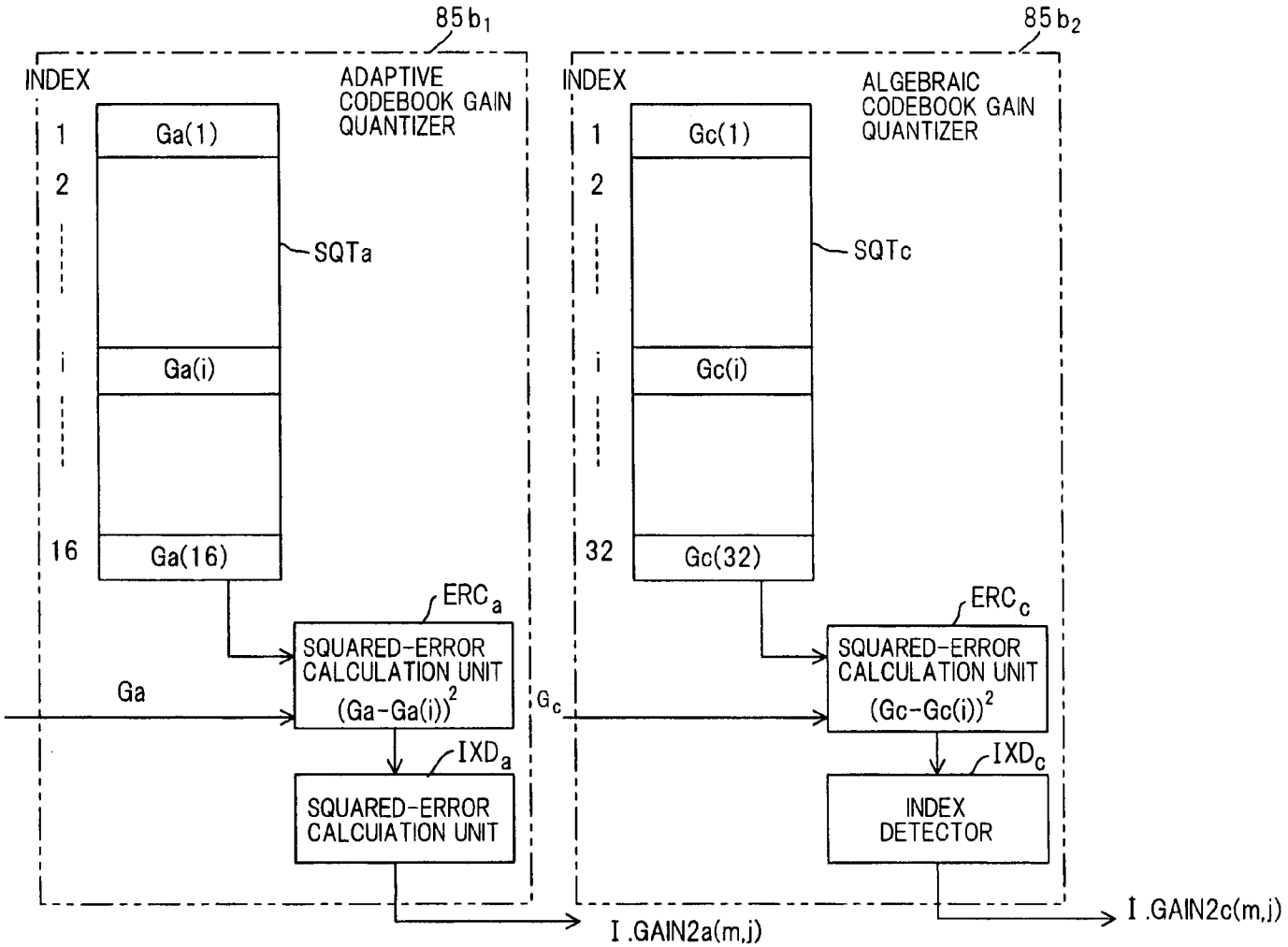
FIG. 10 is a block diagram illustrating the construction of a gain quantizer.

FIG. 10 is a diagram showing the constructions of the adaptive codebook gain quantizer 85$b_1$ and algebraic codebook gain quantizer 85$b_2$.

First, the adaptive codebook gain dequantized value $G_a$ is input to the adaptive codebook gain quantizer 85$b_1$ and is subjected to scalar quantization. Values $G_a(i)$ (i=1–16) of 16 types (four bits) which are the same as those of the AMR method have been stored in a scalar quantization table SQTa. A squared-error calculation unit ERCa calculates the square of the error between the adaptive codebook gain dequantized value $G_a$ and each table value, i.e., $[G_a-G_a(i)]^2$, and an index detector IXDa obtains, as the optimum value, the table value that minimizes the error that prevails when i is varied from 1 to 16, and outputs this index as adaptive codebook gain code I_GAIN2*a*(m,0) in the AMR method.

Next, Gc, which is found in accordance with Equation (21) from the noise codebook gain dequantized value $\gamma_c$ and $g_c'$, is input to the algebraic codebook gain quantizer 85$b_2$ in order to undergo scalar quantization. Values $G_c(i)$ (i=1~32) of 32 types (five bits) which are the same as those of the AMR method have been stored in a scalar quantization table SQTc. A squared-error calculation unit ERCc calculates the square of the error between the noise codebook gain dequantized value $G_c$ and each table value, i.e., $[G_c-G_c(i)]^2$, and an index detector IXDc obtains, as the optimum value, the table value that minimizes the error that prevails when i is varied from 1 to 32, and outputs this index as noise codebook gain code I_GAIN2*c*(m,0) in the AMR method.

Similar processing is thenceforth executed to find AMR-compliant adaptive codebook gain code I_GAIN2*a*(m,1) and noise codebook gain code I_GAIN2*c*(m,1) from G.729A-compliant gain code I_GAIN1(n,1).

Similarly, AMR-compliant adaptive codebook gain code I_GAIN2*a*(m,2) and noise codebook gain code I_GAIN2*c*(m,2) are found from G.729A-compliant gain code I_GAIN1(n+1,0), and AMR-compliant adaptive codebook gain code I_GAIN2*a*(m,3) and noise codebook gain code I_GAIN2*c*(m,3) are found from G.729A-compliant gain code I_GAIN1(n+1,1).

(e) Code Transmission Processing

The buffer 87 of FIG. 3 holds the codes output from the converters 82 to 85 until the processing of two frames of G.729A code (one frame in the AMR method) is completed. The converted code is then input to the code multiplexer 86. When all of the codes of one frame in the AMR method have been acquired, the code multiplexer 86 multiplexes the code data, converts the data to line data and sends the line data to the transmission path from the output terminal #2.

Thus, in accordance with the first embodiment, as described above, G.729A-compliant voice code can be converted to AMR-compliant voice code without being decoded into voice. As a result, delay can be reduced over that encountered with the conventional tandem connection and a decline in sound quality can be reduced as well.

(C) Second Embodiment

Figure 11:
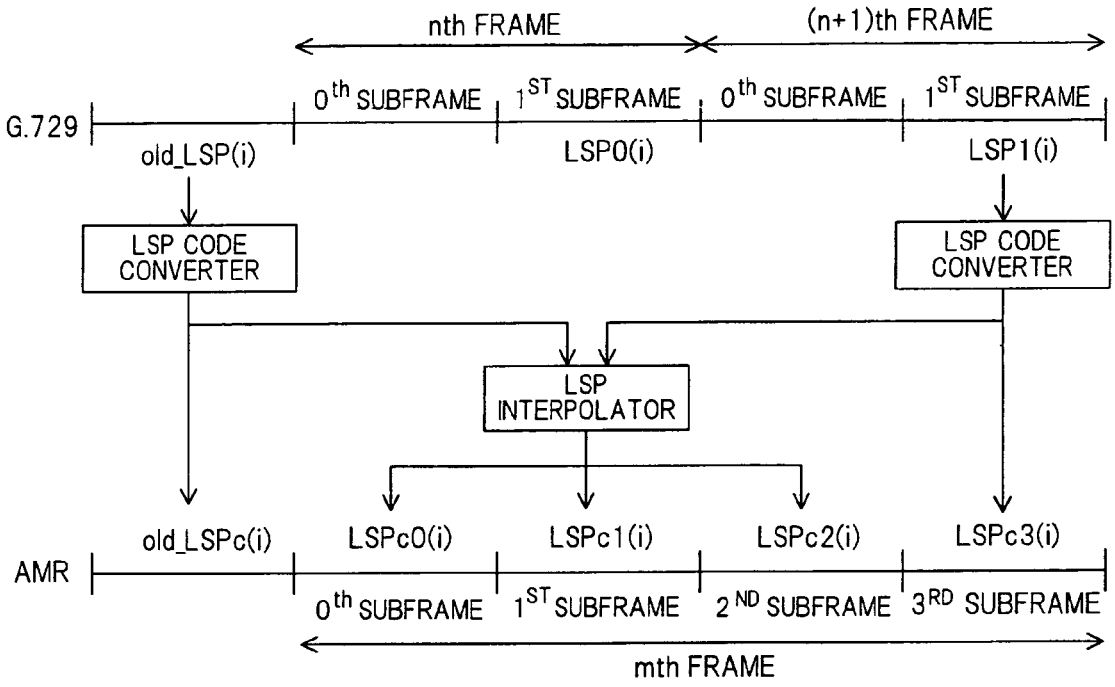
FIG. 11 is a diagram of a second embodiment of the present invention.

FIG. 11 is a diagram useful in describing an overview of a second embodiment of the present invention. The second embodiment improves upon the LSP quantizer 82*b* in the LSP code converter 82 of the first embodiment; the overall arrangement of the voice code conversion unit is the same as that of the first embodiment (FIG. 3).

FIG. 11 illustrates a case where LSP code of nth and (n+1)th frames of the G.729A method is converted to LSP code of the mth frame of the AMR method. In FIG. 11, LSP0(i) (i=1, . . . , 10) represent 10-dimensional LSP dequantized values in a first subframe ($1^{st}$ subframe) of an nth frame according to the G.729A method, and LSP1(i) (i=1, . . . , 10) represent 10-dimensional LSP dequantized values in a first subframe ($1^{st}$ subframe) of an (n+1)th frame according to the G.729A method. Further, old_LSP(i) (i=1, . . . , 10) represent 10-dimensional LSP dequantized values in a $1^{st}$ subframe of a past frame [(n−1)th frame].

In a case where voice code is converted from the G.729A to the AMR method, a dequantized value LSP0(i) in the G.729A method is not converted to an LSP code in the AMR method because of the difference in frame length, as pointed out in the first embodiment. In other words, an LSP is quantized one time per frame in the G.729A method and therefore LSP0(i), LSP1(i) are quantized together and sent to the decoder side. In order to convert voice code from the G.729A to the AMR method, however, it is necessary to encode and convert LSP parameters in conformity with the operation of the AMR-compliant decoder. As a consequence, the dequantized value LSP1(i) in the G.729A method is converted to AMR-compliant code but the dequantized value LSP0(i) is not converted to AMR-compliant code.

According to the AMR method, one frame consists of four subframes and only the LSP parameters of the final subframe ($3^{rd}$ subframe) are quantized and transmitted. In the decoder, therefore, LSP parameters LSPc0(i), LSPc1(i) and LSPc2(i) of the $0^{th}$, $1^{st}$ and $2^{nd}$ subframes are found from the dequantized value old_LSPc(i) of the previous frame and the LSP parameter LSPc3(i) of the $3^{rd}$ subframe in the present frame in accordance with the following interpolation equations:

$$LSPc0(i)=0.75\text{old_}LSPc(i)+0.25LSPc3(i)(i=1, 2, \ldots 10) \quad (22)$$

$$LSPc1(i)=0.50\text{old_}LSPc(i)+0.50LSPc3(i)(i=1, 2, \ldots 10) \quad (23)$$

$$LSPc2(i)=0.25\text{old_}LSPc(i)+0.75LSPc3(i)(i=1, 2, \ldots 10) \quad (24)$$

If the quality of input voice does not change abruptly, which is the case with voiced sounds, the LSP parameters also do not change abruptly. This means that no particular problems arise even if an LSP dequantized value is converted to code so as to minimize the LSP quantization error in the final subframe ($3^{rd}$ subframe), as in the first embodiment, and the LSP parameters of the other $0^{th}$ to $3^{rd}$ subframes are found by the interpolation operations of Equations (22) to (24). However, if voice quality changes suddenly, as in the case of unvoiced or transient segments, and, more particularly, if the quality of voice changes suddenly within the frame, there are instances where the conversion method of the first embodiment is unsatisfactory. Accordingly, in the second embodiment, code conversion is carried out taking into consideration not only LSP quantization error in the final subframe but also interpolation error stemming from LSP interpolation.

When a dequantized value LSP1(i) is converted to AMR-compliant LSP code according to the first embodiment, the conversion is made using as a reference only the square of the error between the LSP parameter LSPc3(i), which is specified by the above-mentioned LSP code, and the dequantized value LSP1(i). By contrast, in the second embodiment, encoding is performed taking into consideration not only the above-mentioned square of the error but also the square of the error between the dequantized value LSP0(i) and the LSP parameter LSPc1(i) obtained by the interpolation operation of Equation (23).

Figure 12:
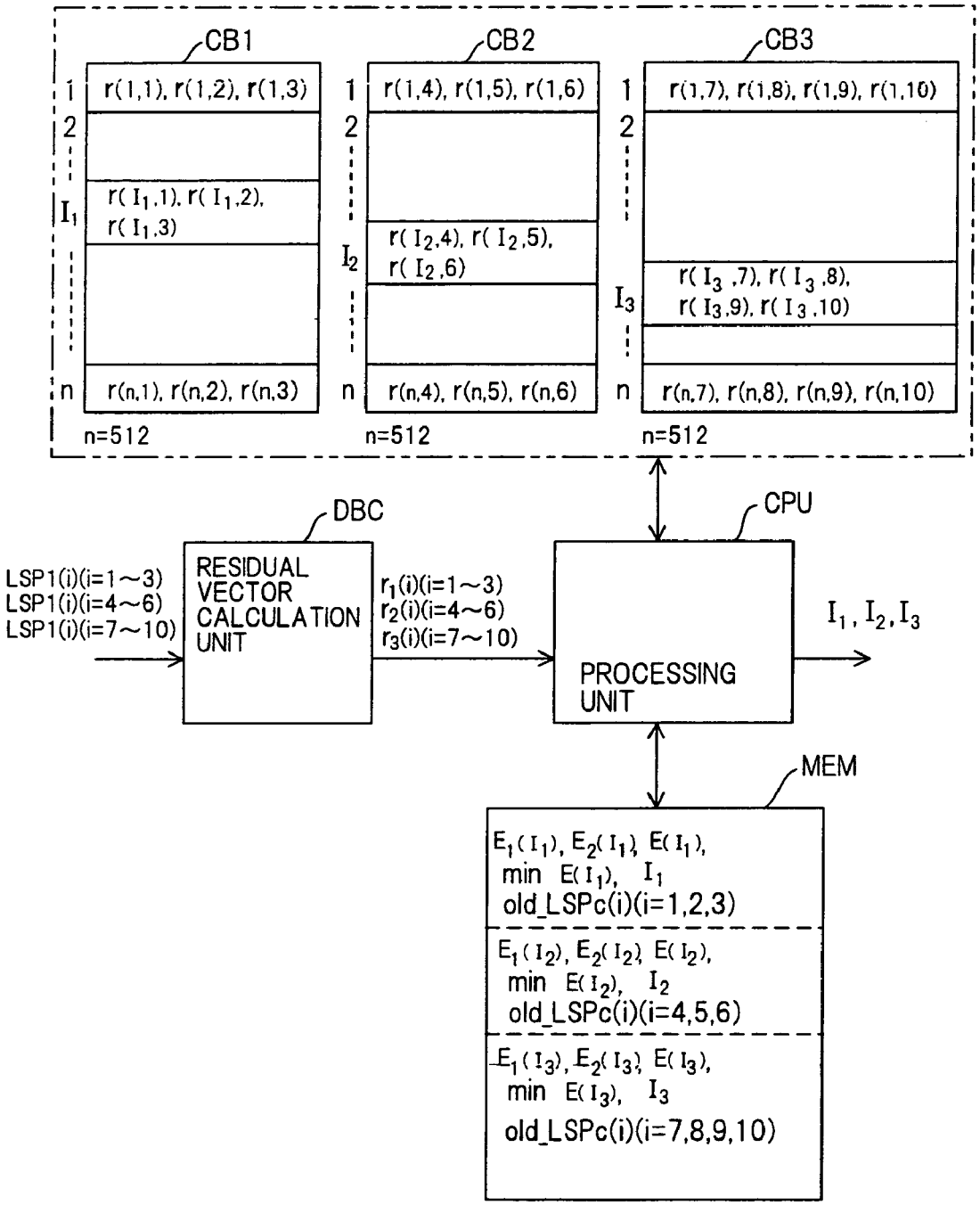
FIG. 12 is a block diagram illustrating the construction of an LSP quantizer according to the second embodiment.
Figure 13:
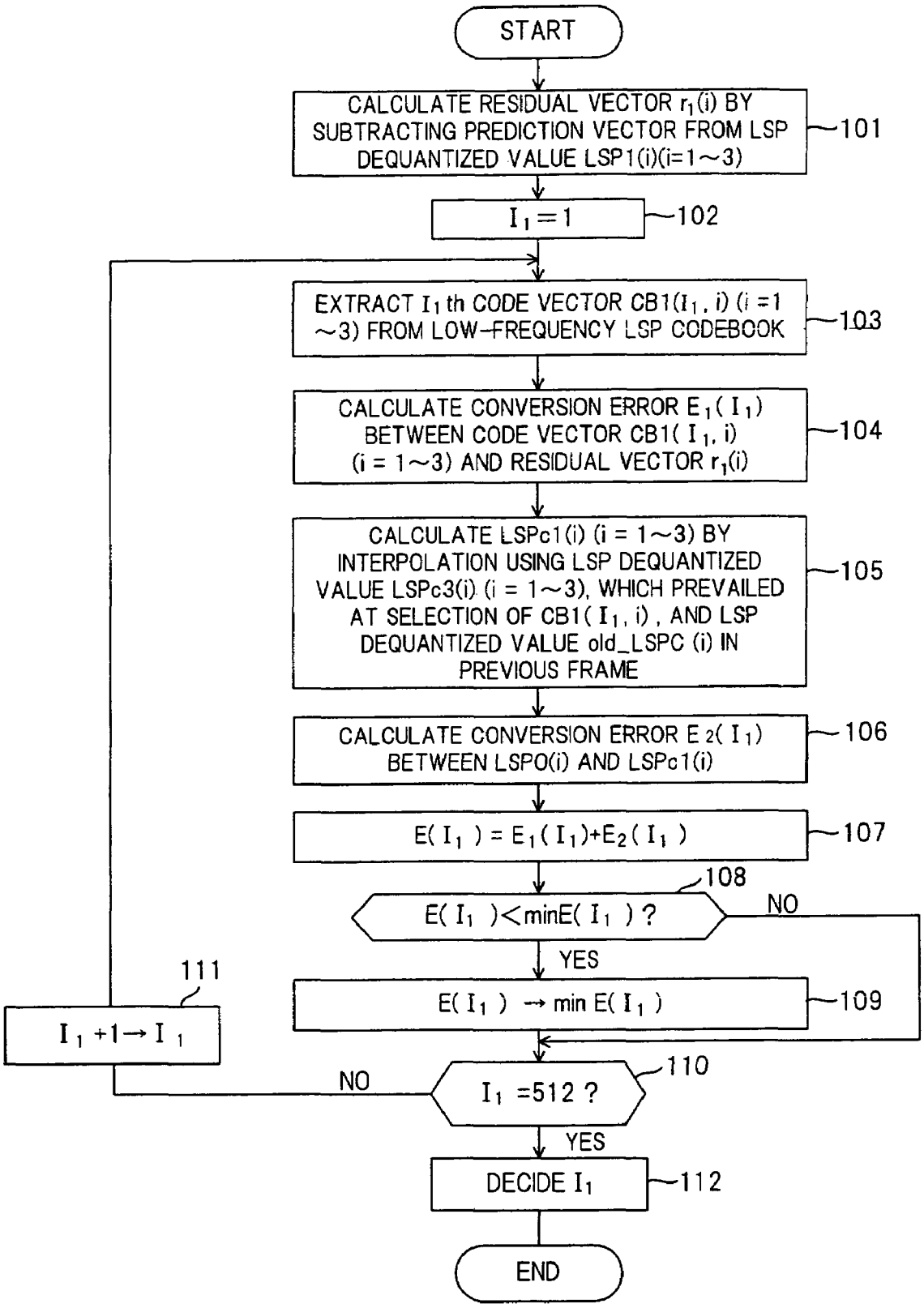
FIG. 13 is a flowchart of SLP encoding processing according to the second embodiment.

FIG. 12 is a diagram illustrating the construction of the LSP quantizer 82*b* according to the second embodiment, and FIG. 13 is a flowchart of conversion processing according to the second embodiment. Each LSP vector (LSP parameter) of the ten dimensions will be considered upon dividing it into three small vectors of a low-frequency region (first to third dimensions), a midrange-frequency region (fourth to sixth dimensions) and a high-frequency region (seventh to tenth dimensions).

Processing for Deciding Low-Frequency Three-Dimensional LSP Codes

First, the processing set forth below is executed with regard to the small vector of the low-frequency region (three dimensions of the low-frequency region) among the values LSP1(i) (i=1, . . . 10). The LSP codebooks used here are of three types, namely the low-frequency codebook CB1 (3 dimensions×512 sets), the midrange-frequency codebook CB2 (3 dimensions×512 sets) and the high-frequency codebook CB3 (4 dimensions×512 sets).

A residual vector calculation unit DBC calculates a residual vector $r_1(i)$ (i=1~3) by subtracting a prediction vector from the low-frequency LSP dequantized value LSP1(i) (i=1~3) (step 101).

Next, a processing unit (CPU) performs the operation $I_1=1$ (step 102), extracts an $I_1$th code vector CB1 ($I_1$,i) (i=1~3) from the low-frequency codebook CB1 (step 103), finds a conversion error $E_1(I_1)$ between this code vector and the residual vector $r_1(i)$ (i=1~3) in accordance with the following equation:

$$E_1(I_1)=\Sigma_i\{r_1(i)-CB1(I_1,i)\}^2 \ (i=1\sim3)$$

and stores this error in a memory MEM (step 104).

Next, using Equation (23), the CPU interpolates LSPc1(i) (i=1~3) from the LSP dequantized value LSPc3(i) (i=1~3), which prevailed when the code vector CB1 ($I_1$,i) was selected, and the preceding dequantized value old_LSPc(i) (i=1~3) (step 105), calculates the conversion error $E_2(I_1)$ between LSP0(i) and LSPc1(i) in accordance with the following equation:

$$E_2(I_1)=\Sigma_i\{LSP0(i)-LSPc1(i)\}^2(i=1\sim3)$$

and stores this error in the memory MEM (step 106).

Next, using the following equation, the CPU calculates an error $E(I_1)$ that prevailed when the $I_1$th code vector was selected and stores this error in memory (step 107):

$$E(I_1)=E(I_1)+E_2(I_1)$$

The CPU then compares the error $E(I_1)$ with a minimum error $\min E(I_1)$ thus far (step 108) and updates the error $E(I_1)$ to $\min E(I_1)$ if $E(I_1)<\min E(I_1)$ holds (step 109).

Following update processing, the CPU checks to see whether $I_1=512$ holds (step 110). If $I_1<512$ holds, the CPU increments $I_1$ ($I_1+1\rightarrow I_1$; step 111). The CPU then repeats processing from step 103 onward. If $I_1=512$ holds, however, the CPU decides, as the low-frequency three-dimensional LSP code, the index $I_1$ for which the error $E(I_1)$ is minimized (step 112).

Processing for Deciding Midrange-frequency Three-dimensional LSP Codes

If processing for deciding the low-frequency three-dimensional LSP code $I_1$ is completed, the CPU executes the processing set forth below with regard to the small vector (three-dimensional) of the midrange-frequency region.

The residual vector calculation unit DBC calculates a residual vector $r_2(i)$ (i=4~6) by subtracting a prediction vector from the midrange-frequency LSP dequantized value LSP1(i) (i=4~6).

Next, the processing unit (CPU) performs the operation $I_2=1$, extracts an $I_2$th code vector CB2($I_2$,i) (i=4~6) from the midrange-frequency codebook CB2, finds a conversion error $E_1(I_2)$ between this code vector and the residual vector $r_2(i)$ (i=4~6) in accordance with the following equation:

$$E_1(I_2)=\Sigma_i\{r_2(i)-CB2(I_2,i)\}^2(i=4\sim6)$$

and stores this error in the memory MEM.

Next, using Equation (23), the CPU interpolates LSPc1(i) (i=4~6) from the LSP dequantized value LSPc3(i) (i=4~6), which prevailed when the code vector CB2($I_2$,i) was selected, and the preceding dequantized value old_LSPc(i) (i=4~6), calculates the conversion error $E_2(I_2)$ between LSP0(i) and LSPc1(i) in accordance with the following equation:

$$E_2(I_2)=\Sigma_i\{LSP0(i)-LSPc1(i)\}^2(i=4\sim6)$$

and stores this error in the memory MEM.

Next, using the following equation, the CPU calculates an error $E(I_2)$ that prevailed when the $I_2$th code vector was selected and stores this error in memory:

$$E(I_2)=E_1(I_2)+E_2(I_2)$$

The CPU then compares the error $E(I_2)$ with a minimum error $\min E(I_2)$ thus far and updates the error $E(I_2)$ to $\min E(I_2)$ if $E(I_2)<\min E(I_2)$ holds.

Following update processing, the CPU checks to see whether $I_2=512$ holds. If $I_2<512$ holds, the CPU increments $I_2$($I_2+1\rightarrow I_2$). The CPU then repeats the above-described processing. If $I_2$=512 holds, however, the CPU decides, as the midrange-frequency three-dimensional LSP code, the index $I_2$ for which the error $E(I_2)$ is minimized.

Processing for Deciding High-frequency Four-dimensional LSP Codes

If processing for deciding the midrange-frequency three-dimensional LSP code $I_2$ is completed, the CPU executes the processing set forth below with regard to the small vector (four-dimensional) of the high-frequency region.

The residual vector calculation unit DBC calculates a residual vector $r_3(i)$ (i=7~10) by subtracting a prediction vector from the high-frequency LSP dequantized value LSP1(i) (i=7~10).

Next, the processing unit (CPU) performs the operation $I_3$=1, extracts an $I_3$th code vector CB3($I_3$,i) (i=7~10) from the high-frequency codebook CB3, finds a conversion error $E_1(I_3)$ between this code vector and the residual vector $r_3(i)$ (i=7~10) in accordance with the following equation:

$$E_1(I_3)=\Sigma_i\{r_3(i)-CB3(I_3,i)\}^2(i=7\sim10)$$

and stores this error in the memory MEM.

Next, using Equation (23), the CPU interpolates LSPc1(i) (i=7~10) from the LSP dequantized value LSPc3(i) (i=7~10), which prevailed when the code vector CB3($I_3$,i) was selected, and the preceding dequantized value old_LSPc (i) (i=7~10), calculates the conversion error $E_2(I_3)$ between LSP0(i) and LSPc1(i) in accordance with the following equation:

$$E_2(I_3)=\Sigma_i\{LSP0(i)-LSPc1(i)\}^2(i=7\sim10)$$

and stores this error in the memory MEM.

Next, using the following equation, the CPU calculates an error $E(I_3)$ that prevailed when the $I_3$th code vector was selected and stores this error in memory:

$$E(I_3)=E_1(I_3)+E_2(I_3)$$

The CPU then compares the error $E(I_3)$ with a minimum error $\min E(I_3)$ thus far and updates the error $E(I_3)$ to $\min E(I_3)$ if $E(I_3)<\min E(I_3)$ holds.

Following update processing, the CPU checks to see whether $I_3$=512 holds. If $I_3$<512 holds, the CPU increments $I_3$ ($I_2+1\rightarrow I_2$). The CPU then repeats the above-described processing. If $I_3$=512 holds, however, the CPU decides, as the high-frequency four-dimensional LSP code, the index $I_3$ for which the error $E(I_3)$ is minimized.

Thus, in the second embodiment, the conversion error of LSPc1(i) is taken into account as interpolator error. However, it is also possible to decide the LSP code upon taking the conversion error of LSPc0(i) and LSPc2(i) into account in similar fashion.

Further, in the second embodiment, the description assumes that the weightings of $E_1$ and $E_2$ are equal as the error evaluation reference. However, the LSP code can also be decided upon so arranging it that $E_1$ and $E_2$ are weighted separately as $E=\omega_1E_1+\omega_2E_2$.

Thus, in accordance with the second embodiment, as described above, a G.729A-compliant voice code can be converted to AMR-compliant code without being decoded to voice. As a result, delay can be reduced over that encountered with the conventional tandem connection and a decline in sound quality can be reduced as well. Moreover, not only conversion error that prevails when LSP1(i) is re-quantized but also interpolation error due to the LSP interpolator are taken into consideration. This makes it possible to perform an excellent voice code conversion with little conversion error even in a case where the quality of input voice varies within the frame.

(D) Third Embodiment

The third embodiment improves upon the LSP quantizer 82*b* in the LSP code converter 82 of the second embodiment. The overall arrangement is the same as that of the first embodiment shown in FIG. 3.

The third embodiment is characterized by making a preliminary selection (selection of a plurality of candidates) for each of the small vectors of the low-, midrange- and high-frequency regions, and finally deciding a combination {$I_1$, $I_2$, $I_3$) of LSP code vectors for which the errors in all bands will be minimal. The reason for this approach is that there are instances where the 10-dimensional LSP synthesized code vector synthesized from code vectors for which the error is minimal in each band is not the optimum vector. In particular, since an LPC synthesis filter is composed of LPC coefficients obtained by conversion from 10-dimensional LSP parameters in the AMR or G.729A method, the conversion error in the LSP parameter region exerts great influence upon reproduced voice. Accordingly, it is desirable not only to perform a codebook search for which error is minimized for each small vector of the LSP but also to finally decide LSP code that will minimize error (distortion) of 10-dimensional LSP parameters obtained by combining small vectors.

Figure 14:
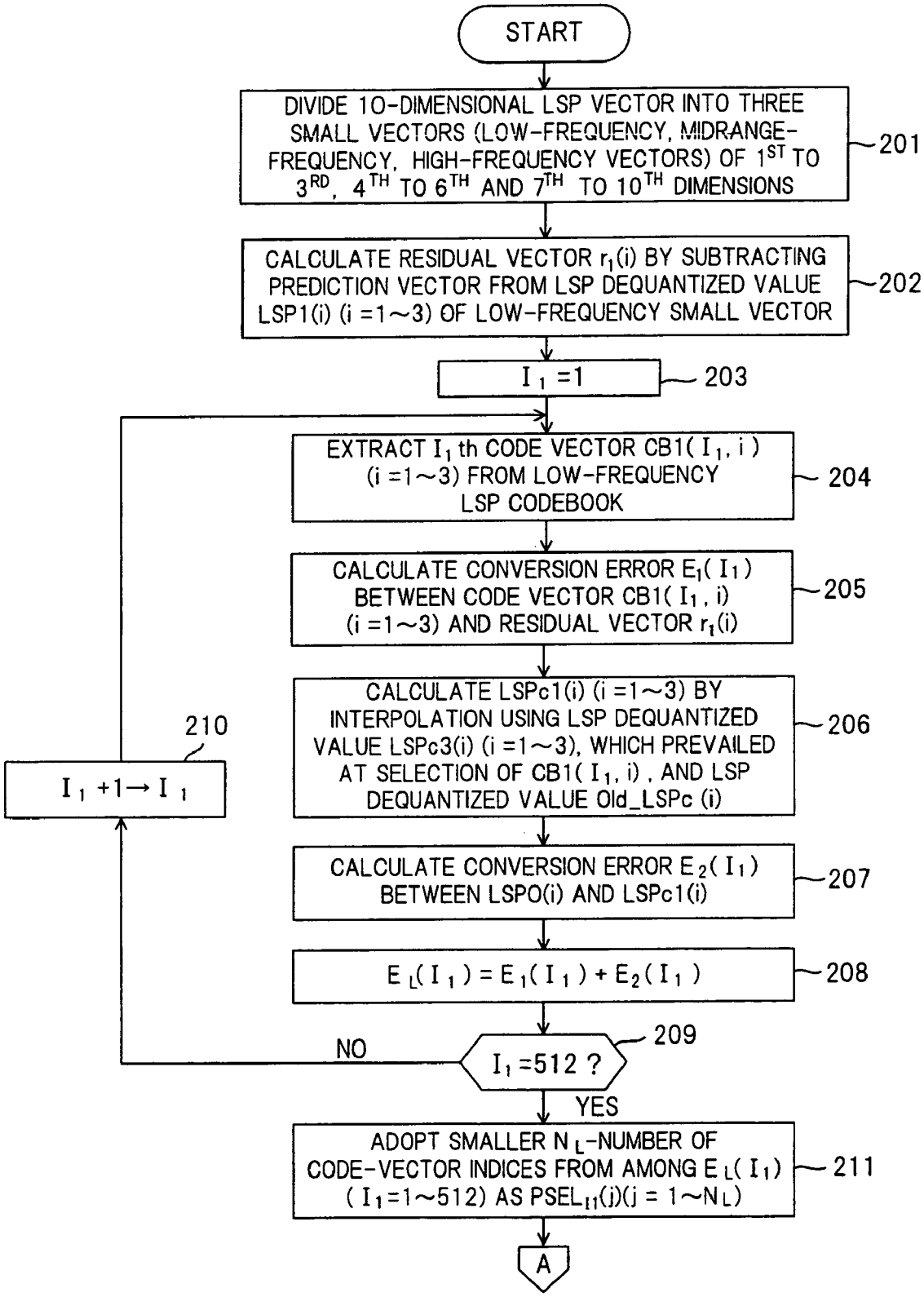
FIG. 14 is part one of a processing flowchart according to a third embodiment.
Figure 15:
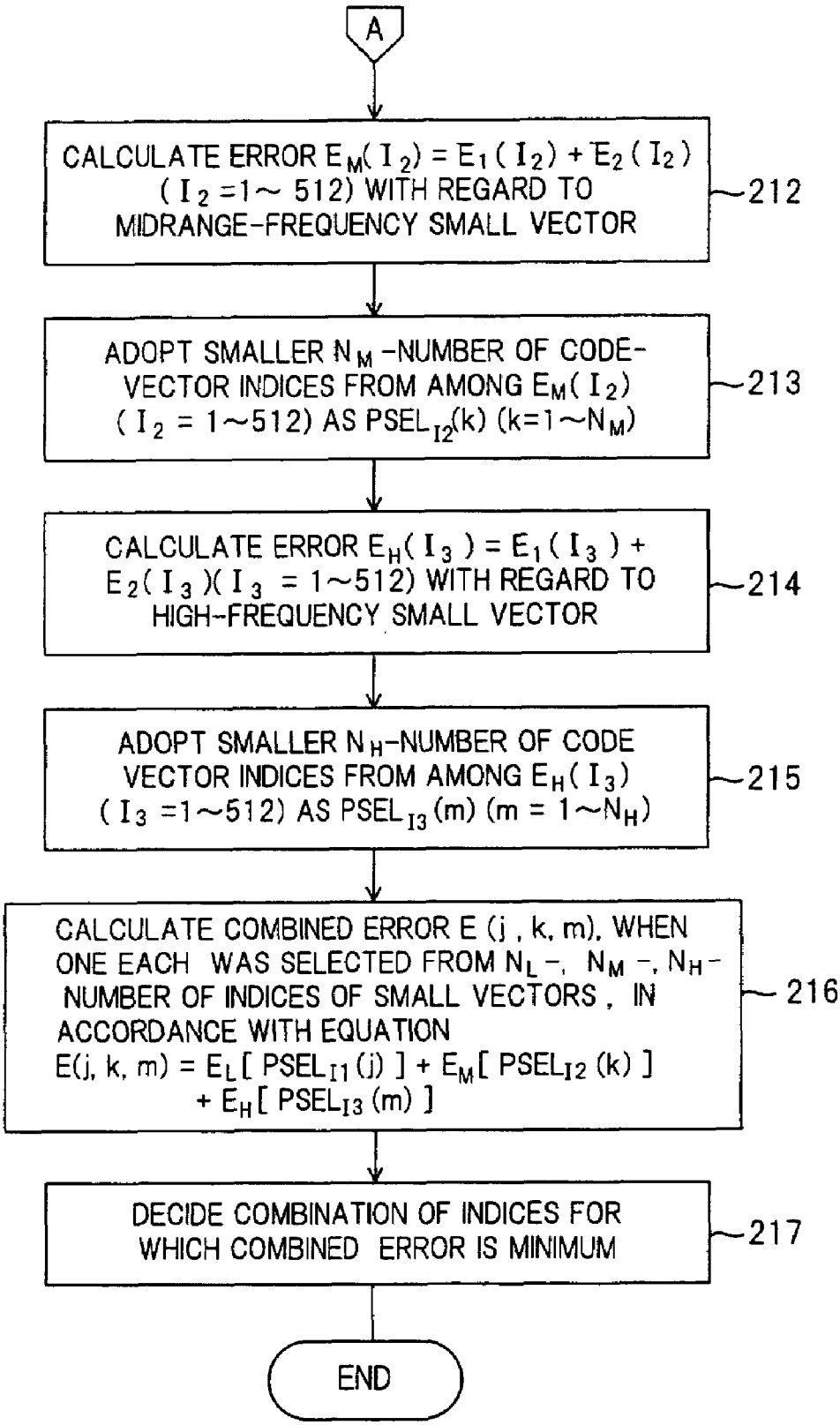
FIG. 15 is part two of a processing flowchart according to the third embodiment.

FIGS. 14 and 15 are flowcharts of conversion processing executed by the LSP quantizer 82*b* according to the third embodiment. Here the LSP quantizer 82*b* has the same block components as those shown in FIG. 12; only the processing executed by the CPU is different.

The 10-dimensional dequantized value output from the LSP dequantizer 82*a* is divided into three areas, namely a low-frequency 3-dimensional small vector LSP1(i) (i=1~3), a midrange-frequency 3-dimensional small vector LSP1(i) (i=4~6) and a high-frequency four-dimensional small vector LSP1(i) (i=7~10) (step 201).

Next, the residual vector calculation unit DBC calculates a residual vector $r_1(i)$ (i=1~3) by subtracting a prediction vector from the low-frequency LSP dequantized value LSP1 (i) (i=1~3) (step 202). The processing unit (CPU) then performs the operation $I_1$=1 (step 203), extracts an $I_1$th code vector CB1($I_1$,i) (i=1~3) from the low-frequency codebook CB1 (step 204), finds a conversion error $E_1(I_1)$ between this code vector and the residual vector $r_1(i)$ (i=1~3) in accordance with the following equation:

$$E_1(I_1)=\Sigma_i\{r_1(i)-CB1(I_1,i)\}^2(i=1\sim3)$$

and stores this error in the memory MEM (step 205).

Next, using Equation (23), the CPU interpolates LSPc1(i) (i=1~3) from the LSP dequantized value LSPc3(i) (i=1~3), which prevailed when the code vector CB1($I_1$,i) was selected, and the preceding dequantized value old_LSPc(i) (i=1~3) (step 206), calculates the conversion error $E_2(I_1)$ between LSP0(i) and LSPc1(i) in accordance with the following equation:

$$E_2(I_1)=\Sigma_i\{LSP0(i)-LSPc1(i)\}^2(i=1\sim3)$$

and stores this error in the memory MEM (step 207).

Next, using the following equation, the CPU calculates an error $E_L(I_1)$ that prevailed when the $I_1$th code vector was selected and stores this error in memory (step 208):

$$E_L(I^1)=E_1(I_1)+E_2(I_1)$$

The processor thenceforth checks to see whether $I_1=512$ holds (step 209). If $I_1<512$ holds, the CPU increments $I_1$ ($I_1+1 \rightarrow I_1$; step 210). The CPU then repeats processing from step 204 onward. If $I_1=512$ holds, however, the CPU selects $N_L$-number of code-vector candidates starting from the smaller ones of $E_L(I_1)$ ($I_1=1\sim512$) and adopts $PSEL_{I1}(j)$ ($j=1, \ldots N_L$) as the index of each of the candidates (step 211).

If processing for deciding the low-frequency three-dimensional small vector is completed, the CPU executes similar processing with regard to the midrange-frequency three-dimensional small vector. Specifically, the CPU calculates 512 sets of errors $E_M(I_2)$ (step 212) by processing similar to that of steps 202 to 210. Next, the CPU selects $N_M$-number of code-vector candidates from the smaller ones of $E_M(I_2)$ ($I_2=1\sim512$) and adopts $PSEL_{I2}(k)$ ($k=1, \ldots N_M$) as the index of each candidate (step 213).

If processing for deciding the midrange-frequency three-dimensional small vector is completed, the CPU executes similar processing with regard to the high-frequency four-dimensional small vector. Specifically, the CPU calculates 512 sets of errors $E_H(I_3)$ (step 214), selects $N_H$-number of code-vector candidates from the smaller ones of $E_H(I_3)$ ($I_3=1\sim512$) and adopts $PSEL_{I3}(m)$ ($m=1, \ldots N_H$) as the index of each candidate (step 215).

A combination for which the errors in all bands will be minimal is decided by the following processing from the candidates that were selected by the processing set forth above: Specifically, the CPU finds the combined error $$E(j,k,m)=E_L[PSEL_{I1}(j)]+E_M[PSEL_{I2}(k)]+E_H[PSEL_{I3}(m)]$$

that prevails when $PSEL_{I1}(j)$, $PSEL_{I2}(k)$, $PSEL_{I3}(m)$ are selected from the $N_L$-number of low-frequency, $N_M$-number of midrange-frequency and $N_H$-number of high-frequency index candidates that were selected by the above-described processing (step 216), decides the combination, from among all combinations of j, k, m, for which the combined error E(j,k,m) will be minimum, and outputs the following indices, which prevail at this time, as the LSP codes of the AMR method (step 217):

$$PSEL_{I1}(j),\ PSEL_{I2}(k),\ PSEL_{I3}(m)$$

According to the third embodiment, the conversion error of LSPc1(i) is taken into account as interpolator error. However, it is also possible to decide the LSP code upon taking the conversion error of LSPc0(i) and LSPc2(i) into account in similar fashion.

Further, in the third embodiment, the description assumes that the weightings of $E_1$ and $E_2$ are equal as the error evaluation reference. However, the LSP code can also be decided upon so arranging it that $E_1$ and $E_2$ are weighted separately as $E=\omega_1E_1+\omega_2E_2$.

Thus, in accordance with the third embodiment, as described above, a G.729A-compliant voice code can be converted to AMR-compliant code without being decoded to voice. As a result, delay can be reduced over that encountered with the conventional tandem connection and a decline in sound quality can be reduced as well. Moreover, not only conversion error that prevails when LSP1(i) is re-quantized but also interpolation error due to the LSP interpolator are taken into consideration. This makes it possible to perform an excellent voice code conversion with little conversion error even in a case where the quality of input voice varies within the frame.

Further, the third embodiment is adapted to find a combination of code vectors for which combined error in all bands will be minimal from combinations of code vectors selected from a plurality of code vectors of each band, and to decide LSP code based upon the combination found. As a result, this embodiment can provide reproduced voice having a sound quality superior to that of the second embodiment.

(E) Fourth Embodiment

The foregoing embodiment relates to a case where the G.729A encoding method is used as the encoding method 1 and the AMR encoding method is used as the encoding method 2. In a fourth embodiment, the 7.95-kbps mode of the AMR encoding method is used as the encoding method 1 and the G.729A encoding method is used as the encoding method 2.

Figure 16:
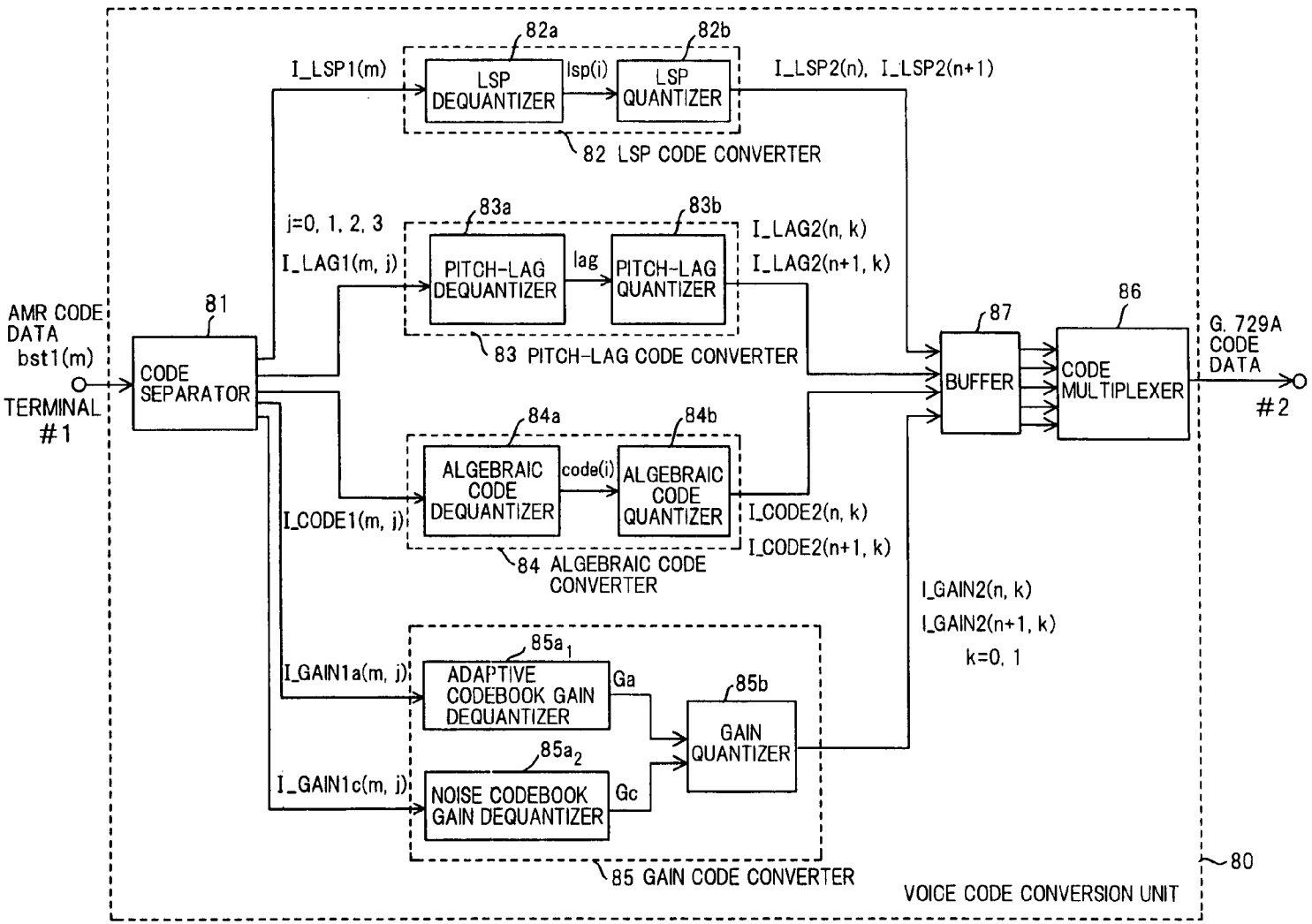
FIG. 16 is a diagram of a fourth embodiment of the present invention.

FIG. 16 is a block diagram illustrating a voice code conversion unit according to a fourth embodiment of the present invention. Components identical with those shown in FIG. 2 are designated by like reference characters. This arrangement differs from that FIG. 2 in that the buffer 87 is provided and in that the gain dequantizer of the gain code converter 85 is constituted by an adaptive codebook gain dequantizer 85$a_1$ and a noise codebook gain dequantizer 85$a_2$. Further, in FIG. 16, the 7.95-kbps mode of the AMR method is used as the encoding method 1 and the G.729A encoding method is used as the encoding method 2.

As shown in FIG. 16, an mth frame of line data bst1(m) is input to terminal #1 from an AMR-compliant encoder (not shown) via the transmission path. Here the bit rate of AMR encoding is 7.95 kbps and the frame length is 20 ms and therefore the line data bst1(m) is represented by bit sequence of 159 bits. The code separator 81 separates LSP code I_LSP1(m), pitch-lag code I_LAG1(m,j), algebraic code I_CODE1(m,j), adaptive codebook gain code I_GAIN1$a$(m,j) and algebraic codebook gain code I_GAIN1$c$(m,j) from the line data bst1(n) and inputs these codes to the converters 82, 83, 84, 85. The suffix j represents the four subframes constituting each frame in the AMR method and takes on any of the values 0, 1, 2 and 3.

(a) LSP Code Converter

Overview of LSP Code Conversion Processing

As shown in FIG. 4B, frame length according to the AMR method is 20 ms and an LSP parameter is quantized from the input signal of the third subframe only once every 20 ms. By contrast, frame length according to the G.729A method is 10 ms and an LSP parameter found from the input voice signal of the first subframe is quantized only once every 10 ms. Accordingly, two frames of LSP code in the G.729A method must be created from one frame of LSP code in the AMR method.

Figure 17:
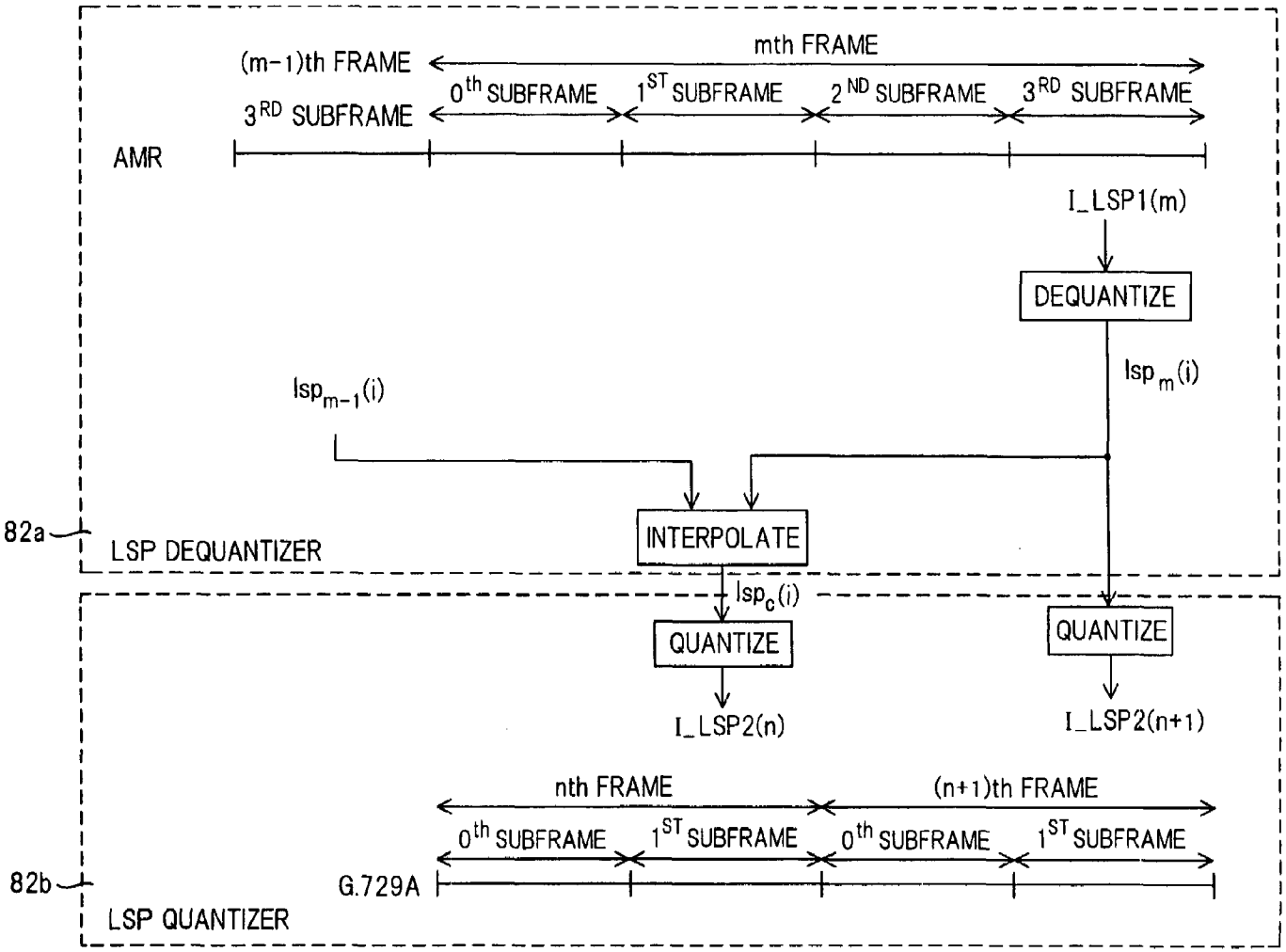
FIG. 17 is a diagram useful in describing processing executed by an LSP code converter according to the fourth embodiment.

FIG. 17 is a diagram useful in describing conversion processing executed by the LSP code converter 82 according to the fourth embodiment.

The LSP dequantizer 82$a$ dequantizes LSP code I_LSP1(m) of the third subframe in the mth frame of the AMR method and generates a dequantized value $lsp_m(i)$. Further, using the dequantized value $lsp_m(i)$ and a dequantized value $lsp_{m-1}(i)$ of the third subframe in the (m−1)th frame, which is the previous frame, the LSP dequantizer 82$a$ predicts a dequantized value $lsp_c(i)$ of the first subframe in the mth frame by interpolation. The LSP quantizer 82$b$ quantizes the dequantized value $lsp_c(i)$ of the first subframe in the mth frame in accordance with the G.729A method and outputs LSP code I_LSP2(n) of the first subframe of the nth frame. Further, the LSP quantizer 82$b$ quantizes the dequantized value $lsp_m(i)$ of the third subframe in the mth frame in accordance with the G.729A method and outputs LSP code I_LSP2(n+1) of the first subframe of the (n+1)th frame in the G.729A method.

LSP Dequantization

Figure 18:
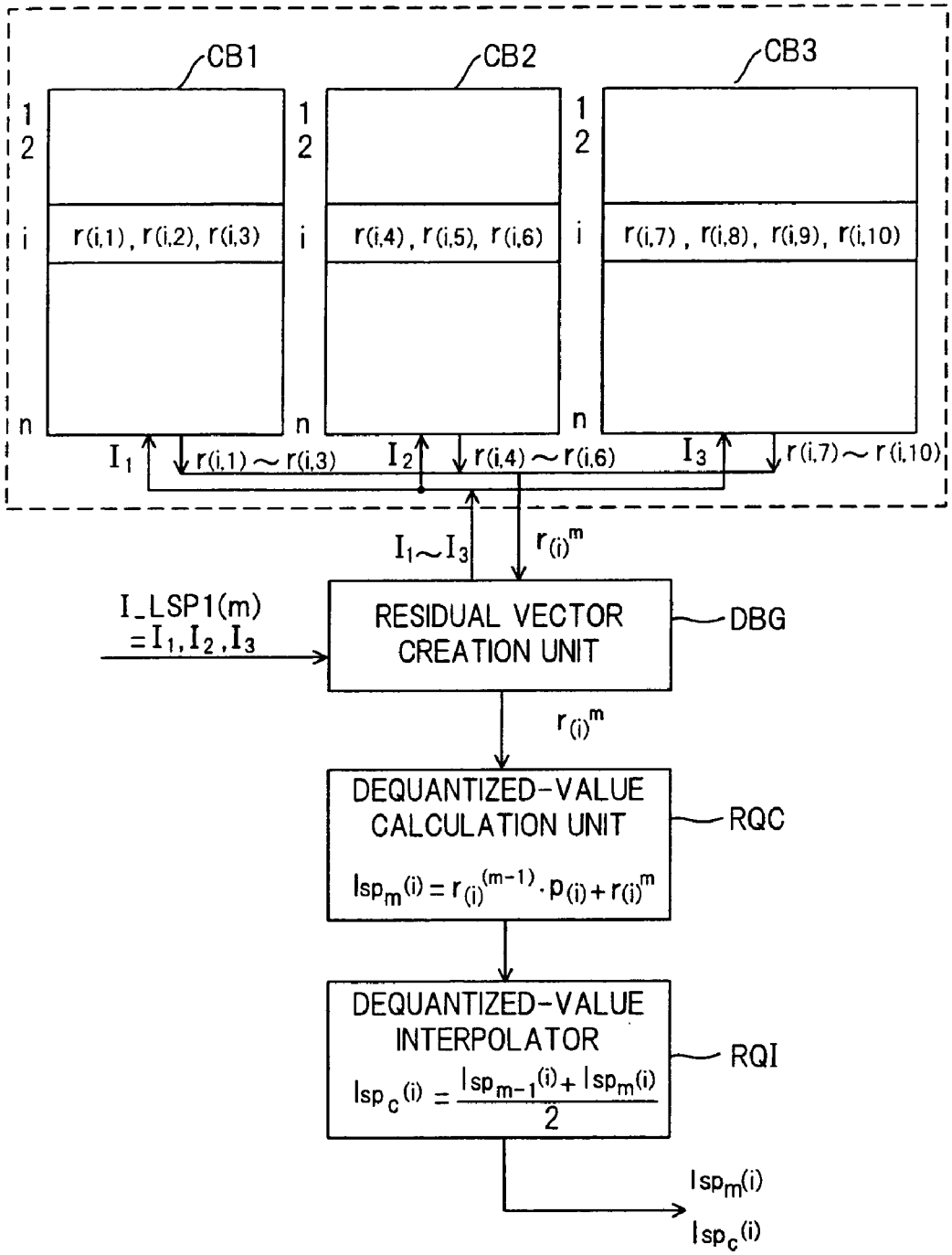
FIG. 18 is a block diagram of an LSP dequantizer.

FIG. 18 is a diagram showing the construction of the LSP dequantizer 82*a*.

The LSP dequantizer 82*a* has 9-bit (512-pattern) codebooks CB1, CB2, CB3 for each of the small vectors when the AMR-method 10-dimensional LSP parameters are divided into the small vectors of first to third dimensions, fourth to sixth dimensions and seventh to tenth dimensions. The LSP code I_LSP1(m) of the AMR method is decomposed into codes $I_1$, $I_2$, $I_3$ and the codes are input to the residual vector calculation unit DBC. The code $I_1$ represents the element number (index) of the low-frequency 3-dimensional codebook CB1, and the codes $I_2$, $I_3$ also represent the element numbers (indices) of the midrange-frequency 3-dimensional codebook CB2 and high-frequency 4-dimensional codebook CB3, respectively.

Upon being provided with LSP code I_LSP1(m)={$I_1$,$I_2$, $I_3$}, a residual vector creation unit DBG extracts code vectors corresponding to the codes $I_1$, $I_2$, $I_3$ from the codebooks CB1, CB2, CB3 and arrays the code vectors in the order of the codebooks CB1–CB3 as follows:

$$r(i,1)\sim r(i,3),\ r(i,4)\sim r(i,6),\ r(i,7)\sim r(i,10),$$

to create a 10-dimensional vector $r(i)^{(m)}$ (i=1, . . . 10). Since prediction is used when LSP parameters are encoded in the AMR method, $r(i)^{(m)}$ is the vector of a residual area. Accordingly, an LSP dequantized value lspm(i) of an mth frame can be found by adding a residual vector $r(i)^{(m)}$ of the present frame to a vector obtained by multiplying a residual vector $r(i)^{(m-1)}$ of the previous frame by a constant p(i). That is, a dequantized-value calculation unit RQC calculates the LSP dequantized value lspm(i) in accordance with the following equation:

$$lsp_m(i)=r(i)^{(m-1)}\cdot p(i)+r(i)^{(m)} \tag{25}$$

It should be noted that the constant p(i) used to multiply the residual vector $r(i)^{(m-1)}$ employs one that has been decided for every index i by the specifications of the AMR encoding method.

Next, using an LSP dequantized value $lsp_{m-1}(i)$ found in the previous (m−1)th frame and $lsp_m(i)$ of the mth frame, a dequantized-value interpolator RQI obtains an LSP dequantized value $lsp_c(i)$ of the first frame in the mth frame by interpolation. Though any interpolation method may be used, the method indicated by the following equation is used by way of example:

$$lsp_c(i) = \frac{lsp_{m-1}(i) + lsp_m(i)}{2} \quad (i = 1, \ldots, 10) \tag{26}$$

By virtue of the foregoing, the LSP dequantizer 82*a* calculates and outputs dequantized values $lsp_m(i)$, $lsp_c(i)$ of the first and third subframes in the mth frame.

LSP Quantization

LSP code I_LSP2(n) corresponding to the first subframe of the nth frame in the G.729A encoding method can be found by quantizing the LSP parameter $lsp_c(i)$, which has been interpolated in accordance with Equation (26), through the method set forth below. Further, LSP code I_LSP2(n+1) corresponding to the first subframe of the (n+1)th frame in the G.729A encoding method can be found by quantizing $lsp_m(i)$ through a similar method.

First, the LSP dequantized value $lsp_c(i)$ is converted to an LSF coefficient (i) by the following equation:

$$\omega(i)=\arccos\,[lsp_c(i)],\ (i1, \ldots, 10) \tag{27}$$

This is followed by quantizing, using 17 bits, residual vectors obtained by subtracting predicted components (predicted components obtained from codebook outputs of the past four frames) from the LSF coefficients ω(i).

In accordance with G.729A encoding, three codebooks cb1 (ten dimensional and seven bits), cb2 (five dimensions and five bits) and cb3 (five dimensions and five bits) are provided. Predicted components $\hat{l}^{(n-1)}$, $\hat{l}^{(n-2)}$, $\hat{l}^{(n-3)}$, $\hat{l}_{(n-4)}$ are found from each of the codebook outputs of the past four frames in accordance with the following equations:

$$\hat{l}_i^{(n-k)} = \begin{cases} cb1(L_1(n-k), i) + cb2(L_2(n-k), i) & (i = 1, \ldots, 5) \\ cb1(L_1(n-k), i) + cb3(L_3(n-k), i-5) & (i = 6, \ldots, 10) \end{cases} \tag{28}$$

where L1(n-k) represents the code (index) of codebook cb1 in the (n-k)th frame and cb1[L1(n-k)] is assumed to be a code vector (output vector) indicated by the index $L_1$(n-k) of codebook cb1 in the (n-k)th frame. The same holds true for $L_2$(n-k) and $L_3$(n-k). Next, a residual vector $l_i$ (i=1, . . . , 10) is found by the following equation:

$$l_i = \frac{\omega_i - \sum_{k=1}^{4} p(i,k)\hat{l}_i^{(m-k)}}{1 - \sum_{k=1}^{4} p(i,k)} \tag{29}$$

where p(i,k) is referred to as a prediction coefficient and is a constant determined beforehand by the specifications of the G.729A encoding method. The residual vector $l_i$ is what undergoes vector quantization.

Vector quantization is executed as follows: First, codebook cb1 is searched to decide the index (code) $L_1$ of the code vector for which the mean-square error is minimum. Next, the 10-dimensional code vector corresponding to the index $L_1$ a is subtracted from the 10-dimensional residual vector $I_i$ to create a new target vector. The codebook cb2 is searched in regard to the lower five dimensions of the new target vector to decide the index (code) $L_2$ of the code vector for which the mean-square error is minimum. Similarly, the codebook cb3 is searched in regard to the higher five dimensions of the new target vector to decide the index (code) $L_3$ of the code vector for which the mean-square error is minimum. The 17-bit code that can be formed by arraying these obtained codes $L_1$, $L_2$, $L_3$ as bit sequences is output as LSP code L_LSP2(n) in the G.729A encoding method. The LSP code I_LSP2(n+1) in the G.729A encoding method can be obtained through exactly the same method with regard to the LSP dequantized value $lsp_m(i)$ as well.

Figure 19:
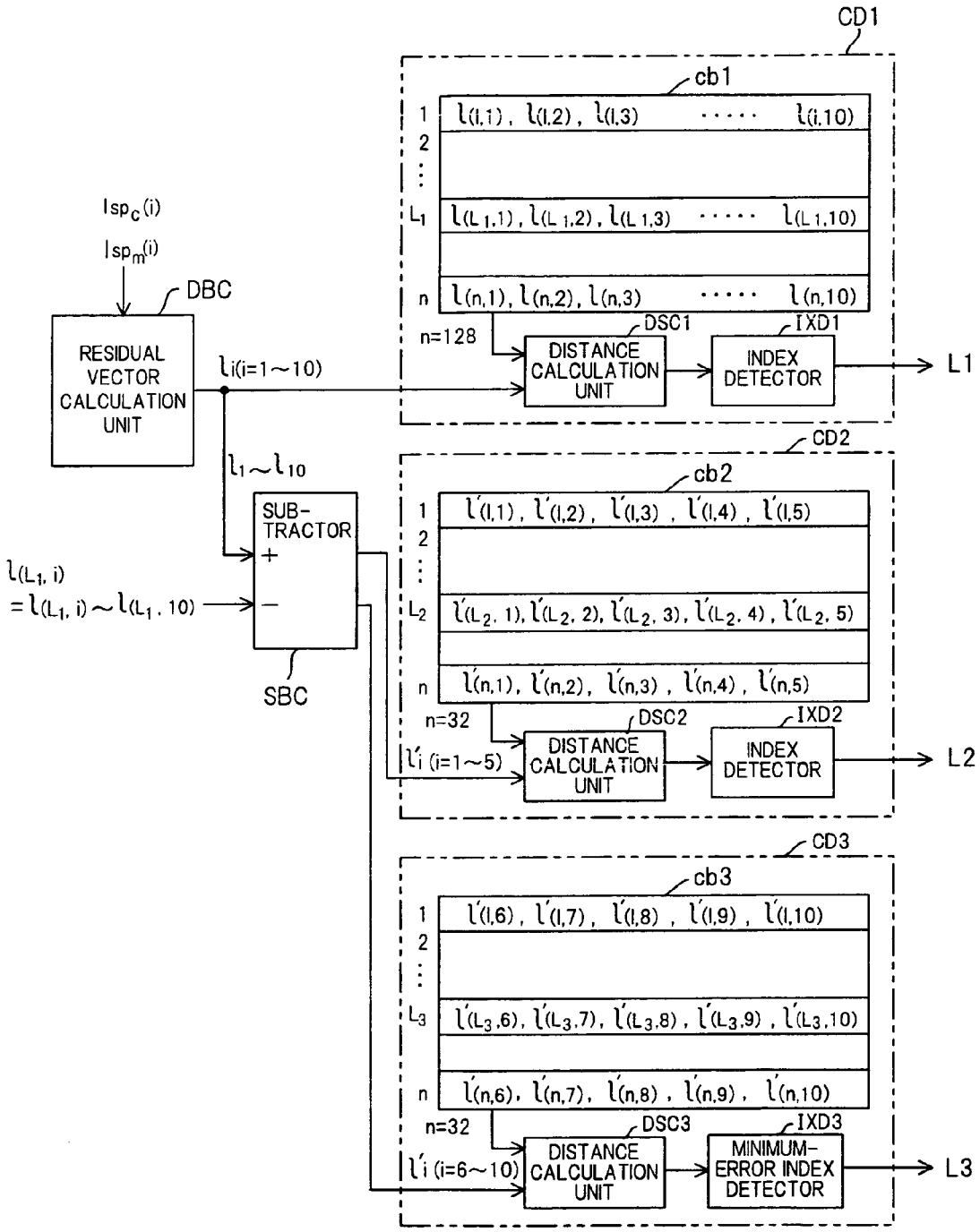
FIG. 19 is a block diagram of an LSP quantizer.

FIG. 19 is a diagram showing the construction of the LSP quantizer 82*b*. The residual vector calculation unit DBC calculates the residual vectors in accordance with Equations (27) to (29). A first codebook cb1 of a first encoder CD1 has 128 sets (seven bits) of 10-dimensional code vectors. A distance calculation unit DSC1 calculates 128 sets of squared errors (Euclidean distances) between residual vectors $l_i$ (i=1~10) and code vectors l ($L_1$,i) (i=1~10), and an index detector IXD1 detects and outputs the index $L_1$ of the code vector for which the error is minimum from among the $L_1$=1~128 code vectors. A subtractor SBC subtracts the 10-dimensional vectors ($L_1$,i) (i=1~10) corresponding to the index $L_1$ of the first codebook cb1 from the 10-dimensional residual vectors $l_i$ (i=1~10) and creates a new target vector $l_i'$ (i=1~10). A second encoder CD2 searches the codebook cb2 in regard to the lower five dimensions $l_i'$ (i=1~5) of the new target vector to decide the index (code) $L_2$ of the code vector l' ($L_2$,i) (i=1~5) for which the mean-square error is minimum. Similarly, the third encoder CD3 searches the codebook cb3 in regard to the higher five dimensions $l_i'$ (i=6~10) of the new target vector to decide the index (code) $L_3$ of the code vector l' ($L_3$,i) (i=6~10) for which the mean-square error is minimum.

(b) Pitch-Lag Code Converter

Pitch-lag code conversion will be described next.

With the G.729A and AMR encoding methods, pitch lag is decided at one-third the sampling precision using a sample interpolation filter, as set forth in connection with the first embodiment. For this reason, two types of lag, namely integral lag and non-integral lag, exist. The relationship between pitch lag and indices in the G.729A method is illustrated in FIGS. 7A and 7B and not described again as it is identical that of the first embodiment. Further, the relationship between pitch lag and indices in the AMR method is as illustrated in FIGS. 8A and 8B and need not be described again as it is identical with that of the first embodiment. Accordingly, the methods of quantizing pitch lag and the numbers of quantization bits are exactly the same in the AMR and G.729A methods with regard to even-numbered subframes. This means that pitch-lag indices of even-numbered subframes in the AMR method can be converted to pitch-lag indices of 0th subframes in two consecutive frames of the G.729A method in accordance with the following equations:

$$I_LAG2(n,0)=I_LAG1(m,0) \tag{30}$$

$$I_LAG2(n+1,0)=I_LAG1(m,2) \tag{31}$$

With regard to odd-numbered subframes, a point in common is that the difference between integral lag Told in the previous subframe and pitch lag in the present subframe is quantized. With respect to the number (six) of quantization bits in the AMR method, the number is smaller than that (five) in the G.729A method. This makes necessary the following expedient:

First, integral lag Int(m,1) and non-integral lag Frac(m,1) are found from lag code I_LAG1(m,1) of the first subframe of the mth frame in the ATM method and the pitch lag is found by the following equation:

$$P=Int(m,1)+Frac(m,1)$$

The integral lag and non-integral lag corresponding to the indices (lag codes) are in one-to-one correspondence. If there are 28 lag codes, for example, then integral lag will be −1, non-integral lag will be −⅓, and pitch lag P will be −(1+⅓), as illustrated in FIG. 8B.

Next, it is determined whether the pitch lag P found falls within the 5-bit pitch-lag range $T_{old}$−(5+⅔) to $T_{old}$−(4+⅔) in the G.729A odd-numbered subframes shown in FIG. 7B. This range will be expressed as [$T_{old}$−(5+⅔), $T_{old}$+(4+⅔)] below. If the corresponding relationship between AMR-compliant pitch lag and indices and the corresponding relationship between G.729A-compliant pitch lag and indices in the odd-numbered subframes are compared, it will be found that there is a shift of 15 indices, as described earlier in connection with the first embodiment. Accordingly, if pitch lag P falls within the above-mentioned pitch-lag range, a correction is applied in accordance with the following equations:

$$I_LAG2(n,1)=I_LAG1(m,1)-15 \tag{32}$$

$$I_LAG2(n+1,1)=I_LAG1(m,3)-15 \tag{33}$$

As a result, pitch lag I_LAG1(m,1) in the AMR method can be converted to pitch lag I_LAG2(n,1) in the G.729A method. Similarly, pitch lag I_LAG1(m,3) in the AMR method can be converted to pitch lag I_LAG2(n+1,1) in the G.729A method.

If pitch lag P does not fall within the above-mentioned pitch-lag range, then pitch lag is clipped. That is, if pitch lag P is smaller than $T_{old}$−(5+⅔), e.g., if pitch lag P is equal to $T_{old}$−7, then pitch lag P is clipped to $T_{old}$−(5+⅔). If pitch lag P is greater than $T_{old}$+(4+⅔), e.g., if pitch lag P is equal to $T_{old}$+7, then pitch lag P is clipped to $T_{old}$+(4+⅔).

Though it may appear at a glance that such clipping of pitch lag will invite a decline in voice quality, preliminary experiments by the Inventors have demonstrated that there is almost no decline in sound quality even if such clipping processing is applied. It is known that in such voiced segments as "ah" and "ee", pitch lag varies smoothly and fluctuation in pitch lag P in voiced odd-numbered subframes is small, falling within the range $T_{old}$−(5+⅔), $T_{old}$+(4+⅔) in most cases. In fluctuating segments such as rising or falling segments, on the other hand, the value of pitch lag P exceeds the above-mentioned range. However, in segments where the quality of voice varies, the influence of the adaptive codebook on reconstructed voice derived from a periodic sound source declines. Hence there is almost no influence on the quality of sound even when clipping processing is executed. In accordance with the method described above, AMR-compliant pitch-lag code can be converted to G.729A-compliant pitch-lag code.

(c) Conversion of Algebraic Code

The conversion of algebraic code will be described next.

Though frame length in the AMR method differs from that in the G.729A method, subframe length is the same 5 ms (40 samples) and the structure of the algebraic code is exactly the same in both methods. Accordingly, the four pulse positions and the pulse polarity information that are results output from the algebraic codebook search in the AMR method can be replaced as is on a one-to-one basis by the results output from the algebraic codebook search in the G.729A method. The algebraic-code conversions, therefore, are as indicated by the following:

$$I_CODE2(n,0)=I_CODE1(m,0) \tag{34}$$

$$I_CODE2(n,1)=I_CODE1(m,1) \tag{35}$$

$$I_CODE2(n+1,0)=I_CODE1(m,2) \tag{36}$$

$$I_CODE2(n+1,1)=I_CODE1(m,3) \tag{37}$$

(d) Conversion of Gain Code

Conversion of gain code will be described next.

First, adaptive codebook gain code I_GAINa(m,0) of the 0th subframe in the mth frame of the AMR method is input to the adaptive codebook gain dequantizer 85$a_1$ to obtain the adaptive codebook gain dequantized value $G_a$. In accordance with the G.729A method, vector quantization is used to quantize the gain. The adaptive codebook gain dequantizer 85*a*1 has a 4-bit {16-pattern} adaptive codebook gain table the same as that of the AMR method and refers to this table to output the adaptive codebook gain dequantized value Ga, that corresponds to the code I&_GAIN1*a*(m,0).

Next, adaptive codebook gain code I_GAINc(m,0) of the 0th subframe in the mth frame of the AMR method is input to the noise codebook gain dequantizer 85*a*2 to obtain the algebraic codebook gain dequantized value Gc. In the AMR method, interframe prediction is used in the quantization of algebraic codebook gain i.e. gain as V predicted from the logarithmic energy of algebraic codebook gain of the past four subframes and the correction coefficients thereof are quantized. To accomplish this, the noise codebook gain dequantizer 85*a*2 which has a 5-bit (32-pattern) correction coefficient table the same as that of the AMR method finds a table value yc of a correction coefficient that corresponds to the code I_GAIN1*c*(m,0) and outputs the dequantized value Gc=(gc'×γc) of algebraic codebook gain. It should be noted that the gain prediction method is exactly the same as the prediction method performed by the AMR-compliant decoder.

Next, the gains Ga, GC are input to the gain quantizer 85*b* to effect a conversion to G.729A-compliant gain code. The gain quantizer 85*b* uses a 7-bit gain quantization table the same as that of the G.729A method. This quantization table is two-dimensional, the first element thereof is adaptive codebook gain $G_a$ and the second element is the correction coefficient $\gamma_c$ that corresponds to the algebraic codebook gain. Accordingly, in the G.729A method, an interframe prediction table is used in quantization of algebraic codebook gain and the prediction method is the same as that of the AMR method.

In the fourth embodiment, the sound-source signal on the AMR side is found using dequantized values obtained by the dequantizers 82*a*–85*a*$_2$ from the codes I_LAG1(m,0), I_CODE1(m,0), I_GAIN1*a*(m,0), I_GAIN1*c*(m,0) of the AMR method and the signal is adopted as a sound-source signal for reference purposes.

Next, pitch lag is found from the pitch-lag code I_LAG2(n,0) already converted to the G.729A method and the adaptive codebook output corresponding to this pitch lag is obtained. Further, the algebraic codebook output is created from the converted algebraic code I_CODE2(n,0). Thereafter, table values are extracted one set at a time in the order of the indices from the gain quantization table for G.729A and the adaptive codebook gain $G_a$ and algebraic codebook gain $G_c$ are found. Next, the sound-source signal (sound-source signal for testing) that prevailed when the conversion was made to the G.729A method is created from the adaptive codebook output, algebraic codebook output, adaptive codebook gain and algebraic codebook gain, and the error power between the sound-source signal for reference and the sound-source signal for testing is calculated. Similar processing is executed with regard to the gain quantization table values indicated by all of the indices and the index for which the smallest value of error power is obtained is adopted as the optimum gain quantization code.

The details of the processing procedure will now be described.

(1) First, adaptive codebook output $\text{pitch}_1(i)$ (i=0, 1, . . . , 39) corresponding to pitch-lag code I_LAG1 in the AMR method is found.

(2) The sound-source signal for reference is found from the following equation:

$$ex_1(i)=G_a\cdot\text{pitch}_1(i)+G_c\cdot\text{code}(i)\ (i=0,\ 1,\ .\ .\ .\ 39)$$

(3) Adaptive codebook output $\text{pitch}_2(i)$ (i=0, 1, . . . 39) corresponding to pitch-lag code I_LAG2(n,k) in the G.729A method is found.

(4) Table values $G_{a2}(L)$, $\gamma_c(L)$ corresponding to the Lth gain code are extracted from the gain quantization table.

(5) An energy component $g_c'$ predicted from the algebraic codebook gain of a past subframe is calculated and $G_{c2}(L)=g_c'\gamma_c(L)$ is obtained.

(6) The sound-source signal for testing is found from the following equation:

$$ex_2(i,L)=G_{a2}(L)\cdot\text{pitch}_2(i)+G_{c2}(L)\cdot\text{code}(i)\ (i=0,\ 1,\ .\ .\ .\ ,\ 39)$$

It should be noted that the algebraic codebook output code(i) is the same in both the AMR and G.729A methods.

(7) The square of the error is found from the following equation:

$$E(L)=[ex_i(i)-ex_2(i,L)]^2(i=0,\ 1\ ,\ .\ .\ .\ ,\ 39)$$

(8) The value of E(L) is calculated with regard to the patterns (L=0~127) of all indices of the gain quantization table and the L for which E(L) is minimized is output as the optimum gain code I_GAIN2(n,0).

In the foregoing description, the square of the error of the sound-source signal is used as a reference when the optimum gain code is retrieved. However, an arrangement may be adopted in which reconstructed voice is found from the sound-source signal and the gain code is retrieved in the region of the reconstructed voice.

(e) Code Transmission Processing

Since the frame lengths in the ARM and G.729A methods differ from each other, two frames of channel data in the G.729A method are obtained from one frame of channel data in the AMR method. Accordingly, the buffer 87 (FIG. 16) inputs the codes I_LSP2(n), I_LAG2(n,0), I_LAG2(n,1), I_CODE2(n,0), I_CODE2(n,1), I_GAIN2(n,0), I_GAIN2(n,1) to the code multiplexer 86. The latter multiplexes these input codes to create the voice signal of the nth frame in the G.729A method and sends the code to the transmission path as the line data.

Next, the buffer 87 inputs the codes I_LSP2(n+1), I_LAG2(n+1,0), I_LAG2(n+1,1), I_CODE2(n+1,0), I_CODE2(n+1,1), I_GAIN2(n+1,0), I_GAIN2(n+1,1) to the code multiplexer 86. The latter multiplexes these input codes to create the voice signal of the (n+1)th frame in the G.729A method and sends the code to the transmission path as the line data.

(F) Fifth Embodiment

The foregoing embodiments deal with cases in which there is no transmission-path error. In actuality, however, if wireless communication is employed as when using a cellular telephone, bit error or burst error occurs owing to the influence of phenomena such as phasing, the voice code changes to one different from the original and there are instances where the voice code of an entire frame is lost. If traffic is heavy over the Internet, transmission delay grows, the voice code of an entire frame may be lost or frames may change places in terms of their order.

(a) Effects of Transmission-Path Error

Figure 20:
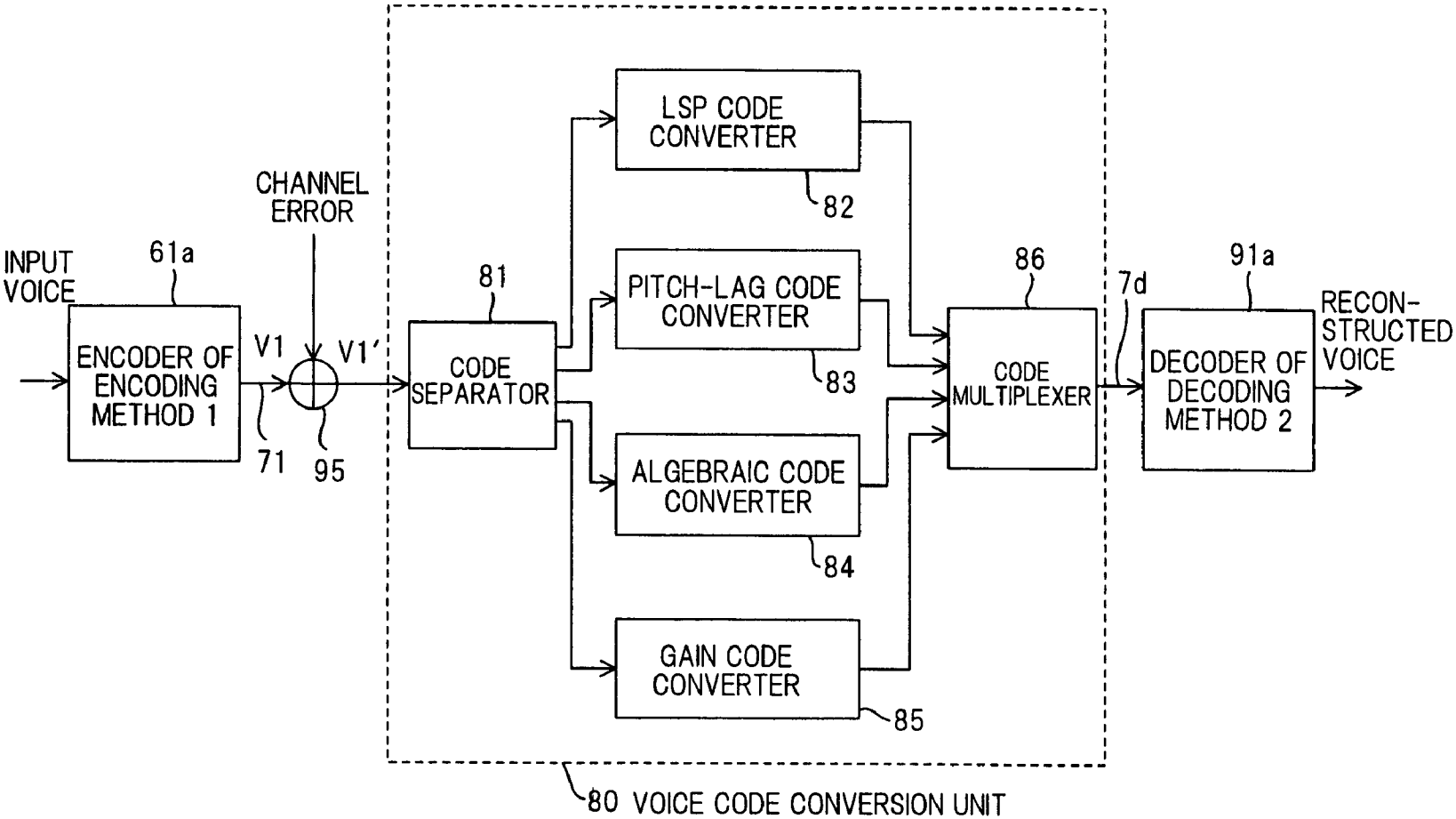
FIG. 20 is a block diagram useful in describing the intrusion of channel error into voice code.

FIG. 20 is a diagram useful in describing the effects of transmission-path error. Components in FIG. 20 that are identical with those shown in FIGS. 1 and 2 are designated by like reference characters. This arrangement differs in that it possesses a combiner 95 which simulates the addition of transmission-path error (channel error) to a transmit signal.

Input voice enters the encoder 61*a* of encoding method 1and the encoder 61*a* outputs a voice code V1 of encoding method 1. The voice code V1 enters the voice code conversion unit 80 through the transmission path (Internet, etc.) 71, which is wired. If channel error intrudes before the voice code V1 enters the voice code conversion unit 80, however, the voice code V1 is distorted into a voice code V1', which differs from the voice code V1, owing to the effects of such channel error. The voice code V1' enters the code separator 81, where it is separated into the parameter codes, namely the LSP code, pitch-lag code, algebraic code and gain code. The parameter codes are converted by respective ones of the code converters 82, 83, 84 and 85 to codes suited to the encoding method 2. The codes obtained by the conversions are multiplexed by the code multiplexer 86, whence a voice code V2 compliant with encoding method 2 is finally output.

Thus, if channel error intrudes prior to input of the voice code V1 to voice code conversion unit 80, conversion is carried out based upon the erroneous voice code V1' and, as a consequence, the voice code V2 obtained by the conversion is not necessarily the optimum code. With CELP, furthermore, an IIR filter is used as a voice synthesis filter. If the LSP code or gain code, etc., is not the optimum code owing to the effects of channel error, therefore, the filter often oscillates and produces a large abnormal sound. Another problem is that because of the properties of an IIR filter, once the filter oscillates, the vibration affects the ensuing frame. Consequently, it is necessary to reduce the influence which channel error has on the voice code conversion components.

(b) Principles of the Fifth Embodiment

Figure 21:
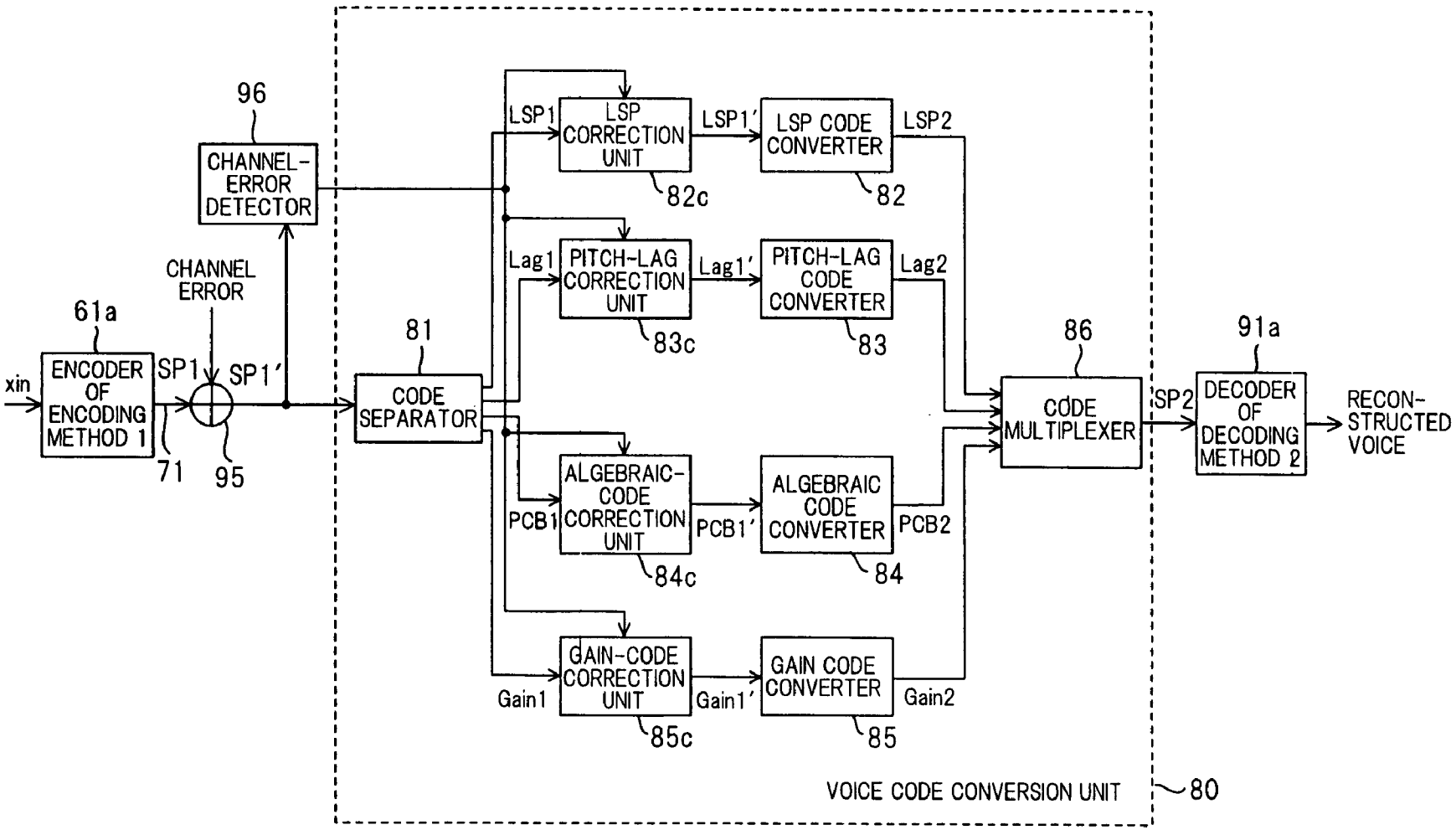
FIG. 21 is a block diagram useful in describing the principles of a fifth embodiment of the present invention.

FIG. 21 illustrates the principles of the fifth embodiment. Here encoding methods based upon CELP compliant with AMR and G.729A are used as the encoding methods 1 and 2.

In FIG. 21, input voice xin is input to the encoder 61*a* of encoding method 1so that a voice code sp1 of the encoding method 1 is produced. The voice code sp1 is input to the voice code conversion unit 80 through a wireless (radio) channel or wired channel (the Internet). If channel error ERR intrudes before the voice code sp1 enters the voice code conversion unit 80, the voice code sp1 is distorted into a voice code sp' that contains the channel error. The pattern of the channel error ERR depends upon the system and various patterns are possible, examples of which are random-bit error and burst error. If no error intrudes upon the input, then the codes sp1' and sp1 will be identical.

The voice code sp1' enters the code separator 81 and is separated into LSP code LSP1, pitch-lag code Lag1, algebraic code PCB1 and gain code Gain1. The voice code sp1' further enters a channel-error detector 96, which detects through a well-known method whether channel error is present or not. For example, channel error can be detected by adding a CRC code onto the voice code sp1 in advance or by adding data, which is indicative of the frame sequence, onto the voice code sp1 in advance.

The LSP code LSP1 enters an LSP correction unit 82*c*, which converts the LSP code LSP1 to an LSP code LSP1' in which the effects of channel error have been reduced. The pitch-lag code Lag1 enters a pitch-lag correction unit 83*c*, which converts the pitch-lag code Lag1 to a pitch-lag code Lag1' in which the effects of channel error have been reduced. The algebraic code PCB1 enters an algebraic-code correction unit 84*c*, which converts the algebraic code PCB1 to an algebraic code PCB1' in which the effects of channel error have been reduced. The gain code Gain1 enters a gain-code correction unit 85*c*, which converts the gain code Gain1 to a gain code Gain1' in which the effects of channel error have been reduced.

Next, the LSP code LSP1' is input to the LSP code converter 82 and is converted thereby to an LSP code LSP2 of encoding method 2, the pitch-lag code Lag1' is input to the pitch-lag code converter 83 and is converted thereby to an pitch-lag code Lag2 of encoding method 2, the algebraic code PCB1' is input to the algebraic code converter 84 and is converted thereby to an algebraic code PCB2 of encoding method 2, and the gain code Gain1' is input to the gain code converter 85 and is converted thereby to a gain code Gain2 of encoding method 2.

The codes LSP2, Lag2, PCB2 and Gain2 are multiplexed by the code multiplexer 86, which outputs a voice code sp2 of encoding method 2.

By adopting this arrangement, it is possible to diminish a decline in post-conversion voice quality due to channel error, which is a problem with the conventional voice code converter.

(c) Voice Code Converter According to the Fifth Embodiment

Figure 22:
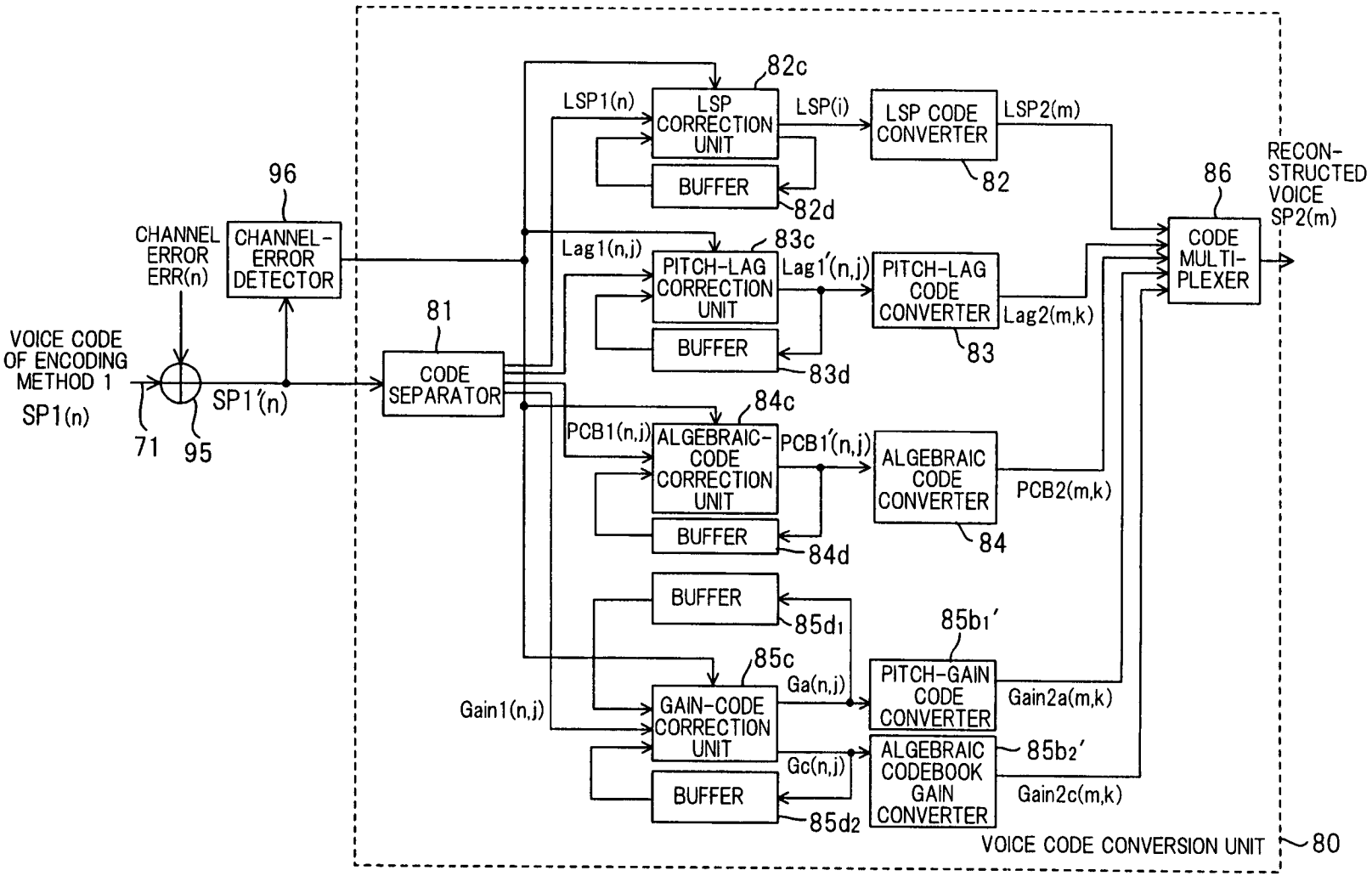
FIG. 22 is a block diagram showing the fifth embodiment.
Figure 23:
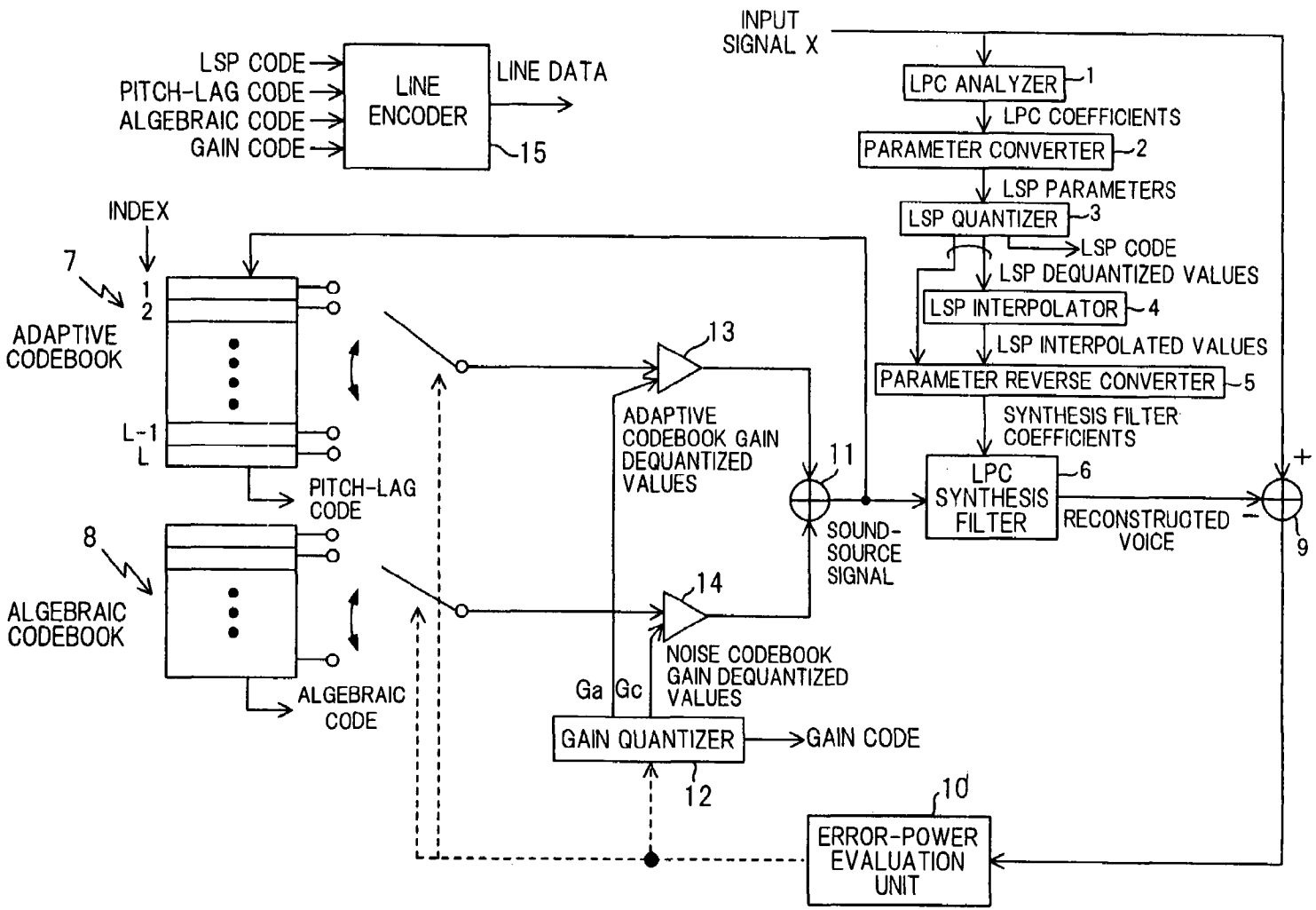
FIG. 23 PRIOR ART
FIG. 23 is a block diagram of an encoder based upon ITU-T G.729A code conversion according to the prior art.
Figure 24:
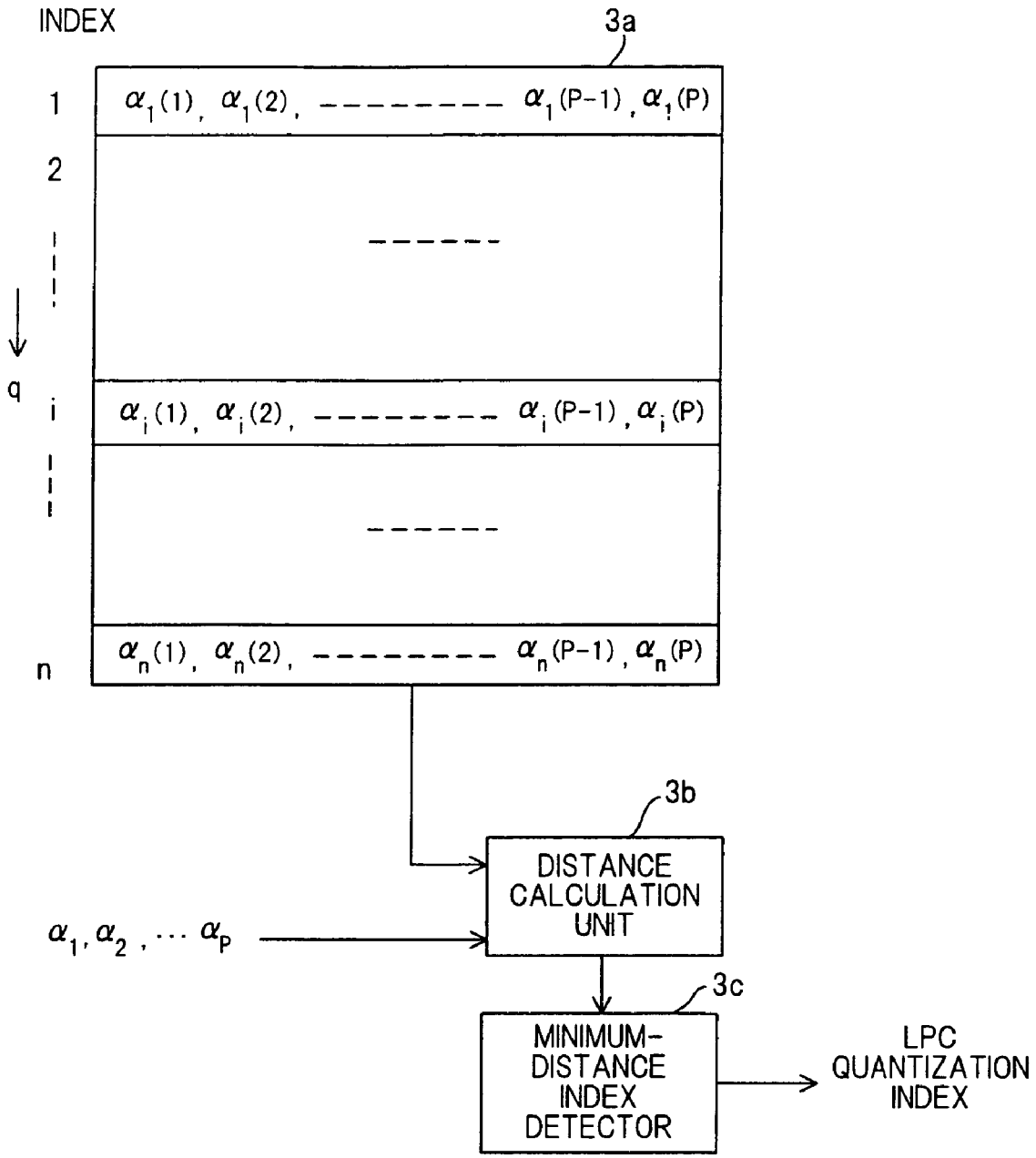
FIG. 24 PRIOR ART
FIG. 24 is a diagram useful in describing a quantization method according to the prior art.
Figure 25:
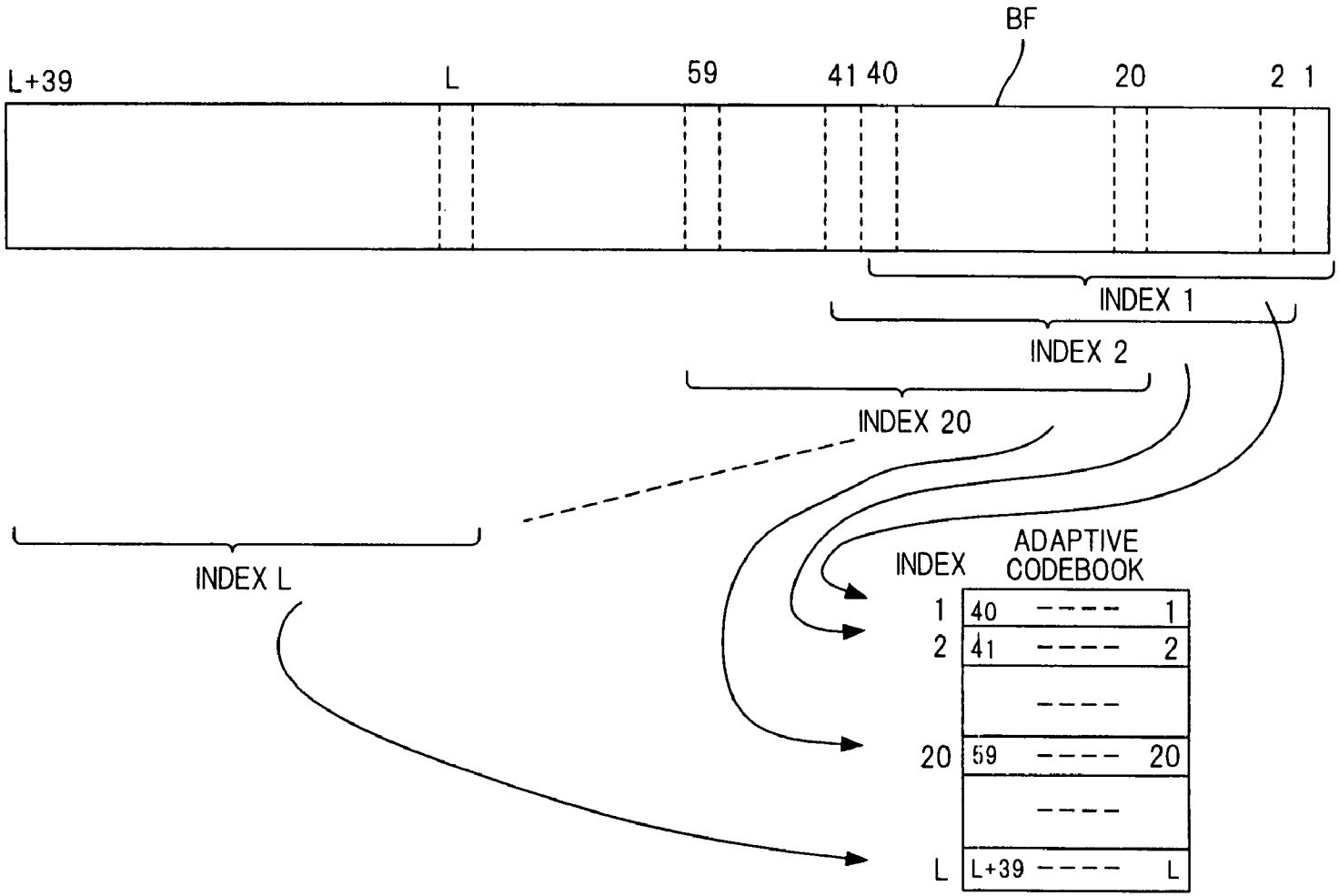
FIG. 25 PRIOR ART
FIG. 25 is a diagram useful in describing an adaptive codebook according to the prior art.

FIG. 22 is a block diagram illustrating the structure of the voice code converter of the fifth embodiment. This illustrates a case where G.729A and AMR are used as the encoding methods 1 and 2, respectively. It should be noted that although there are eight AMR encoding modes, FIG. 22 illustrates a case where 7.94 kbps is used. In FIG. 22, a voice code sp1(n), which is a G.729A-compliant encoder output of an nth frame, is input to the voice code conversion unit 80. Since the G.729A bit rate is 8 kbps, sp1(n) is represented by a bit sequence of 80 bits. The code separator 81 separates the voice code sp1(n) into the LSP code LSP1(n), pitch-lag code Lag1(n,j), algebraic code PCB1(n,j) and gain code Gain1(n,j). The suffix j in the parentheses represents the subframe number and takes on values of 0 and 1.

If channel error ERR intrudes before the voice code sp1(n) enters the voice code conversion unit 80, the voice code sp1(n) is distorted into a voice code sp1'(n) that contains the channel error. The pattern of the channel error ERR depends upon the system and various patterns are possible, examples of which are random-bit error and burst error. If burst error occurs, the information of an entire frame is lost and voice cannot be reconstructed correctly. Further, if voice code of a certain frame does not arrive within a prescribed period of time owing to network congestion, this situation is dealt with by assuming that there is no frame. As a consequence, the information of an entire frame may be lost and voice cannot be reconstructed correctly. This is referred to as "frame disappearance" and necessitates measures just as channel error does. If no error intrudes upon the input, then the codes sp1'(n) and sp1(n) will be exactly the same.

The particular method of determining whether channel error or frame disappearance has occurred or not differs depending upon the system. In the case of a cellular telephone system, for example, the usual practice is to add an error detection code or error correction code onto the voice code. The channel-error detector 96 is capable of detecting whether the voice code of the present frame contains an error based upon the error detection code. Further, if the entirety of one frame's worth of voice code cannot be received within a prescribed period of time, this frame can be dealt with by assuming frame disappearance.

The LSP code LSP1(n) enters the LSP correction unit 82*c*, which converts this code to an LSP parameter lsp(i) in which the effects of channel error have been reduced. The pitch-lag code Lag1(n,j) enters the pitch-lag correction unit 83*c*, which converts this code to a pitch-lag code Lag1'(n,j) in which the effects of channel error have been reduced. The algebraic code PCB1(n,j) enters the algebraic-code correction unit 84*c*, which converts this code to an algebraic code PCB1'(n,j) in which the effects of channel error have been reduced. The gain code Gain1(n,j) enters the algebraic-code correction unit 85*c*, which converts this code to a pitch gain Ga(n,j) and algebraic codebook gain Gc(n,j) in which the effects of channel error have been reduced.

If channel error or frame disappearance has not occurred, the LSP correction unit 82*c* outputs an LSP parameter lsp(i) that is identical with that of the first embodiment, the pitch-lag correction unit 83*c* outputs a code, which is exactly the same as Lag1(n,j), as Lag1'(n,j), the algebraic-code correction unit 84*c* outputs a code, which is exactly the same as PCB1(n,j), as PCB1'(n,j), and the gain-code correction unit 85*c* outputs a pitch gain Ga(n,j) and algebraic codebook gain Gc(n,j) that are identical with those of the first embodiment.

(d) LSP Code Correction and LSP Code Conversion

The LSP correction unit 82*c* will now be described.

If an error-free LSP code LSP1(n) enters the LSP correction unit 82*c*, the latter executes processing similar to that of the LSP dequantizer 82*a* of the first embodiment. That is, the LSP correction unit 82*c* divides LSP1(n) into four smaller codes $L_0$, $L_1$, $L_2$ and $L_3$. The code $L_1$ represents an element number of the LSP codebook CB1, and the codes $L_2$, $L_3$ represent element numbers of the LSP codebooks $CB_2$, $CB_3$, respectively. The LSP codebook CB1 has 128 sets of 10-dimensional vectors, and the LSP codebooks CB2 and CB3 both have 32 sets of 5-dimensional vectors. The code $L_0$ indicates which of two types of MA prediction coefficients (described later) to use. A residual vector $l_i^{(n)}$ of the nth frame is found by the following equation:

$$l_i^{(n)} = \begin{cases} CB1(L_1, i) + CB2(L_2, i) & (i = 1, \ldots, 5) \\ CB1(L_1, i) + CB3(L_3, i-5) & (i = 6, \ldots, 10) \end{cases} \tag{38}$$

Next, an LSF coefficient ω(i) is found from the residual vector $l_i^{(n)}$ and residual vectors $l_i^{(n-k)}$ of the last most recent four frames in accordance with the following equation:

$$\omega(i) = \left(1 - \sum_{k=1}^{4} p(i, k)\right) l_i^{(n)} + \sum_{k=1}^{4} p(i, k) l_i^{(n-k)}, \ (i = 1, \ldots, 10) \tag{39}$$

where p(i,k) represents which coefficient of the two types of MA prediction coefficients has been specified by the code $L_0$. The residual vector $l_i^{(n)}$ is held in a buffer 82*d* for the sake of frames from the next frame onward. Thereafter, the LSP correction unit 82*c* finds the LSP parameter lsp(i) from the LSP coefficient ω(i) using the following equation:

$$lsp(i) = \cos[\omega(i)] \ (i = 1, \ldots, 10) \tag{40}$$

Thus, if channel error or frame disappearance has not occurred, the input to the LSP code converter 82 can be created by calculating LSP parameters, through the above-described method, from LSP code received in the present frame and LSP code received in the past four frames.

The above-described procedure cannot be used if the correct LSP code of the present frame cannot be received owing to channel error or frame disappearance. In the fifth embodiment, therefore, if channel error or frame disappearance has occurred, the LSP correction unit 82*c* uses the following Equation to create the residual vector $l_i^{(n)}$ from the past four good frames of LSP code received last:

$$l_i^{(n)} = \left[\hat{\omega}_i^{(m)} - \sum_{k=1}^{4} p(i, k) l_i^{(n-k)}\right] \Big/ \left[1 - \sum_{k=1}^{4} p(i, k)\right], \ (i = 1, \ldots, 10) \tag{41}$$

where p(i,k) represents the MA prediction coefficient of the last good frame received.

Thus, as set forth above, the residual vector $t_i^{(n)}$ of the present frame can be found in accordance with Equation (41) in this embodiment even if the voice code of the present frame cannot be received owing to channel error or frame disappearance.

The LSP code converter 82 executes processing similar to that of the LSP quantizer 82*b* of the first embodiment. That is, the LSP parameter lsp(i) from the LSP correction unit 82*c* is input to the LSP code converter 82, which then proceeds to obtain the LSP code for AMR by executing dequantization processing identical with that of the first embodiment.

(e) Pitch-lag Correction and Pitch-lag Code Conversion

The pitch-lag correction unit 83*c* will now be described. If channel error and frame disappearance have not occurred, the pitch-lag correction unit 83*c* outputs the received lag code of the present frame as Lag1'(n,j). If channel error or frame disappearance has occurred, the pitch-lag correction unit 83*c* acts so as to output, as Lag1'(n,j), the last good frame of pitch-lag code received. This code has been stored in buffer 83*d*. It is known that pitch lag generally varies gradually in voiced segments. In a voiced segment, therefore, there is almost no decline in sound quality even if the pitch lag of the preceding frame is substituted, as mentioned earlier. It is known that pitch lag undergoes a large conversion in unvoiced segments. However, since the contribution in the adaptive codebook in unvoiced segments is small (pitch gain is low), there is almost no decline in sound quality caused by the above-described method.

The pitch-lag code converter 83 performs the same pitch-lag code conversion as that of the first embodiment. Specifically, whereas frame length according to the G.729A method is 10 ms, frame length according to AMR is 20 ms. When pitch-lag code is converted, therefore, it is necessary that two frame's worth of pitch-lag code according to G.729A be converted as one frame's worth of pitch-lag code according to AMR. Consider a case where pitch-lag codes of the nth and (n+1)th frames in the G.729A method are converted to pitch-lag code of the mth frame in the AMR method. A pitch-lag code is the result of combining integral lag and non-integral into one word. In even-numbered subframes, the methods of synthesizing pitch-lag codes in the G.729A and AMR methods are exactly the same and the numbers of quantization bits are the same, i.e., eight. This means that the pitch-lag code can be converted in the manner indicated by the following equations:

$$LAG2(m,0) = LAG1'(n,0) \tag{42}$$

$$LAG2(m,2) = LAG1'(n+1,0) \tag{43}$$

Further, quantization of the difference between integral lag of the present frame and integral lag of the preceding subframe is performed in common for the odd-numbered subframes. However, since the number of quantization bits is one larger for the AMR method, the conversion can be made as indicated by the following equations:

$$LAG2(m,1) = LAG1'(n,1) + 15 \tag{44}$$

$$LAG2(m,3) = LAG1'(n+1,1) + 15 \tag{45}$$

(f) Algebraic Code Correction and Algebraic Code Conversion

If channel error and frame disappearance have not occurred, the algebraic-code correction unit 84*c* outputs the received algebraic code of the present frame as PCB1'(n,j). If channel error or frame disappearance has occurred, the algebraic-code correction unit 84*c* acts so as to output, as PCB1'(n,j), the last good frame of algebraic code received. This code has been stored in buffer 84*d*.

The algebraic code converter 84 performs the same algebraic code conversion as that of the first embodiment. Specifically, although frame length in the G.729A method differs from that in the AMR method, subframe length is the same for both, namely 5 ms (40 samples). Further, the structure of the algebraic code is exactly the same in both methods. Accordingly, the pulse positions and the pulse polarity information that are the results output from the algebraic codebook search in the G.729A method can be replaced as is on a one-to-one basis by the results output from the algebraic codebook search in the AMR method. The algebraic-code conversions are as indicated by the following:

$$PCB2(m,0)=PCB1'(n,0) \quad (46)$$

$$PCB2(m,1)=PCB1'(n,1) \quad (47)$$

$$PCB2(m,2)=PCB1'(n+1,0) \quad (48)$$

$$PCB2(m,3)=PCB1'(n+1,1) \quad (49)$$

(g) Gain Code Correction and Gain Code Conversion

If channel error and frame disappearance have not occurred, the gain-code correction unit 85*c* finds the pitch gain Ga(n,j) and the algebraic codebook gain Gc(n,j) from the received gain code Gain1(n,j) of the present frame in a manner similar to that of the first embodiment. However, in accordance with the G.729A method, the algebraic codebook gain is not quantized as is. Rather, quantization is performed with the participation of the pitch gain Ga(n,j) and a correction coefficient $\gamma_c$ for algebraic codebook gain.

Accordingly, when the gain code Gain1(n,j) is input thereto, the gain-code correction unit 85*c* obtains the pitch gain Ga(n,j) and correction coefficient $\gamma_c$ corresponding to the gain code Gain1(n,j) from the G.729A gain quantization table. Next, using the correction coefficient $\gamma_c$ and prediction value $g_c'$, which is predicted from the logarithmic energy of algebraic codebook gain of the past four subframes, the gain-code correction unit 85*c* finds algebraic codebook gain Gc(n,j) in accordance with Equation (21).

If channel error or frame disappearance has occurred, the gain code of the present frame cannot be used. Accordingly, pitch gain Ga(n,j) and algebraic codebook gain Gc(n,j) are found by attenuating the gain of the immediately preceding subframe stored in buffers 85*d*1, 85*d*2, as indicated by Equations (50) to (53) below. Here α, β are constants equal to 1 or less. Pitch gain Ga(n,j) and algebraic codebook gain Gc(n,j) are the outputs of the gain-code correction unit 85*c*.

$$Ga(n,0)=\alpha\cdot Ga(n-1) \quad (50)$$

$$Ga(n,1)=\alpha\cdot Ga(n,0) \quad (51)$$

$$Gc(n,0)=\beta\cdot Gc(n-1,1) \quad (52)$$

$$Gc(n,1)=\beta\cdot Gc(n,0) \quad (53)$$

Gain converters 85$b_1$', 85$b_2$' will now be described.

In the AMR method, pitch gain and algebraic codebook gain are quantized separately. However, algebraic codebook gain is not quantized directly. Rather, a correction coefficient for algebraic codebook gain is quantized. First, pitch gain Ga(n,0) is input to pitch gain converter 85$b_1$' and is subjected to scalar quantization. Values of 16 types (four bits) the same as those of the AMR method have been stored in the scalar quantization table. The quantization method includes calculating the square of the error between the pitch gain Ga(n,0) and each table value, adopting the table value for which the smallest error is obtained as the optimum value and adopting this index as the gain2*a*(m,0).

The algebraic codebook gain converter 85$b_2$' scalar-quantizes $\gamma_c$(n,0). Values of 32 types (five bits) the same as those of the AMR method have been stored in this scalar quantization table. The quantization method includes calculating the square of the error between $\gamma_c$(n,0) and each table value, adopting the table value for which the smallest error is obtained as the optimum value and adopting this index as the gain2*c*(m,0).

Similar processing is executed to find Gain2*a*(m,1) and Gain2*c*(m,1) from Gain1(n,1). Further, Gain2*a*(m,2) and Gain2*c*(m,2) are found from Gain1(n+1,0), and Gain2*a*(m,3) and Gain2*c*(m,3) are found from Gain1(n+1,1).

(h) Code Multiplexing

The code multiplexer 86 retains converted code until the processing of two frame's worth (one frame's worth in the AMR method) of G.729A code is completed, processes two frames of the G.729A code and outputs voice code sp2(m) when one frame's worth of AMR code has been prepared in its entirety.

Thus, as described above, this embodiment is such that if channel error or frame disappearance occurs, it is possible to diminish the effects of the error when G.729A voice code is converted to AMR code. As a result, it is possible to achieve excellent voice quality in which a decline in the quality of sound is diminished in comparison with the conventional voice code converter.

Thus, in accordance with the present invention, codes of a plurality of components necessary to reconstruct a voice signal are separated from a voice code based upon a first voice encoding method, the code of each component is dequantized and the dequantized values are quantized by a second encoding method to achieve the code conversion. As a result, delay can be reduced over that encountered with the conventional tandem connection and a decline in sound quality can be reduced as well.

Further, in accordance with the present invention, in a case where LSP code of the first excitation signal is dequantized and a dequantized value LSP1(i) is quantized by the second encoding method to achieve the code conversion when a conversion of LSP code is performed, not only a first distance (error) between the dequantized value LSP1(i) and a dequantized value LSPc3(i) of LSP code obtained by conversion but also a second distance (error) between an intermediate LSP code dequantized value LSP0(i) of the first encoding method and an intermediate LSP code dequantized value LSPc1(i) of the second encoding method calculated by interpolation is taken into account and input to achieve the LSP code conversion. As a result, it is possible to perform an excellent voice code conversion with little conversion error even in a case where the quality of input voice varies within the frame.

Further, in accordance with the present invention, the first and second distances are weighted and an LPC coefficient dequantized value LSP1(i) is encoded to an LPC code in the second encoding method in such a manner that the sum of the weighted first and second distances will be minimized. This makes it possible to perform a voice code conversion with a smaller conversion error.

Further, in accordance with the present invention, LPC coefficients are expressed by n-order vectors, the n-order vectors are divided into a plurality of small vectors (low-, midrange- and high-frequency vectors), a plurality of code candidates for which the sum of the first and second distances will be small is calculated for each small vector, codes are selected one at a time from the plurality of code candidates of each small vector and are adopted as n-order LPC codes, and an n-order LPC code is decided based upon a combination for which the sum of the first and second distances is minimized. As a result, a voice code conversion that makes possible the reconstruction of sound of higher quality can be performed.

Further, in accordance with the present invention, it is possible to provide excellent reconstructed voice after conversion by diminishing a decline in sound quality caused by channel error, which is a problem with the conventional voice code converter. In particular, in the case of CELP algorithms used widely in low-bit-rate voice encoding in recent years, an IIR filter is used as a voice synthesis filter and, as a result, the system is susceptible to the influence of channel error and large abnormal sounds are often produced by oscillation. The improvement afforded by the present invention is especially effective in dealing with this problem.

It should be noted that although the present invention has been described with regard to voice signals and voice codes, it is applicable to other sound-related signals and codes, which may be referred to as "acoustic signals" and "acoustic codes".

As many apparently widely different embodiments of the present invention can be made without departing from the spirit and scope thereof, it is to be understood that the invention is not limited to the specific embodiments thereof except as defined in the appended claims.

What is claimed is:

1. A voice code conversion apparatus, in which a fixed number of samples of a voice signal. is adopted as one frame, for obtaining a first LPC code obtained by quantizing linear prediction coefficients (LPC coefficients), which are obtained by frame-by-frame linear prediction analysis, or LSP parameters found from these LPC coefficients; a first pitch-lag code, which specifies an output signal of an adaptive codebook that is for outputting a periodic sound-source signal; a first noise code, which specifies an output signal of a noise codebook that is for outputting a noisy sound-source signal; and a first gain code obtained by quantizing adaptive codebook gain, which represents amplitude of the output signal of the adaptive codebook, and noise codebook gain, which represents amplitude of the output signal of the noise codebook; wherein a method for encoding the voice signal by these codes is assumed to be a first voice encoding method and a method for encoding the voice signal by a second LPC code, a second pitch-lag code, a second noise code and a second gain code, which are obtained by quantization in accordance with a quantization method different from that of the first voice encoding method, is assumed to be a second voice encoding method; and wherein voice code that has been encoded by the first voice encoding method is input to said apparatus for being converted to voice code of the second voice encoding method; said apparatus comprising:

LPC code conversion means for dequantizing the first LPC code by an LPC dequantization method according to the first voice encoding method, and quantizing the dequantized values of LPC coefficients using an LPC quantization table according to the second voice encoding method to find the second LPC code;

pitch-lag conversion means for converting the first pitch-lag code to the second pitch-lag code by conversion processing that takes into consideration a difference between the pitch-lag code according to the first voice encoding method and the pitch-lag code according to the second voice encoding method;

noise code conversion means for converting the first noise code to the second noise code by conversion processing that takes into consideration a difference between the noise code according to the first voice encoding method and the noise code according to the second voice encoding method;

gain dequantization means for dequantizing the first gain code by a gain dequantization method according to the first voice encoding method to thereby find a gain dequantized value; and gain code conversion means for quantizing the gain dequantized value using a gain quantization table according to the second voice encoding method to convert the gain dequantized value to the second gain code.

2. The apparatus according to claim 1, wherein said gain dequantization means finds a dequantized value of adaptive codebook gain and a dequantized value of noise codebook gain by dequantizing the first gain code by the gain dequantization method according to the first voice encoding method; and said gain code conversion means generates adaptive codebook gain code and noise codebook gain code by separately quantizing the dequantized values of the adaptive codebook gain and noise codebook gain using the gain quantization table according to the second voice encoding method, and constructs the second gain code from these two gain codes.

3. The apparatus according to claim 2, wherein said gain code conversion means includes:

first gain code converting means for generating the adaptive codebook gain code by quantizing the dequantized value of adaptive codebook gain using the gain quantization table according to the second voice encoding method; and second gain code converting means for generating the noise codebook gain code by quantizing the dequantized value of noise codebook gain using the gain quantization table according to the second voice encoding method.

4. The apparatus according to claim 1, wherein frame length according to the first voice encoding method is half the frame length according to the second voice encoding method, a frame according to the first voice encoding method includes two subframes, a frame according to the second voice encoding method includes four subframes, the first voice encoding method expresses pitch-lag code by $n_0$, $n_1$ bits subframe by subframe and the second voice encoding method expresses pitch-lag code by $n_0$, $(n_1+1)$, $n_0$, $(n_1+1)$ bits subframe by subframe, and said pitch-lag code conversion means converts the first pitch-lag code to the second pitch-lag code by:

creating four consecutive subframes, in which pitch-lag code is expressed successively by the $n_0$, $n_1$, $n_0$, $n_1$, bits, from two consecutive frames according to the first voice encoding method;

adopting said pitch-lag codes of the first and third subframes as pitch-lag codes of the first and third subframes according to the second voice encoding method; and adopting pitch-lag codes, which are obtained by adding a constant value to said pitch-lag codes of the second and fourth subframes, as pitch-lag codes of the second and fourth subframes of the second voice encoding method.

5. The apparatus according to claim 1, wherein frame length according to the first voice encoding method is half the frame length according to the second voice encoding method, a frame according to the first voice encoding method includes two subframes, a frame according to the second voice encoding method includes four subframes, the first voice encoding method expresses noise code by $m_1$, $m_1$ bits subframe by subframe and the second voice encoding method expresses noise code by $m_1$, $m_1$, $m_1$, $m_1$ bits subframe by subframe, and said noise code conversion means converts the first noise code to the second noise code by:

creating four consecutive subframes, in which noise code is expressed successively by the $m_1$, $m_1$, $m_1$, $m_1$ bits, from two consecutive frames according to the first voice encoding method; and adopting said noise codes of the first to fourth subframes as noise codes of the first to fourth subframes according to the second voice encoding method.

6. The apparatus according to claim 1, wherein said LPC code conversion means includes:

a first arithmetic unit for calculating a first distance between a dequantized value of the first LPC code and a dequantized value of the second LPC code that has been found;

an interpolator for interpolating a dequantized value of an intermediate second LPC code using a dequantized value of the second LPC code of a present frame and a dequantized value of the second LPC code of the previous frame;

a second arithmetic unit for calculating a second distance between a dequantized value of an intermediate first LPC code and a dequantized value of the intermediate second LPC code that has been found by the interpolation; and an encoder for encoding dequantized values of the 20 LPC coefficients to the second LPC codes so as to minimize the sum of the first and second distances.

7. The apparatus according to claim 6, further comprising weighting means for weighting the first and second distances, wherein said encoder encodes the dequantized values of the LPC coefficients to the second LPC codes so as to minimize the sum of the weighted first and second distances.

8. The apparatus according to claim 7, wherein said LPC code conversion means includes:

code candidate calculation means which, when LPC coefficients are expressed by an n-order vector and the n-order vector is divided into a plurality of small vectors, is for calculating a plurality of code candidates, for which the sum of the first and second distances is small, on a per-small-vector basis; and LPC code decision means which, when codes are selected one at a time from among the plurality of code candidates of each small vector and are adopted as an n-order LPC code of LPC coefficient dequantized values, is for deciding an n-order LPC code for which the sum of the first and second distances will be minimized and adopting this LPC code as the second LPC code.

9. A voice code conversion apparatus, in which a fixed number of samples of a voice signal is adopted as one frame, for obtaining a first LPC code obtained by quantizing linear prediction coefficients (LPC coefficients), which are obtained by frame-by-frame linear prediction analysis, or LSP parameters found from these LPC coefficients; a first pitch-lag code, which specifies an output signal of an adaptive codebook that is for outputting a periodic sound-source signal; a first noise code, which specifies an output signal of a noise codebook that is for outputting a noisy sound source signal; a first adaptive codebook gain code obtained by quantizing adaptive codebook gain, which represents amplitude of the output signal of the adaptive codebook; and a first noise codebook gain code obtained by quantizing noise codebook gain, which represents amplitude of the output signal of the noise codebook; wherein a method for encoding the voice signal by these codes is assumed to be a first voice encoding method and a method for encoding the voice signal by a second LPC code, a second pitch lag code, a second noise code and a second gain code, which are obtained by quantization in accordance with a quantization method different from that of the first voice encoding method, is assumed to be a second voice encoding method; and wherein voice code that has been encoded by the first voice encoding method is input to said apparatus for being converted to voice code of the second voice encoding method; said apparatus comprising:

LPC code conversion means for dequantizing the first LPC code by an LPC dequantization method according to the first voice encoding method, and quantizing the dequantized values of LPC coefficients using an LPC quantization table according to the second voice encoding method to find the second LPC code;

pitch-lag conversion means for converting the first pitch-lag code to the second pitch-lag code by conversion processing that takes into consideration a difference between the pitch-lag code according to the first voice encoding method and the pitch-lag code according to the second voice encoding method;

noise code conversion means for converting the first noise code to the second noise code by conversion processing that takes into consideration a difference between the noise code according to the first voice encoding method and the noise code according to the second voice encoding method; and gain code conversion means for generating the second gain code by collectively quantizing, using a gain quantization table according to the second voice encoding method, a dequantized value obtained by dequantizing the first adaptive codebook gain code by a gain dequantization method according to the first voice encoding method, and a dequantized value obtained by dequantizing the first noise codebook gain code by the gain dequantization method according to the first voice encoding method.

10. The apparatus according to claim 9, wherein said LPC code conversion means includes:

a first arithmetic unit for calculating a first distance between a dequantized value of the first LPC code and a dequantized value of the second LPC code that has been found;

an interpolator for interpolating a dequantized value of an intermediate second LPC code using a dequantized value of the second LPC code of a present frame and a dequantized value of the second LPC code of the previous frame;

a second arithmetic unit for calculating a second distance between a dequantized value of an intermediate first LPC code and a dequantized value of the intermediate second LPC code that has been found by the interpolation; and an encoder for encoding dequantized values of the 5 LPC coefficients to the second LPC codes so as to minimize the sum of the first and second distances.

11. The apparatus according to claim 10, further comprising weighting means for weighting the first and second distances, wherein said encoder encodes the dequantized values of the LPC coefficients to the second LPC code so as to minimize the sum of the weighted first and second distances.

12. The apparatus according to claim 11, wherein said LPC code conversion means includes:

code candidate calculation means which, when LPC coefficients or LSP parameters are expressed by an n-order vector and the n-order vector is divided into a plurality of small vectors, is for calculating a plurality of code candidates, for which the sum of the first and second distances is small, on a per-small-vector basis; and LPC code decision means which, when codes are selected one at a time from among the plurality of code candidates of each small vector and are adopted as an n-order LPC code of LPC coefficient dequantized values, is for deciding an n-order LPC code for which the sum of the first and second distances will be minimized and adopting this LPC code as the second LPC code.

13. The apparatus according to claim 9, wherein frame length according to the first voice encoding method is twice the frame length according to the second voice encoding method, a frame according to the first voice encoding method includes four subframes, a frame according to the second voice encoding method includes two subframes, the first voice encoding method expresses pitch-lag code by $n_0$, $(n_1+1)$, $n_0$, $(n_1+1)$ bits subframe by subframe and the second voice encoding method expresses pitch-lag code by $n_0$, $n_1$, bits subframe by subframe, and said pitch-lag code conversion means converts the first pitch-lag code to the second pitch-lag code by:

adopting pitch-lag codes of the first and third subframes, from among the pitch-lag codes expressed by the $n_0$, $(n_1+1)$, $n_0$, $(n_1+1)$ bits in four consecutive subframes according to the first voice encoding method, as pitch-lag codes of first subframes of consecutive first and second frames according to the second voice encoding method; and adopting pitch-lag codes, which are obtained by subtracting a constant value from the pitch-lag codes of the second and fourth subframes, as pitch-lag codes of second subframes of consecutive first and second frames according to the second voice encoding method.

14. The apparatus according to claim 9, wherein frame length according to the first voice encoding method is twice the frame length according to the second voice encoding method, a frame according to the first voice encoding method includes four subframes, a frame according to the second voice encoding method includes two subframes, the first voice encoding method expresses each of the noise codes of the four subframes by $m_1$, $m_1$, $m_1$, $m_1$ and the second voice encoding method expresses each of the noise codes of the two subframes by $m_1$, $m_1$, and said noise code conversion means converts the first noise code to the second noise code by:

adopting the noise codes of the first and second subframes according to the first voice encoding method as noise codes of first and second subframes of the first frame according to the second voice encoding method; and adopting the noise codes of the third and fourth subframes according to the first voice encoding method as noise codes of first and second subframes of the second frame according to the second voice encoding method.

* * * * *